US010961007B2

(12) United States Patent
Pfeffer

(10) Patent No.: US 10,961,007 B2
(45) Date of Patent: Mar. 30, 2021

(54) LABELLING MACHINE WITH A CONTROLLED BRAKE ASSEMBLY AND METHOD OF ITS OPERATION

(71) Applicant: Videojet Technologies Inc., Wood Dale, IL (US)

(72) Inventor: Gary Pfeffer, Woodthorpe (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 16/663,755

(22) Filed: Oct. 25, 2019

(65) Prior Publication Data

US 2020/0055628 A1 Feb. 20, 2020

Related U.S. Application Data

(62) Division of application No. 15/523,112, filed as application No. PCT/GB2015/053283 on Oct. 30, 2015, now Pat. No. 10,507,947.

(30) Foreign Application Priority Data

Oct. 31, 2014 (GB) ..... 1419486

(51) Int. Cl.
*B65C 9/18* (2006.01)
*B65C 9/42* (2006.01)

(52) U.S. Cl.
CPC ..... *B65C 9/1865* (2013.01); *B65C 9/42* (2013.01)

(58) Field of Classification Search
CPC ..... B65C 9/0006; B65C 9/1865; B65C 9/40; B65C 9/42; B65C 2009/401;
(Continued)

(56) References Cited

U.S. PATENT DOCUMENTS 9,850,018 B2 12/2017 McNestry et al.
10,065,760 B2 * 9/2018 McNestry ..... B65C 9/0006
(Continued)

FOREIGN PATENT DOCUMENTS

WO 199516612 A1 6/1995
WO 2010018368 A2 2/2010
(Continued)

OTHER PUBLICATIONS

PCT/GB2015/053283 International Search Report and Written Opinion, dated May 19, 2016, 18 pages.

*Primary Examiner* — George R Koch
(74) *Attorney, Agent, or Firm* — Wolter Van Dyke Davis, PLLC; Robert L. Wolter

(57) ABSTRACT

A labelling machine comprises a supply spool support for supporting a supply spool comprising label stock; a take-up spool support adapted to take up a portion of the label stock; a motive device configured to propel the label stock along a web path from the supply spool support towards the take up spool support; a first arrangement configured to produce a first signal indicative of a speed at which label stock is removed from the supply spool by the motive device; a controller configured to receive the first signal and output a brake assembly control signal based upon the first signal; and a brake assembly configured to apply a braking force to the supply spool support based upon the brake assembly control signal, the braking force resisting rotation of the supply spool support. The controller is configured to output the brake assembly control signal based upon a target supply spool speed.

12 Claims, 27 Drawing Sheets

(58) Field of Classification Search
CPC ..... B65C 2009/402; B65C 2009/404; B65C 2009/405; B65C 2009/407; B65C 2009/408
See application file for complete search history.

(56) References Cited

U.S. PATENT DOCUMENTS

| | | | | |
|---|---|---|---|---|
| 10,124,922 | B2 * | 11/2018 | Pfeffer | B65C 9/42 |
| 10,507,947 | B2 * | 12/2019 | Pfeffer | B65C 9/1865 |
| 2015/0274346 | A1 | 10/2015 | Buckby et al. | |

FOREIGN PATENT DOCUMENTS

| | | | |
|---|---|---|---|
| WO | 2011018804 | A1 | 2/2011 |
| WO | 2014072726 | A1 | 5/2014 |
| WO | 2014072727 | A1 | 5/2014 |

* cited by examiner

LABELLING MACHINE WITH A CONTROLLED BRAKE ASSEMBLY AND METHOD OF ITS OPERATION

This application is a division of U.S. patent application Ser. No. 15/523,112, filed Apr. 28, 2017, now U.S. Pat. No. 10,507,947 B2, which is a 371 of PCT/GB2015/053283, filing date Oct. 30, 2015.

The present invention relates to a labelling machine and particularly to a labelling machine for use with label stock comprising a web and a plurality of labels attached to the web and which are separable from the web. Such machines are sometimes referred to as "roll-fed self-adhesive labelling machines".

A label stock comprising a web carrying labels is usually manufactured and supplied as a wound roll (hereinafter referred to as a spool). For a given spool, all the labels are typically the same size, within manufacturing tolerances. However, in some instances, this is not the case.

Labels are commonly used to display information relating to an article and are commonly disposed on the article such that the information is easily readable either manually or automatically. Such labels may, for example, display product information, barcodes, stock information or the like. Labels may be adhered to a product or to a container in which the product is packaged.

In the manufacturing industry, where such labels are read automatically, it is important for the information to be printed such that it is clear and positioned accurately so that an automated reader can consistently and correctly read the information.

Some known labelling machines apply pre-printed labels to an article. Other known labelling machines print information onto labels immediately before printed labels are applied to an article. Such labelling machines may be referred to as print and apply labelling machines.

It is desirable to be able to advance a web of labels to be applied to an article accurately, so as to ensure that print is accurately positioned on the label and/or to ensure that the label is accurately positioned on the article. This may be particularly important in print and apply labelling machines in which printing is typically carried out while the label moves relative to the printhead, making accurate control of the label (and hence the label stock) important if printing is to be properly carried out such that the desired information is correctly reproduced on the label.

Given that labels are often removed from the moving web by passing the label stock under tension around a labelling peel beak (sometimes referred to as a peel beak, a peel blade or a label separating beak), it is sometimes desirable to ensure that a predetermined optimum tension in the web of the label stock is maintained. In addition, in the case of some print and apply labelling machines, it is important to maintain an optimum tension in the label web to ensure optimum print quality on the label web. The optimum tension may be a tension above a minimum tension. In some applications, it is also desirable that the label stock can be moved at a predetermined speed of travel along a defined web path, so as to ensure that the speed at which labels are dispensed is compatible with the speed at which products or containers move along a path adjacent the device.

A known labelling machine comprises a tape drive which advances the label stock from a supply spool support to a take up spool support. The tape drive has a capstan roller of known diameter which is accurately driven to achieve desired linear movement of the label stock along the web path. This capstan roller is also often referred to as a drive roller. The label stock is often pressed against the capstan roller by a nip roller, in order to mitigate risk of slip between the capstan roller and the label stock. For the reliable running of such machines the nip/capstan mechanical arrangement is designed so as to ensure respective axes of the two rollers are substantially parallel to one another and that the pressure exerted by the nip roller (which is typically sprung loaded) is generally even across the width of the label carrying web. This often results in relatively expensive and complex mechanical arrangements, and it is often a time consuming process to load the machine with a supply spool of label stock and feed the label stock from the supply spool support to the take-up spool support, through the nip/capstan rollers, before the labelling machine is operated. This is because the nip roller has to be temporarily disengaged or removed to allow the web of the label stock to be positioned along the web path between the supply spool support and the take up spool support. The nip roller is then repositioned such that the label stock is pressed against the capstan roller by the nip roller and the web of the label stock can be moved between the spool supports by rotation of the capstan roller.

Furthermore, in such labelling machines, the take-up spool (and hence the take up spool support) itself typically needs to be driven in order to maintain adequate tension in the web, between the nip/capstan roller and the take-up spool support. If the tension is too low, the web can become wrapped around the capstan roller, causing the machine to fail, and if the tension is too high, the capstan roller can be "over-driven" by the take-up spool support, resulting in the web being fed at the wrong speed, or indeed the web snapping. The drive for the take-up spool support must also deal with the changing diameter of the take-up spool which carries the web from which labels have been removed. This is because the diameter of the take-up spool increases from an initial value where the take-up spool is empty, to a value many times greater than the initial value, when the supply spool is exhausted.

Known tape drives of labelling machines have mechanisms for achieving appropriate drive of the take-up spool including so-called slipping clutch arrangements. The take-up spool support may be either driven by an independent drive apparatus, such as a variable torque motor, or driven via a pulley belt and gears from a motor driving the capstan roller.

Tape drive mechanisms which rely upon capstan rollers add cost and complexity to the labelling machine, and have the disadvantages referred to above.

Another known problem associated with nip/capstan roller arrangements of the type described above is that the pressure exerted by the nip roller onto the web and against the capstan roller can cause label adhesive to "bleed" out, over time, from the edges of the label. This adhesive can eventually build up on the capstan or nip rollers. This adhesive can then cause the label stock to stick to the rollers such that it is not transported properly along the desired web path. Furthermore, it is common for labels to be accidentally removed from the web and become attached to the capstan roller or nip roller, impeding proper operation of the labelling machine.

It is therefore desirable in the manufacturing industry for there to be means and a method for transporting a label stock and applying labels from the web of the label stock to a product or container, which is accurate, reliable, simple to use and adaptable to different applications.

The braking assembly of known labelling machines may include at least one component that is subject to wear over time. Once said at least one component of the braking assembly has worn to the extent that performance of the labelling machine is unacceptably adversely affected then said at least one component may require replacement. In order to replace said at least one component it may require that the labelling machine is shut down at an inconvenient time which results in down time of a production line of which the labelling machine forms part.

It is an object of embodiments of the present invention to obviate or mitigate one or more of the problems of known labelling machines whether set out above or otherwise, and/or to provide an alternative labelling machine.

According to a first aspect of the invention there is provided a labelling machine comprising a supply spool support for supporting a supply spool comprising label stock; a take-up spool support adapted to take up a portion of the label stock; a motive device configured to propel the label stock along a web path from the supply spool support towards the take up spool support; a first arrangement configured to produce a first signal indicative of a speed at which label stock is removed from the supply spool by the motive device; a controller configured to receive the first signal and output a brake assembly control signal based upon the first signal; and a brake assembly configured to apply a braking force to the supply spool support based upon the brake assembly control signal, the braking force resisting rotation of the supply spool support; wherein the controller is configured to output the brake assembly control signal based upon a target supply spool speed.

The controller may be configured to output the brake assembly control signal based upon a target supply spool speed such that the controller controls the brake assembly based upon the first signal so as to cause the speed at which label stock is removed from the supply spool by the motive device to tend towards or achieve a target supply spool speed.

The first arrangement may be a first sensor arrangement.

The labelling machine may be configured such that the labelling machine undertakes a labelling operation in which the label stock is propelled along a web path from the supply spool support towards the take up spool support. The target supply spool speed may be set (for example, by the controller) based upon a speed of the label stock along the web path during the labelling operation.

The target supply spool speed may be set such that it is substantially equal to an average speed of the label stock along the web path during the labelling operation. The average speed of the label stock along the web path during the labelling operation may be the mean speed of the label stock along the web path during the labelling operation. Alternatively, the average speed of the label stock along the web path during the labelling operation may be the median or mode of a number of sensed values of the speed of the label stock along the web path during the labelling operation.

The target supply spool speed may be set (for example, by the controller) based upon any appropriate speed of the label stock along the web path during the labelling operation. For example, the speed of the label stock along the web path during the labelling operation may be an instantaneous speed of the label stock along the web path at a particular elapsed time of the labelling operation or when the label stock has been fed a certain distance along the web path during the labelling operation.

The labelling machine may comprise a linear speed sensor (or linear speed arrangement) configured to output a speed signal indicative of a speed of the label web along the web path. The controller may be configured to determine the average speed of the label stock along the web path during the labelling operation based on the speed signal.

The speed signal indicative of a speed of the label web along the web path may be based on a linear displacement of the label stock along the web path.

The target supply spool speed may be set after the labelling operation.

The labelling machine may be configured such that the labelling operation comprises a portion of the label stock being accelerated by the motive device from rest to a labelling speed, the label stock being conveyed by the motive device at the labelling speed for a first duration of time, the label stock being decelerated from the labelling speed to rest, and the label stock being at rest for a second period of time before a subsequent labelling operation commences.

The labelling machine may further comprise a movable element which defines a portion of a web path between the supply spool and the take-up spool support; and a second arrangement configured to produce a second signal indicative of the position of the movable element and provide said second signal to the controller.

The controller may be configured to determine an average position of the movable element during a labelling operation based on the second signal. The controller may be configured to modify the target supply spool speed based on a comparison between the average position of the movable element and a target position value indicative of a desired target position of the movable element.

The movable element may be biased by resilient biasing member in a first direction.

A tension in the label stock may change based upon the position of the movable element.

The labelling machine may further comprise a linear displacement sensor configured to output a third signal indicative of a linear displacement of the label stock along the web path.

The first arrangement may comprise the second arrangement and the linear displacement sensor. The first signal may comprise the second and third signals. The controller may be configured to determine the first measure indicative of a speed at which label stock is removed from the supply spool by the motive device by:

determining a second measure indicative of the speed of linear displacement of the label stock along the label web path based on the third signal, determining a third measure indicative of a rate of change of a length of the web path based on the second signal, and adding the second and third measures or subtracting one of the second and third measures from the other of the second and third measures.

The linear displacement sensor may have any appropriate form. The linear displacement sensor may be capable of measuring and/or monitoring the linear displacement of a portion of the label stock along the label web path. The portion of the label stock may be located downstream (with respect to the movement of the label stock) of the movable element. The linear displacement sensor may be contactless—example it may count passing labels and the sensor or controller may determine linear displacement by multiplying the number of sensed labels by the label pitch of the label stock. The linear displacement sensor may contact the label web. It may include a roller of known diameter and an associated encoder which measures the amount of rotation of the roller.

A first operating zone of the movable element may be defined by a first range of positions of the movable element.

The first operating zone may be referred to as the normal operating zone.

Whilst the labelling machine is operating, the brake force exerted by the braking assembly may increase or decrease in order to maintain the supply spool speed at the target speed. In equilibrium, the braking force is substantially equal to the accelerating force created by the web tension, and the supply spins at a constant speed. The movable element (e.g. dancing arm) moves continuously throughout a feed causing constant changes in the web tension, which ideally are countered by modulating the brake signal provided by the controller to the brake assembly. Changing the speed of rotation of the supply spool (for a given speed of label stock being wound onto the take up spool) will change the tension in the label stock and hence the position of the movable element. At any instant, the speed that label stock is unwound from the supply spool relative to the speed label stock is wound onto the take up spool will change the tension in the label stock and hence the position of the movable element. If the supply spool speed is faster than the take up spool speed, the movable element may move in a direction such that the web path length between the supply spool and the take up spool increases and tension may decrease. If the supply spool speed is slower than the take up spool speed, the movable element may move in a direction such that the web path length between the supply spool and the take up spool decreases and tension may increase.

A second operating zone of the movable element may be defined by a second range of positions of the movable element. The controller may be configured such that when the second signal is indicative of the movable element being within the second operating zone, the controller modifies the target supply spool speed so that the target supply spool speed is reduced.

If the target supply speed changes (e.g. is reduced), then a transient period of increased braking is necessary to adjust the actual supply speed so as to enable the actual supply spool speed to approach and/or reach the target supply speed.

The target supply spool speed may be reduced gradually until it reaches a minimum target supply spool speed. This may occur as the dancing arm moves through the second operating zone towards a minimum tension position (also referred to as the setpoint position).

The labelling machine may be configured such that the controller modifies the target supply spool speed so that the target supply spool speed is substantially equal to a current instantaneous speed of the label stock along the label web path or a live average speed of the label stock along the label web path based on movement of the label stock along the label web path since commencement of a current labelling operation.

Depending on the current instantaneous speed of the label stock along the label web path or the live average speed of the label stock along the label web path since commencement of a current labelling operation the target supply spool speed may be increased or decreased to match relevant speed. Modifying the target supply spool speed so that it is substantially equal to a current instantaneous speed of the label stock or a live average speed of the label stock since commencement of a current labelling operation may done when the combination of label pitch, feed speed and/or average speed results in a large displacement of the arm during each feed. It is more common that it results in the supply spool target speed being increased, not decreased. However, since the current instantaneous speed of the label stock and the live average speed of the label stock since commencement of a current labelling operation are both "live" values they change throughout the feed, at different times potentially being faster or slower than the current (unmodified) supply spool target speed.

Depending on the circumstances, the controller may be configured to modify the target supply spool speed to either the average speed of the last labelling operation, or a speed which is somewhere between the instantaneous speed of the label stock and the live average speed of the label stock. For example, when the movable element displacement is determined by the controller to be great using the average speed of the last labelling operation, the controller may interpolate using determined supply spool diameter, between instantaneous speed of the label stock (at start of use of the supply reel) and current live average speed of the label stock (at end of the supply reel).

The second operating zone may be adjacent the first operating zone such that the second range of positions of the movable element is adjacent the first range of positions of the movable element.

The labelling machine may be configured such that in response to the modified reduced target supply spool speed the brake assembly control signal output by the controller commands the brake assembly to apply an increased braking force to the supply spool support.

The labelling machine may be configured such that a limit of the second range of positions of the movable element is a minimum tension position, the minimum tension position of the movable element corresponding to a predetermined minimum desired tension of the label stock.

The controller may be configured such that if the second signal is indicative of the movable element being located at the minimum tension position, the brake assembly control signal output by the controller commands the brake assembly to apply a maximum braking force.

A third operating zone of the movable element may be defined by a third range of positions of the movable element, and wherein the controller is configured such that when the second signal is indicative of the movable element being within the third operating zone, the controller modifies the target supply spool speed so that the target supply spool speed is increased.

If the target supply speed changes (e.g. is increased), then a transient period of reduced braking is necessary to adjust the actual supply speed so as to enable the actual supply spool speed to approach and/or reach the target supply speed.

For example, in some embodiments the controller may modify the target supply speed so that it is gradually doubled whilst the moveable element is located in the third operating zone. In other words, in some embodiments the third operating zone (also referred to as the acceleration zone) is the zone of movable element movement between the first operating zone (also referred to as the normal operating zone) and a mechanical override position. In some embodiments the target supply spool speed at the border between the first operating zone and third operating zone is unmodified (i.e. the same as that within the first operating zone). At mechanical override position the target supply spool speed is twice the unmodified value (although in other embodiments it may be thrice the unmodified value or any appropriate multiple (integer or non-integer) of the unmodified value greater than one). The controller may be configured to interpolate between the unmodified speed and twice the unmodified speed based upon the position of the movable element between the border between the first operating zone and third operating zone, and the mechanical override position.

The labelling machine may be configured such that the controller modifies the target supply spool speed so that the target supply spool speed is substantially equal to a current instantaneous speed of the label stock along the label web path or a live average speed of the label stock along the label web path based on movement of the label stock along the label web path since commencement of a current labelling operation.

The labelling machine may be configured such that the third operating zone is adjacent the first operating zone such that the third range of positions of the movable element is adjacent the first range of positions of the movable element.

The labelling machine may be configured such that a limit of the third range of positions of the movable element is a mechanical override position, the mechanical override position is a position of the movable element beyond which a mechanical override reduces (of completely removes) the braking force exerted by the braking assembly. It may be desirable for the brake control signal produced by the controller to command the electro-mechanical braking assembly to be fully released in order to avoid conflict between the electro-mechanical control of the braking assembly and the mechanical brake override mechanism.

The labelling machine may be configured such that the first operating zone is between the second and third operating zones such that the first range of positions of the movable element is between the second and third ranges of positions of the movable element.

The labelling machine may be configured such that in response to the modified increased target supply spool speed the brake assembly control signal output by the controller commands the brake assembly to apply a reduced braking force to the supply spool support.

The reduced braking force may be applied temporarily, until the target supply spool speed is achieved.

The labelling machine may be configured such that the controller implements closed loop control in order to output the brake assembly control signal based on the first signal. The brake assembly control signal may be determined by the controller based on a difference between the target supply spool speed and the speed at which label stock is removed from the supply spool indicated by the first signal.

The closed loop control may be PID control based on an error based on the difference between the target supply spool speed and the speed at which label stock is removed from the supply spool indicated by the first signal.

The labelling machine may be configured such that if the controller receives an indication that a label feed speed for a labelling operation is below a predetermined low speed value, the labelling machine enters a low speed mode in which the target supply spool speed is set to zero for a first part of the labelling operation and then set to a non-zero value for a second part of the labelling operation.

The labelling machine may be configured such that once the labelling machine has entered the low speed mode, if the controller receives an indication that a label feed speed for a labelling operation is above a predetermined high speed value, the labelling machine exits the low speed mode, wherein the high speed value is greater than the low speed value.

The labelling machine according may further comprise a label applicator located in a location along said web path between said take up and supply supports and arranged to separate labels from the web for application to a receiving surface.

The labelling machine may be arranged to apply preprinted labels to packages in a product packaging facility.

The labelling machine may further comprise a printer arranged to print onto labels prior to application of labels onto the receiving surface.

According to a second aspect of the invention there is provided a method of operating a labelling machine, the labelling machine comprising a supply spool support, a take-up spool support, a motive device, a first arrangement, a controller and a brake assembly; the method comprising: the supply spool support supporting a supply spool comprising label stock; the take-up spool support taking up a portion of the label stock; the motive device propelling the label stock along a web path from the supply spool support towards the take up spool support; the first arrangement producing a first signal indicative of a speed at which label stock is removed from the supply spool by the motive device; the controller receiving the first signal and outputting a brake assembly control signal based upon the first signal; the brake assembly applying a braking force to the supply spool support based upon the brake assembly control signal, the braking force resisting rotation of the supply spool support; the controller outputting the brake assembly control signal based upon a target supply spool speed.

The controller may output the brake assembly control signal based upon a target supply spool speed such that the controller controls the brake assembly based upon the first signal so as to cause the speed at which label stock is removed from the supply spool by the motive device to tend towards or achieve a target supply spool speed.

According to a third aspect of the invention there is provided a method of operating a labelling machine, the labelling machine comprising a supply spool support; a take-up spool support; a motive device; a movable element biased by a resilient biasing member in a first direction towards a home position, movement of the moveable element in the first direction increasing the length of the web path; a first arrangement; a second arrangement; a controller; and a brake assembly; the method comprising: the supply spool support supporting a supply spool comprising label stock; the take up spool taking up a portion of the label stock; the movable element defining a portion of the web path between the supply spool and the take-up spool support; the first arrangement producing a first signal indicative of movement of the movable element and providing said first signal to the controller; the controller outputting a brake assembly control signal which commands the brake assembly to apply a braking force to the supply spool support to substantially prevent rotation of the supply spool support; the controller commanding the motive device to move the label stock along the web path in a reverse direction from the take-up spool towards the supply spool such that the movable element is moved by the resilient member in the first direction from a first position to the home position; the second arrangement producing a second signal indicative of the movable element being located at the home position; the controller determining the first position of the movable element relative to the home position based on the first and second signals.

The movable element may be a dancing arm.

The resilient biasing member may be a tension spring.

A tension in the label stock may change based upon the position of the movable element. The tension may decrease as the movable element moves towards the home position.

The length of the web path between the supply spool and the take up spool may change based on the position of the movable element. The length of the web path between the supply spool and the take up spool may increase as the movable element moves towards the home position.

The motive device may drive the take up spool for rotation.

The motive device may be a stepper motor.

The first arrangement may be a sensor configured such that the first signal is pulsed, a pulse corresponding to each time the movable element moves by a first distance. The first distance may be an angular distance.

Where features have been described above in the context of one aspect of the invention, it will be appreciated that where appropriate such features may be applied to other aspects of the invention. Indeed, any of the features described above and elsewhere herein can be combined in any operative combination and such combination is expressly foreseen in the present disclosure.

To the extent appropriate, control methods described herein may be implemented by way of suitable computer programs and as such computer programs comprising processor readable instructions arranged to cause a processor to execute such control methods are provided. Such computer programs may be carried on any appropriate carrier medium (which may be a tangible or non-tangible carrier medium).

Specific embodiments of the present invention will now be described, by way of example only, with reference to the accompanying drawings, in which.

Figure 1:
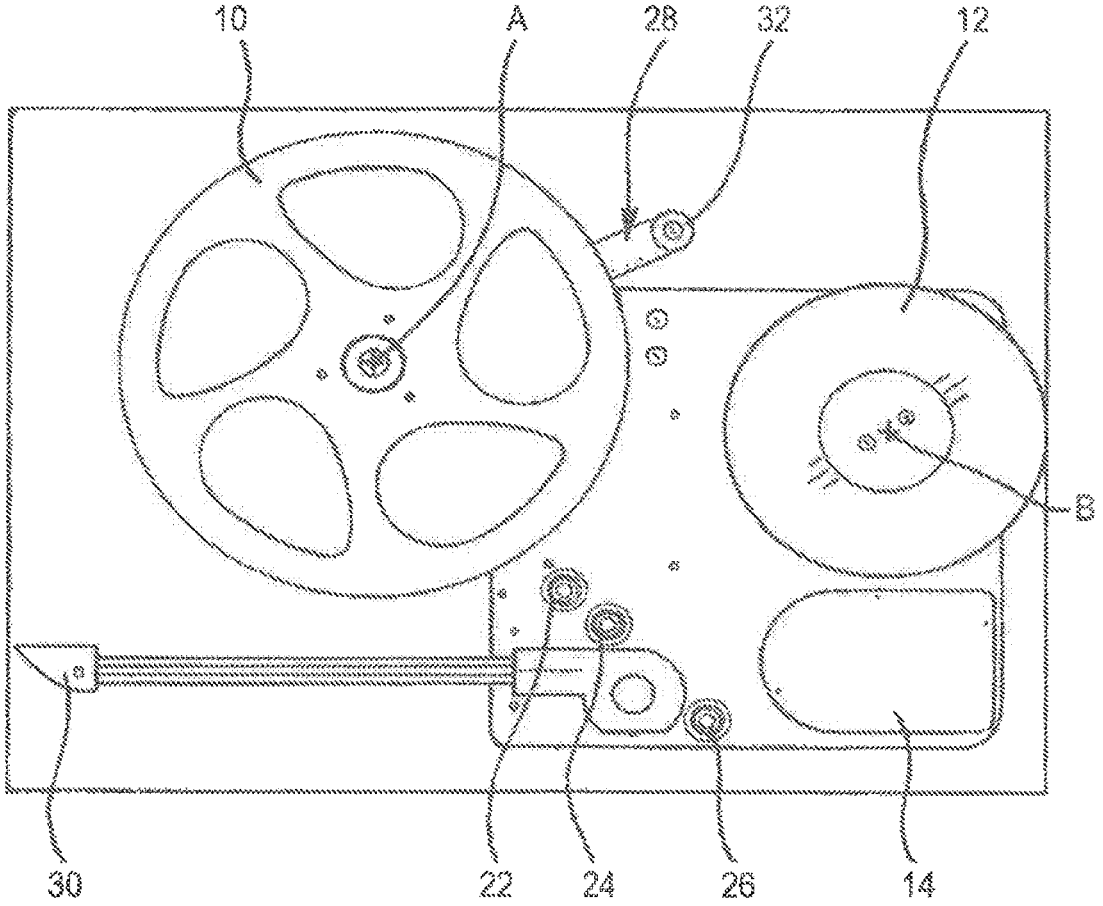
FIG. 1 shows a schematic side elevation of a portion of a labelling machine in accordance with an embodiment of the invention.
Figure 2:
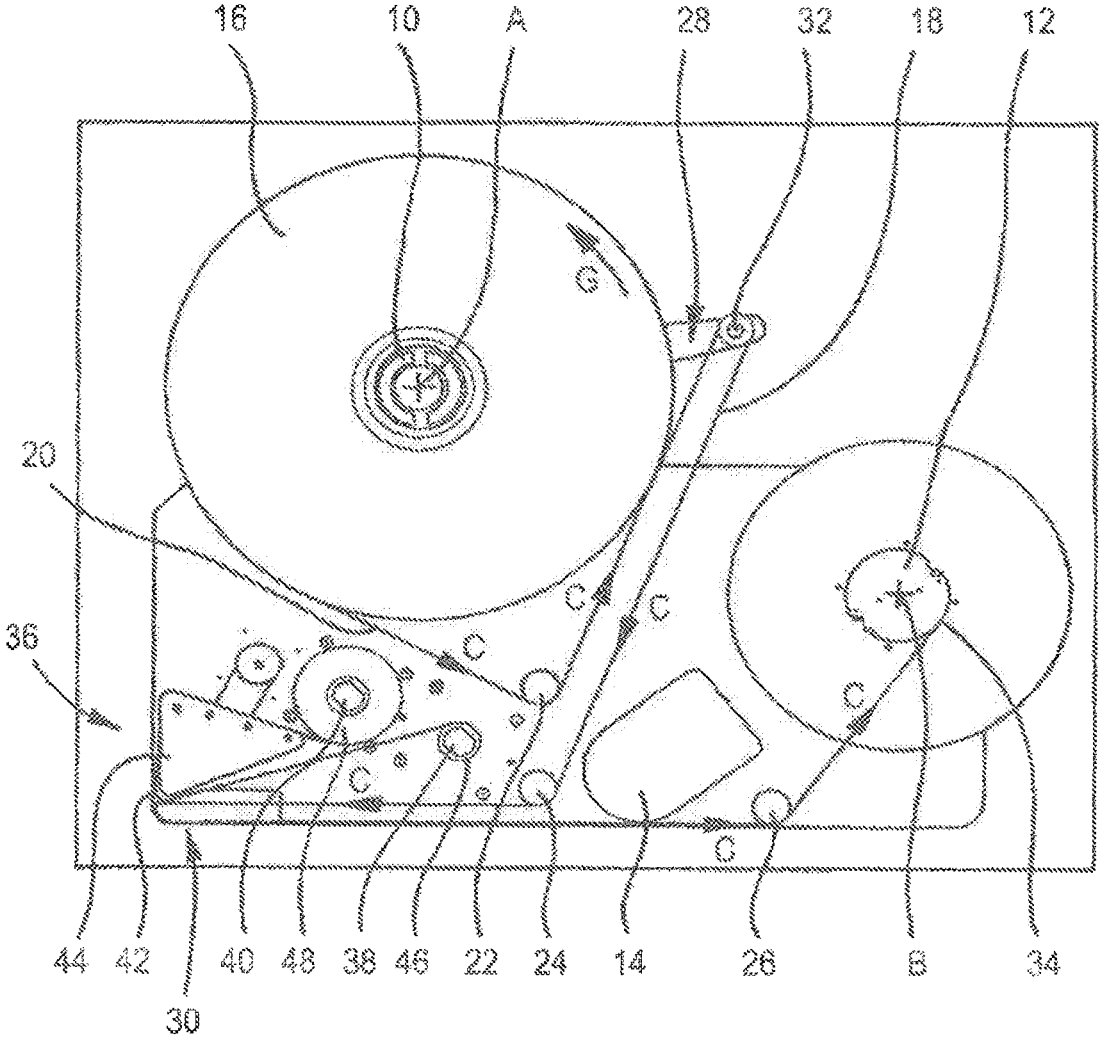
FIG. 2 shows a schematic side elevation of a portion of a labelling machine in accordance with a second embodiment of the invention.
Figures 4, 4A:
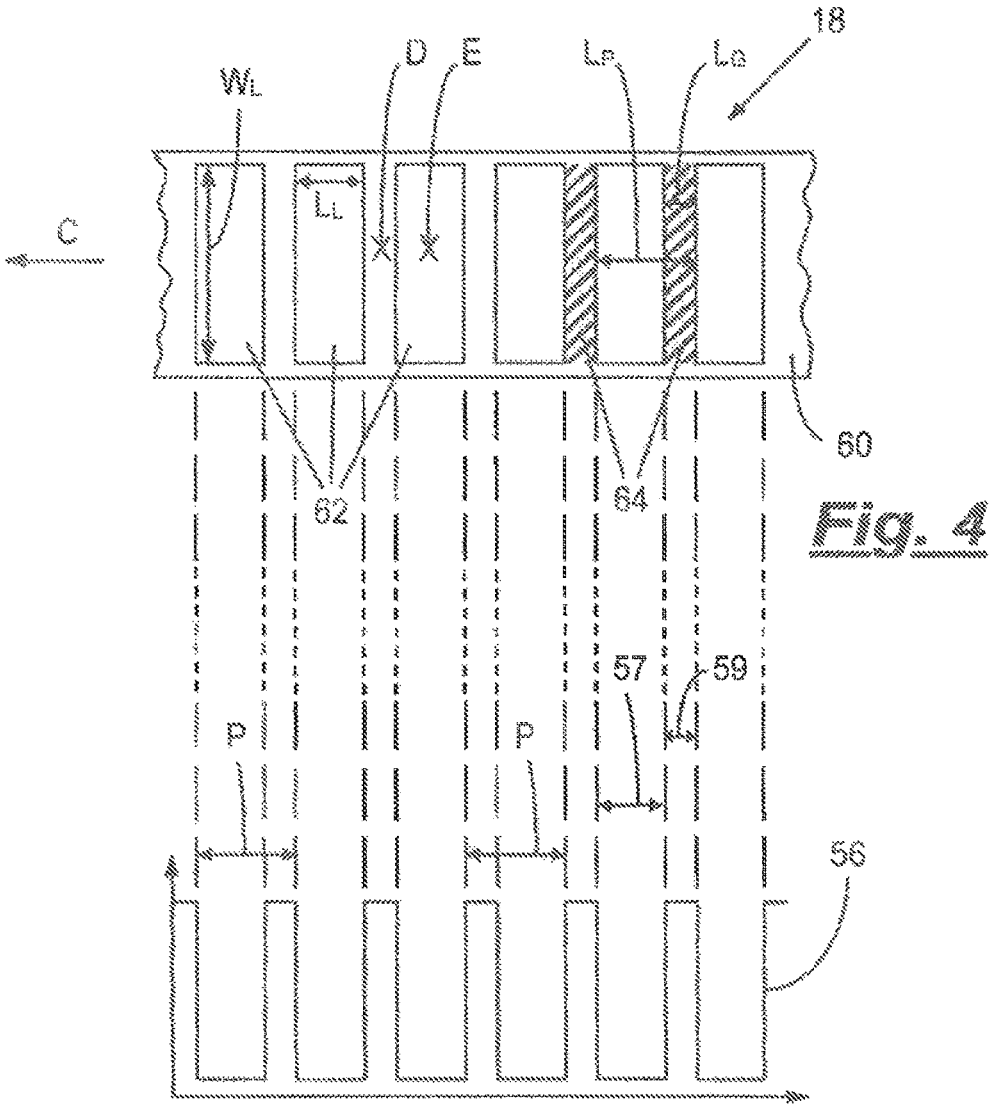
FIG. 4 shows a schematic plan view of a portion of label stock which is utilised in conjunction with a labelling machine in accordance with an embodiment of the invention.
Figure 5:
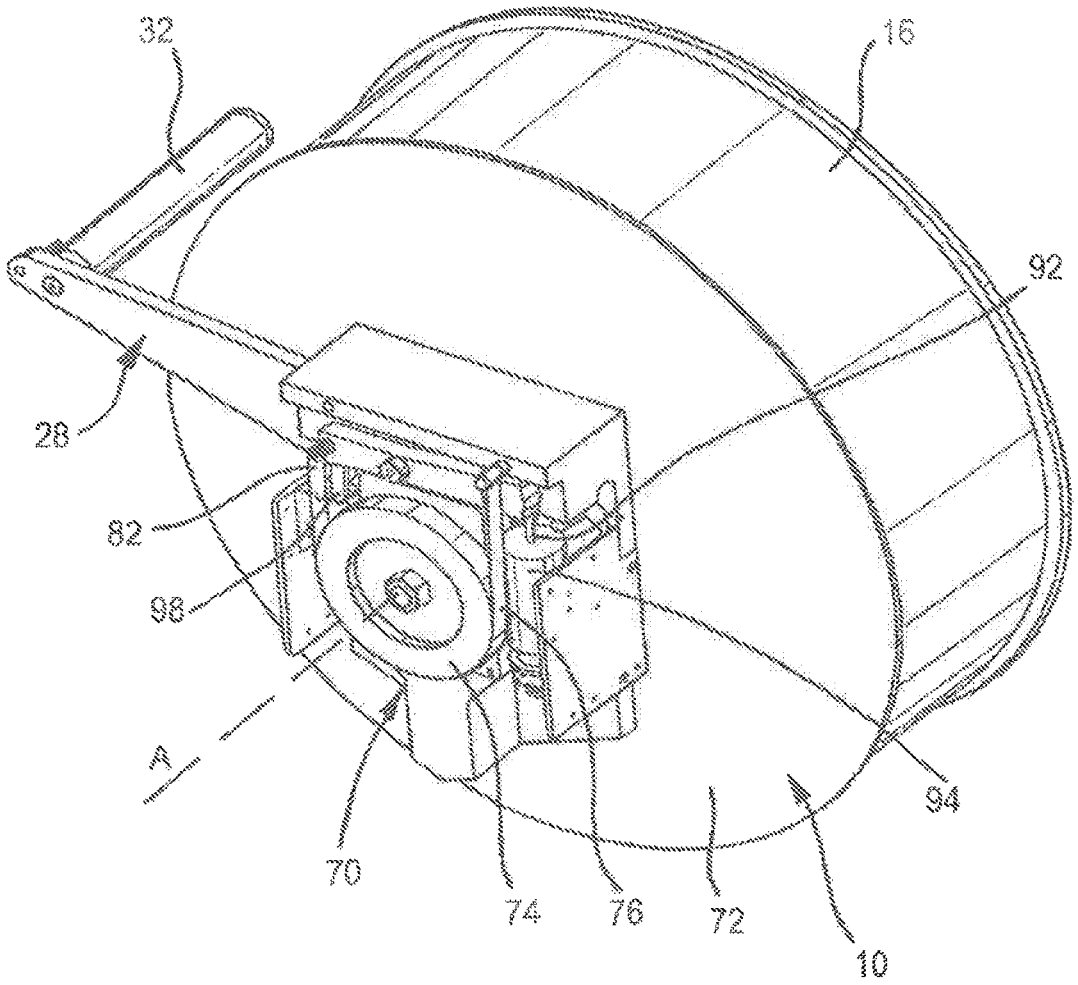
Figure 6:
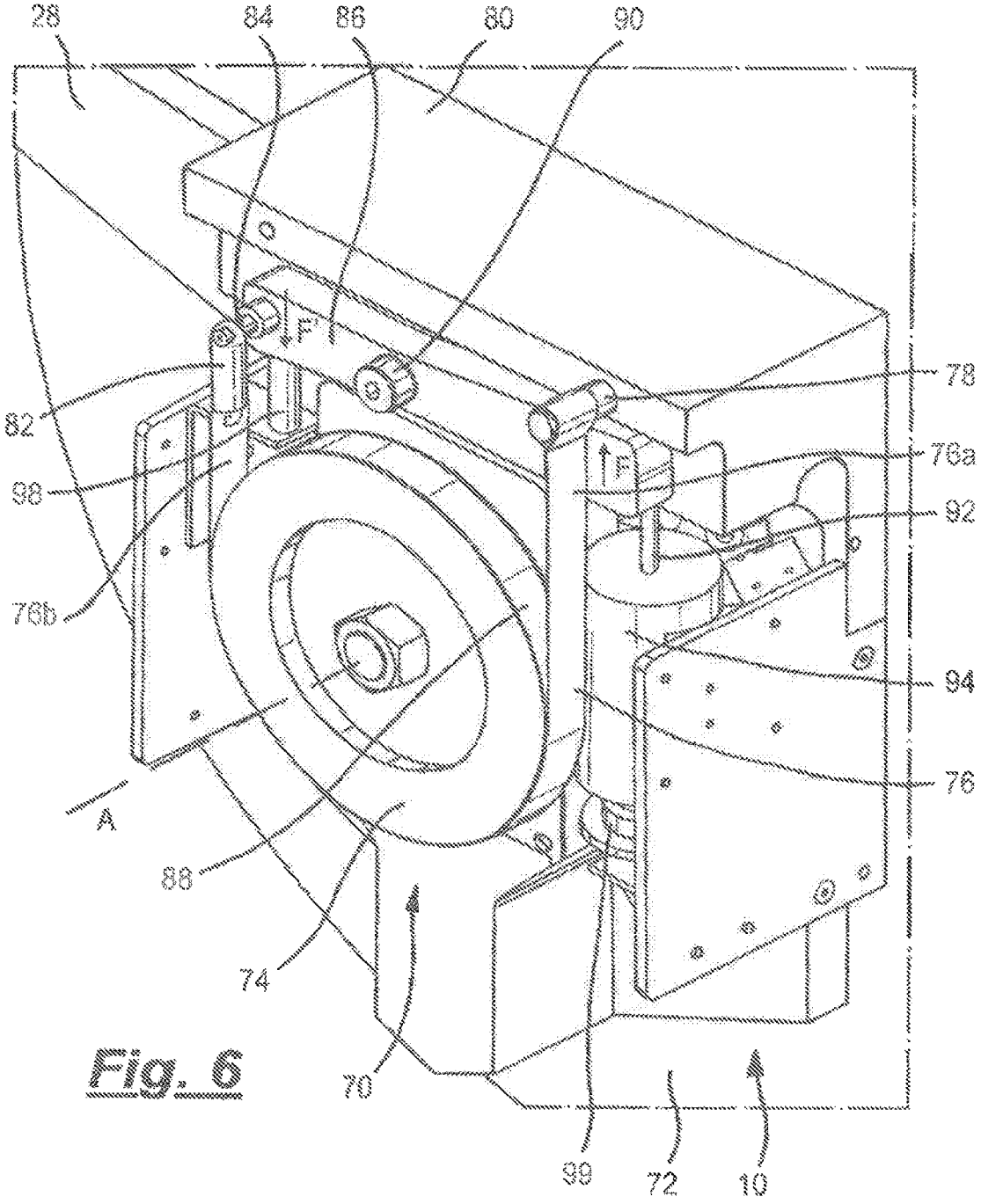
Figure 7:
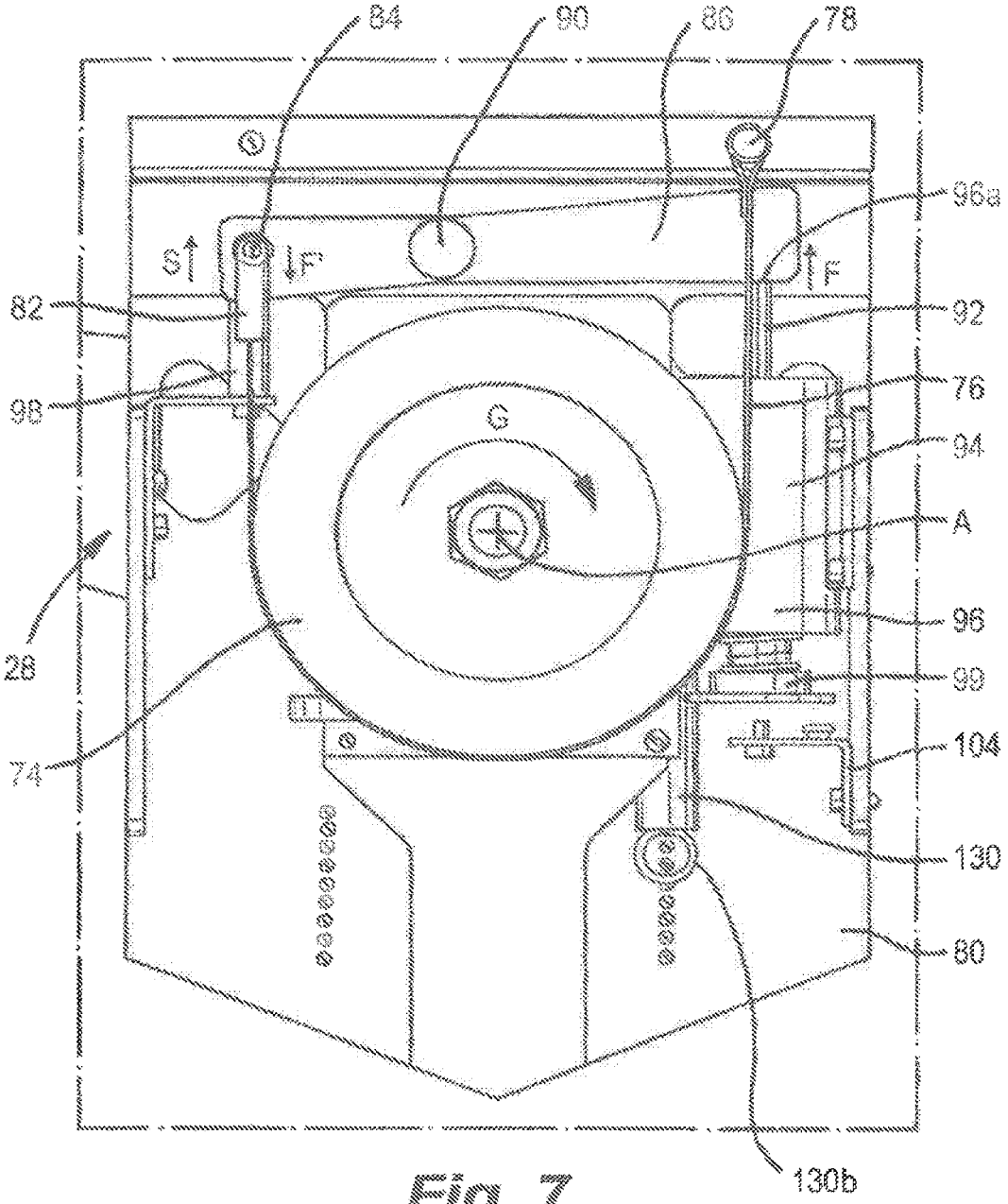
Figure 8:
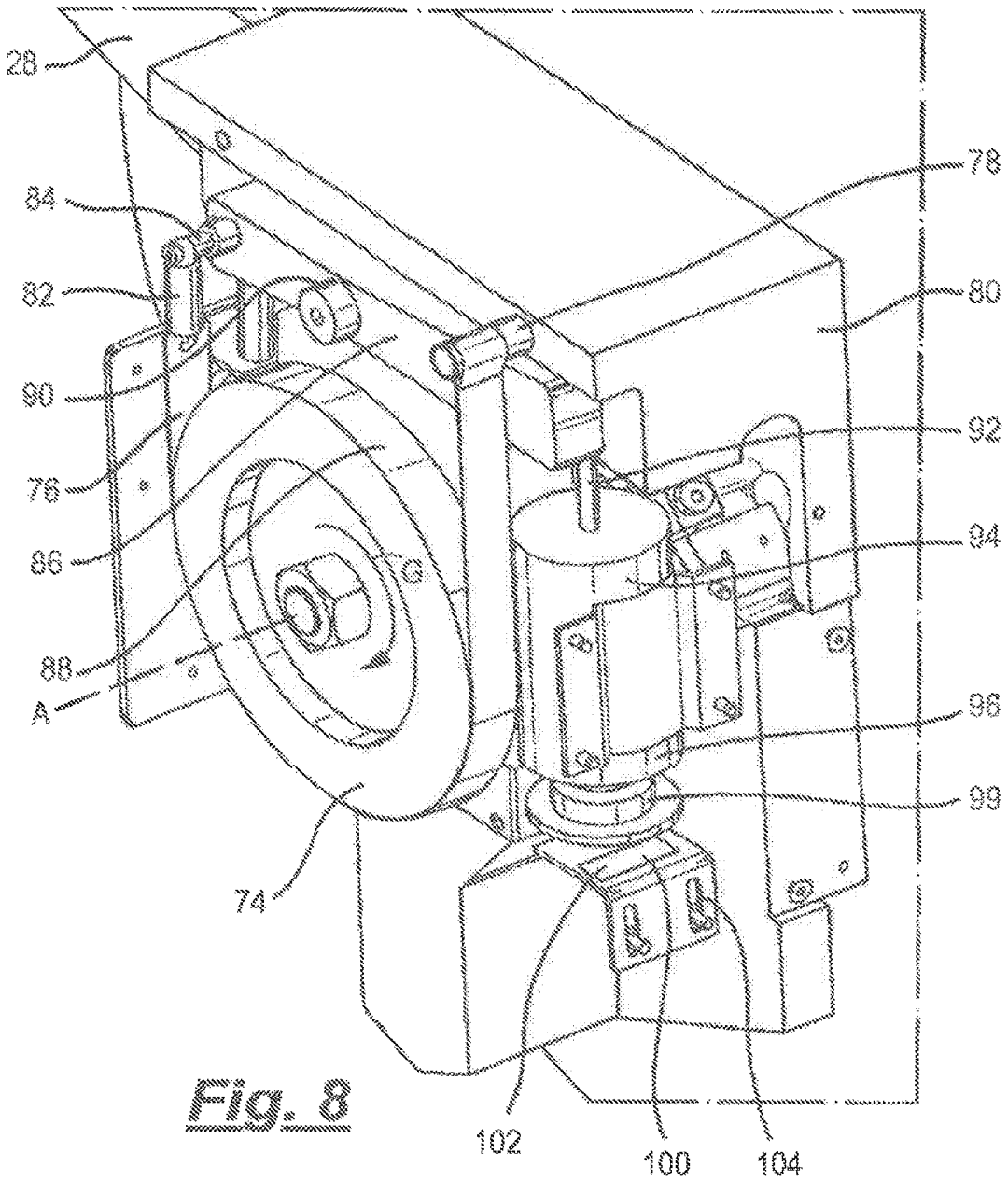
Figure 9:
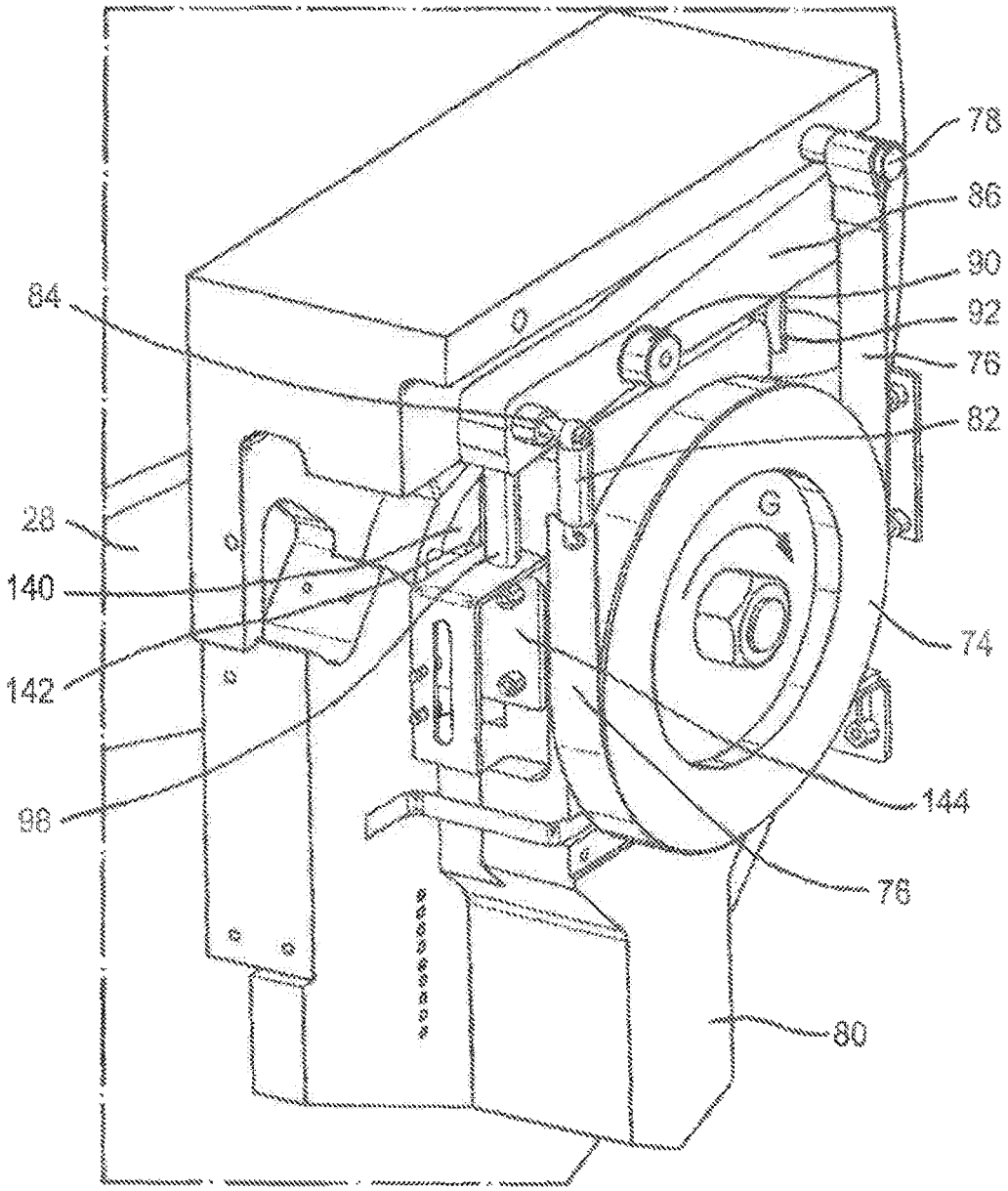
Figure 10:
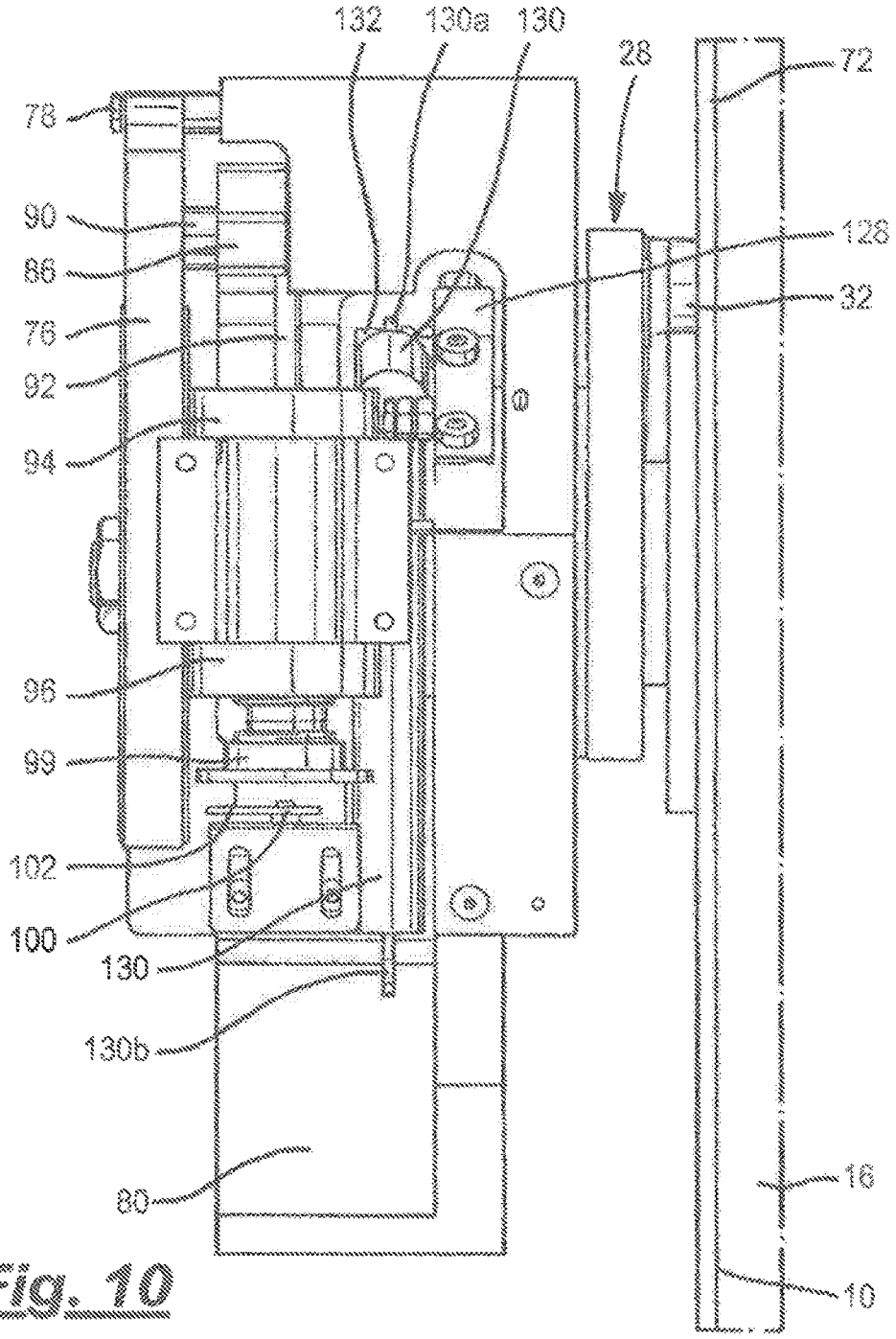
Figure 11:
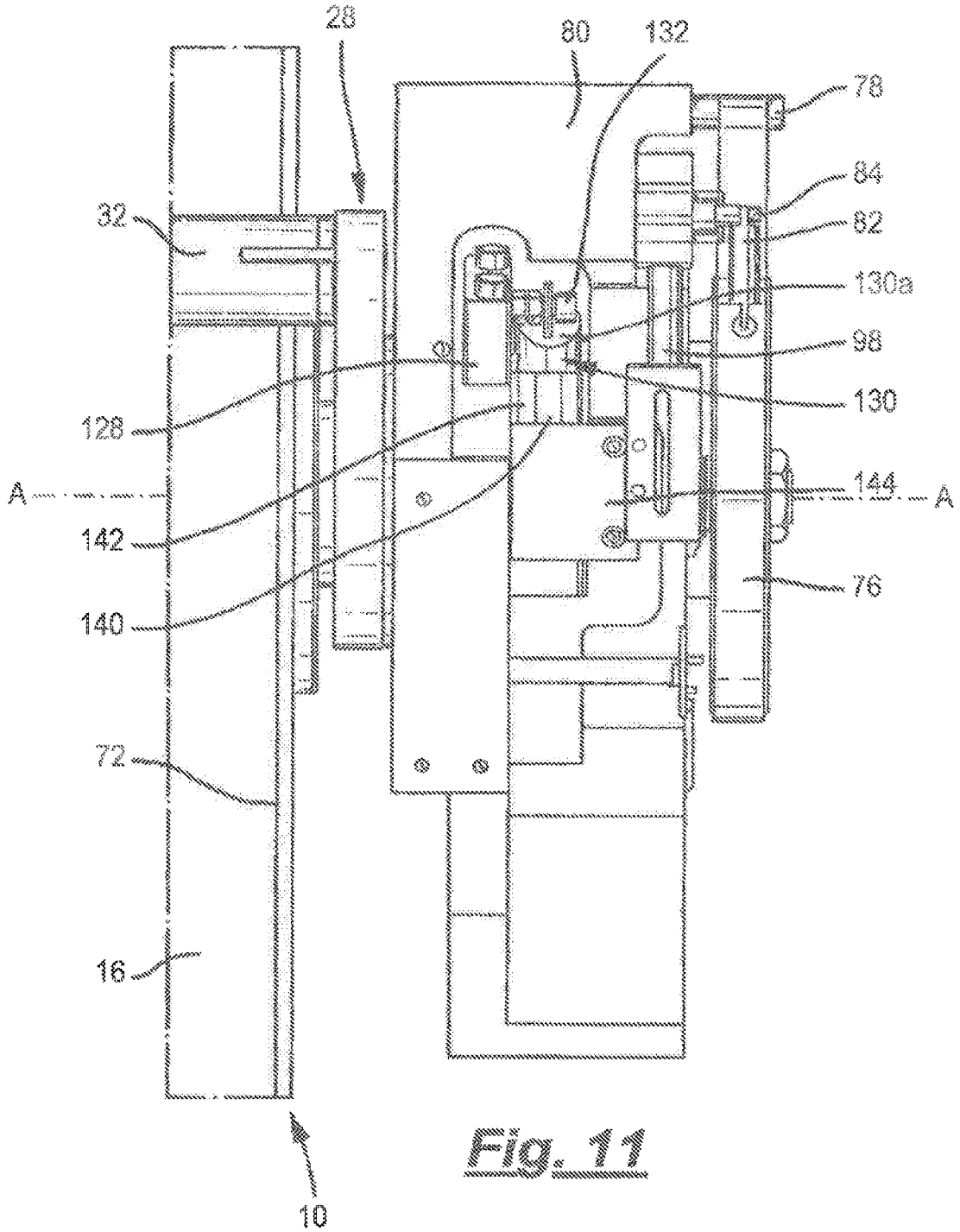
Figure 12:
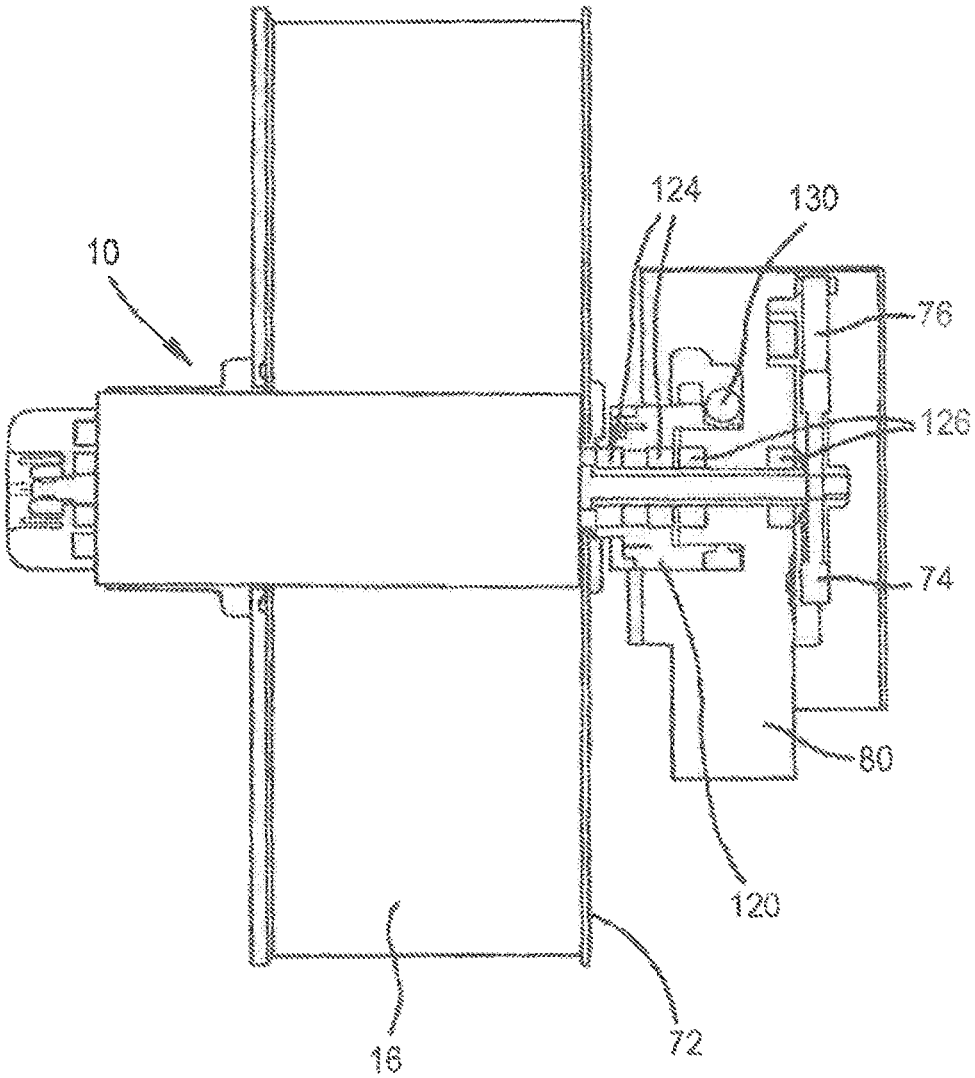
Figure 13:
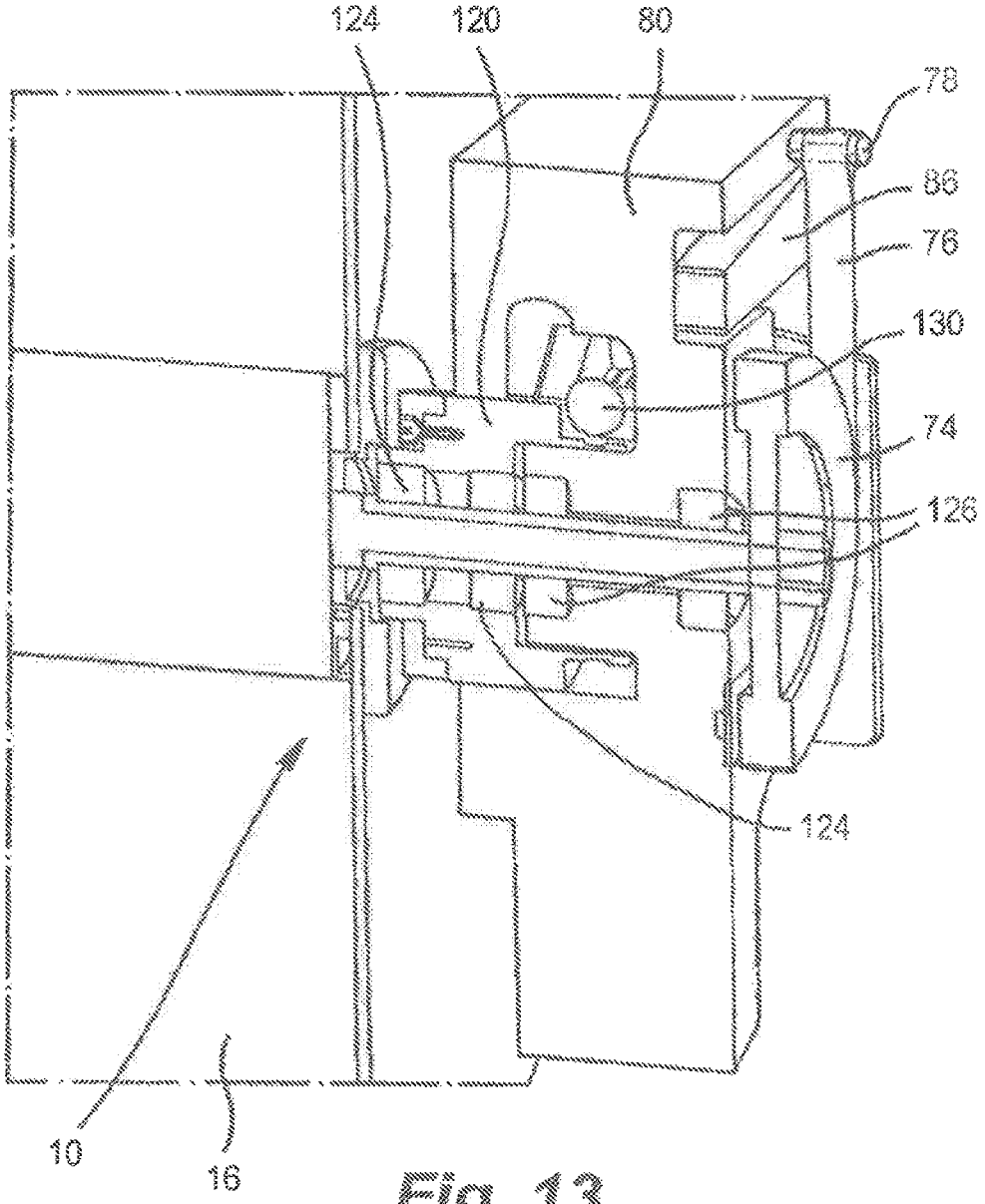
Figure 14:
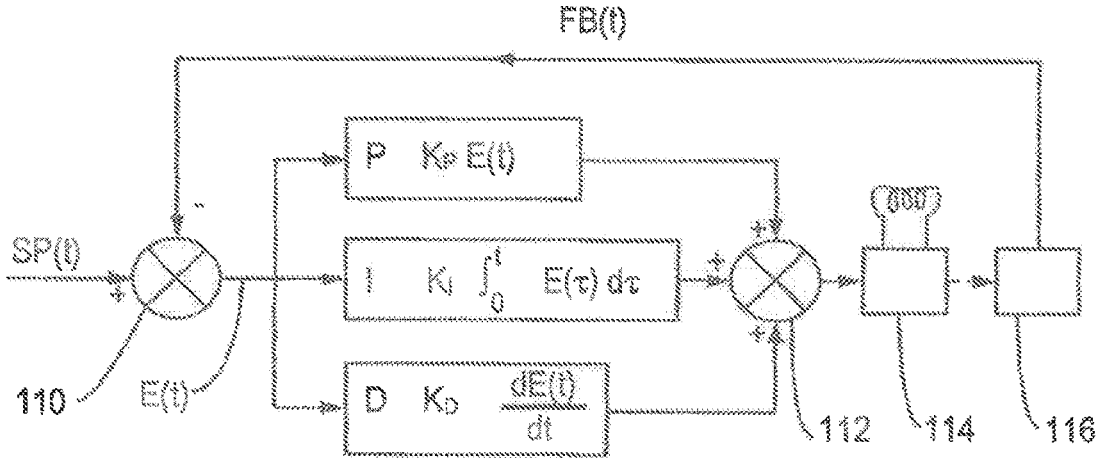
Figure 15:
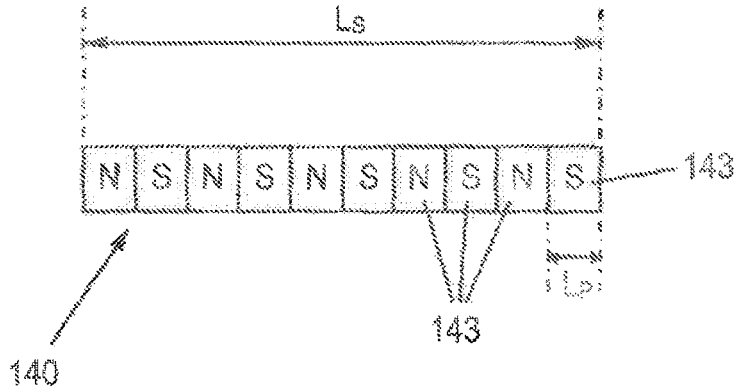
Figure 16:
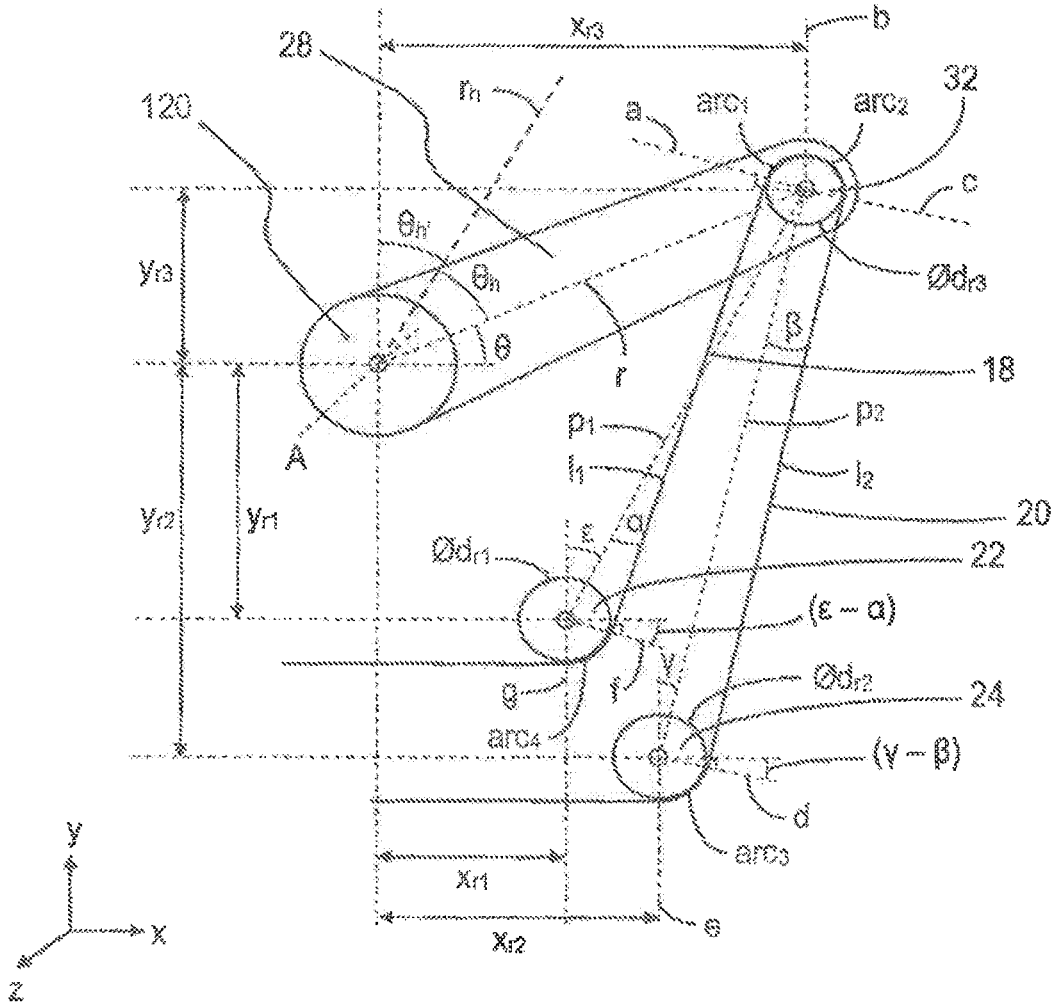
Figure 17:
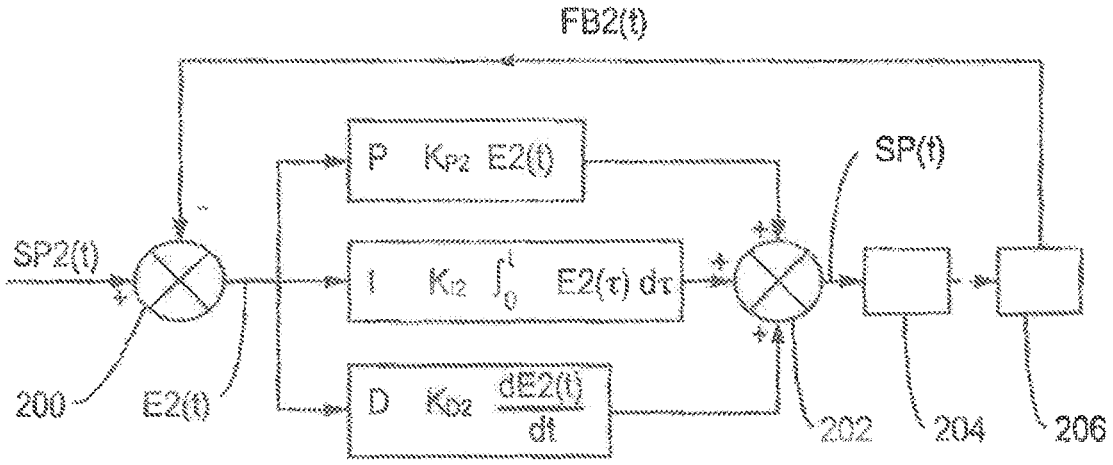
Figure 17A:
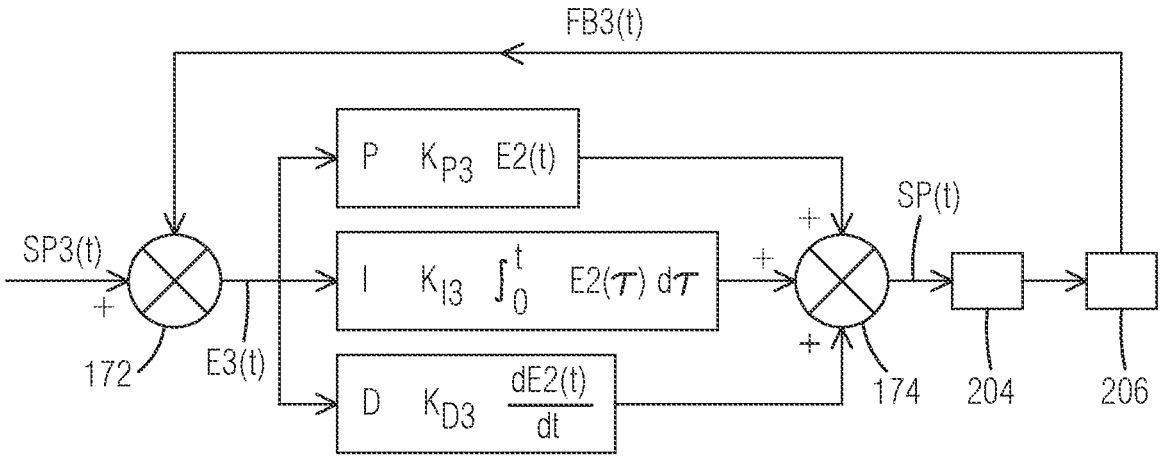
Figure 18:
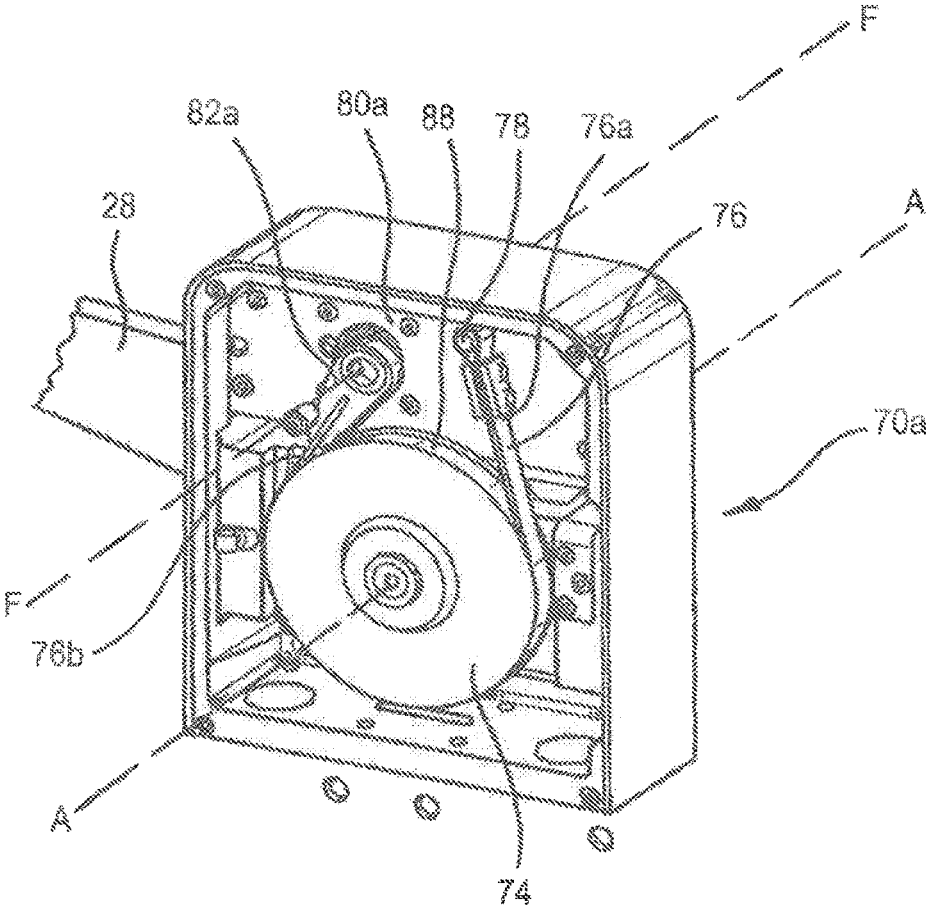
Figure 19:
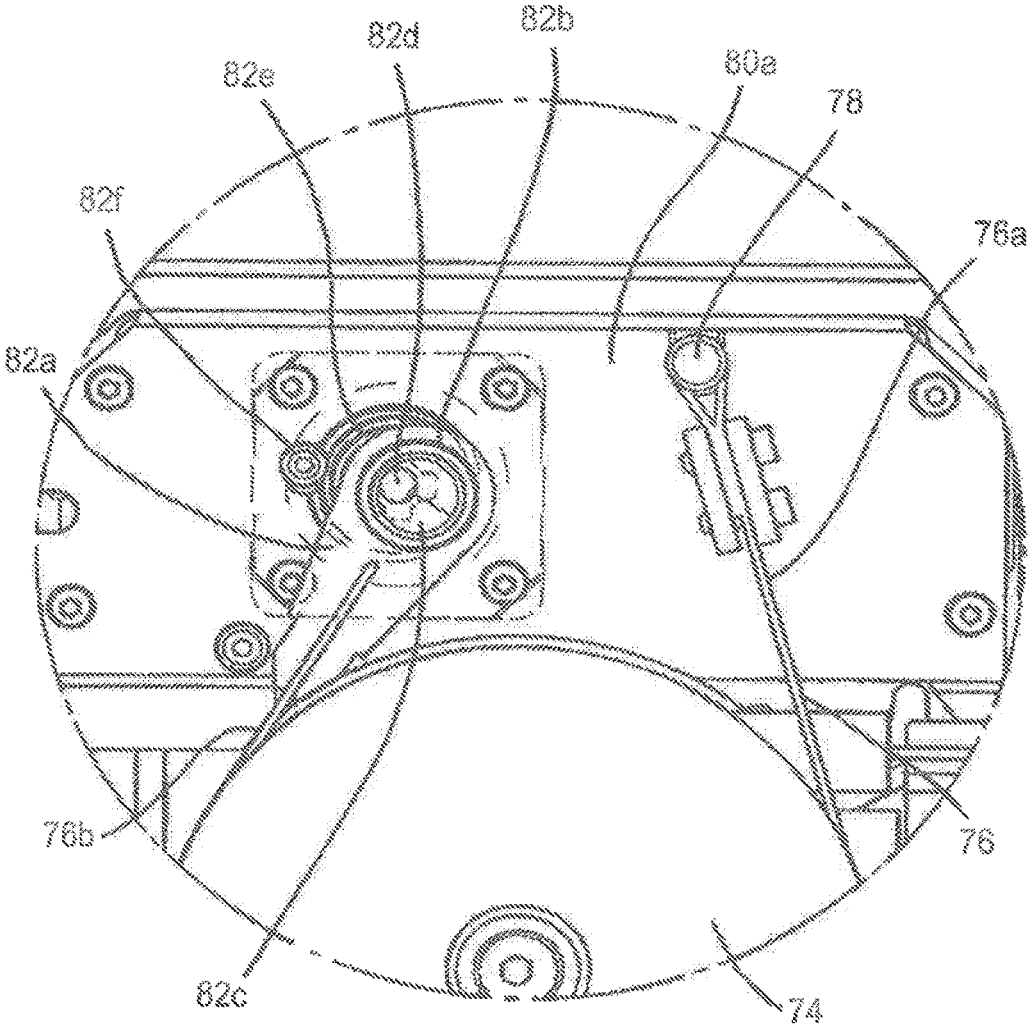
Figure 20:
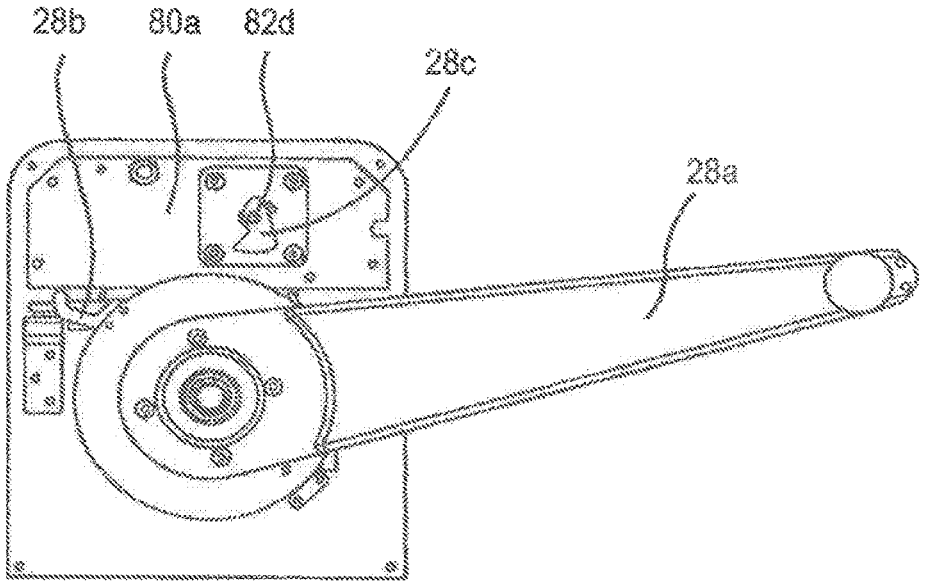
Figure 21:
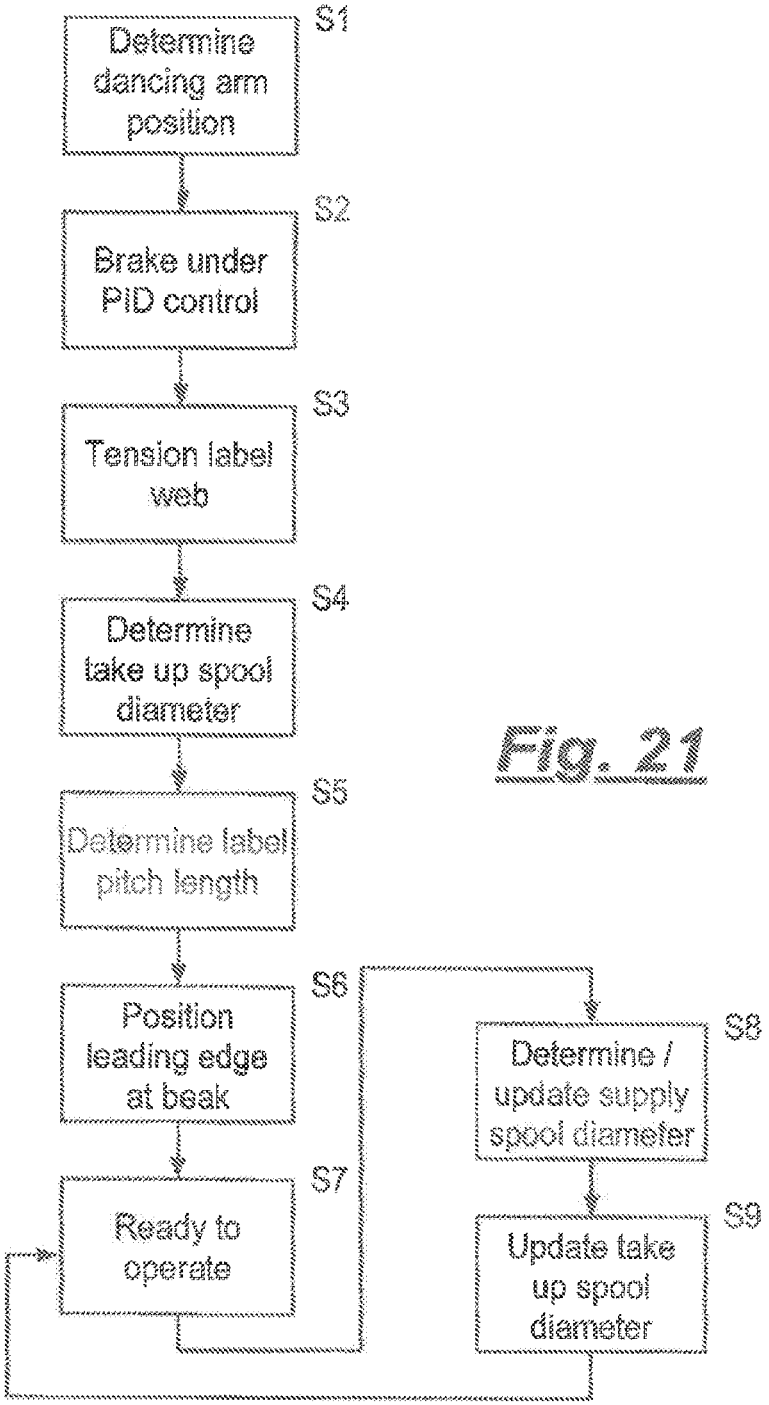
Figure 22:
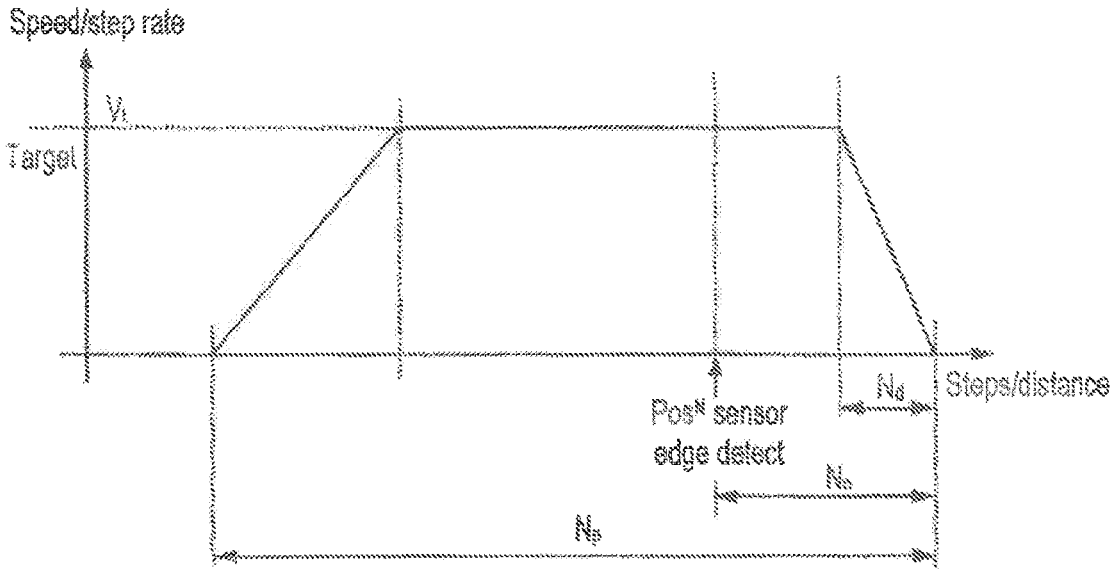

FIG. 4*a* shows a schematic graph of a sensor signal produced by a sensor which forms part of a labelling machine in accordance with an embodiment of the present invention, the sensor signal being produced when the portion of label stock shown in FIG. 4 is utilised in conjunction with the labelling machine;

FIG. 5 shows a schematic perspective view of a portion of the labelling machine shown in FIG. 2;

FIG. 6 shows a further schematic perspective view of a portion of the labelling machine shown in FIG. 2;

FIG. 7 shows a schematic side elevation of a portion of the labelling machine shown in FIG. 2;

FIG. 8 shows a further schematic perspective view of the portion of the labelling machine shown in FIG. 6, with a first mounting plate removed;

FIG. 9 shows a further schematic perspective view of a portion of the labelling machine shown in FIG. 2, with first and second mounting plates removed;

FIG. 10 shows a schematic end-on view of a portion of the labelling machine shown in FIG. 2, with the first mounting plate removed;

FIG. 11 shows a further schematic end-on view of a portion of the labelling machine shown in FIG. 2, with the second mounting plate removed;

FIG. 12 shows a schematic cross-sectional view of a portion of the labelling machine shown in FIG. 2;

FIG. 13 shows a further schematic perspective cross-sectional view of a portion of the labelling machine shown in FIG. 2;

FIG. 14 shows a schematic diagram illustrating a solenoid armature position control algorithm which is implemented by a controller which forms part of a labelling machine in accordance with an embodiment of the invention;

FIG. 15 shows a schematic view of a multipole strip magnet which forms part of a moving element position sensor which forms part of a labelling machine in accordance with an embodiment of the invention;

FIG. 16 shows a schematic view of a portion of the labelling machine shown in either of FIG. 1 or 2;

FIG. 17 shows a schematic diagram illustrating a moving element position control algorithm which is implemented by a controller which forms part of a known labelling machine;

FIG. 17*a* shows a schematic diagram illustrating a supply speed control algorithm which is implemented by a controller which forms part of a labelling machine in accordance with an embodiment of the invention;

FIG. 18 shows a perspective view of a portion of an alternative braking assembly which in some embodiments of the present invention may take the place of the braking assembly shown in FIGS. 5 to 11;

FIG. 19 shows a further view of the alternative braking assembly shown in FIG. 18;

FIG. 20 shows a view of a portion of a labelling machine according to an embodiment of the present invention including the alternative braking assembly shown in FIGS. 18 and 19 and further including a brake release mechanism;

FIG. 21 is a flow chart showing operation of a labelling machine in accordance with an embodiment of the invention, including various features described herein;

FIG. 22 is a speed/distance graph for a typical labelling operation; and

Figure 23:
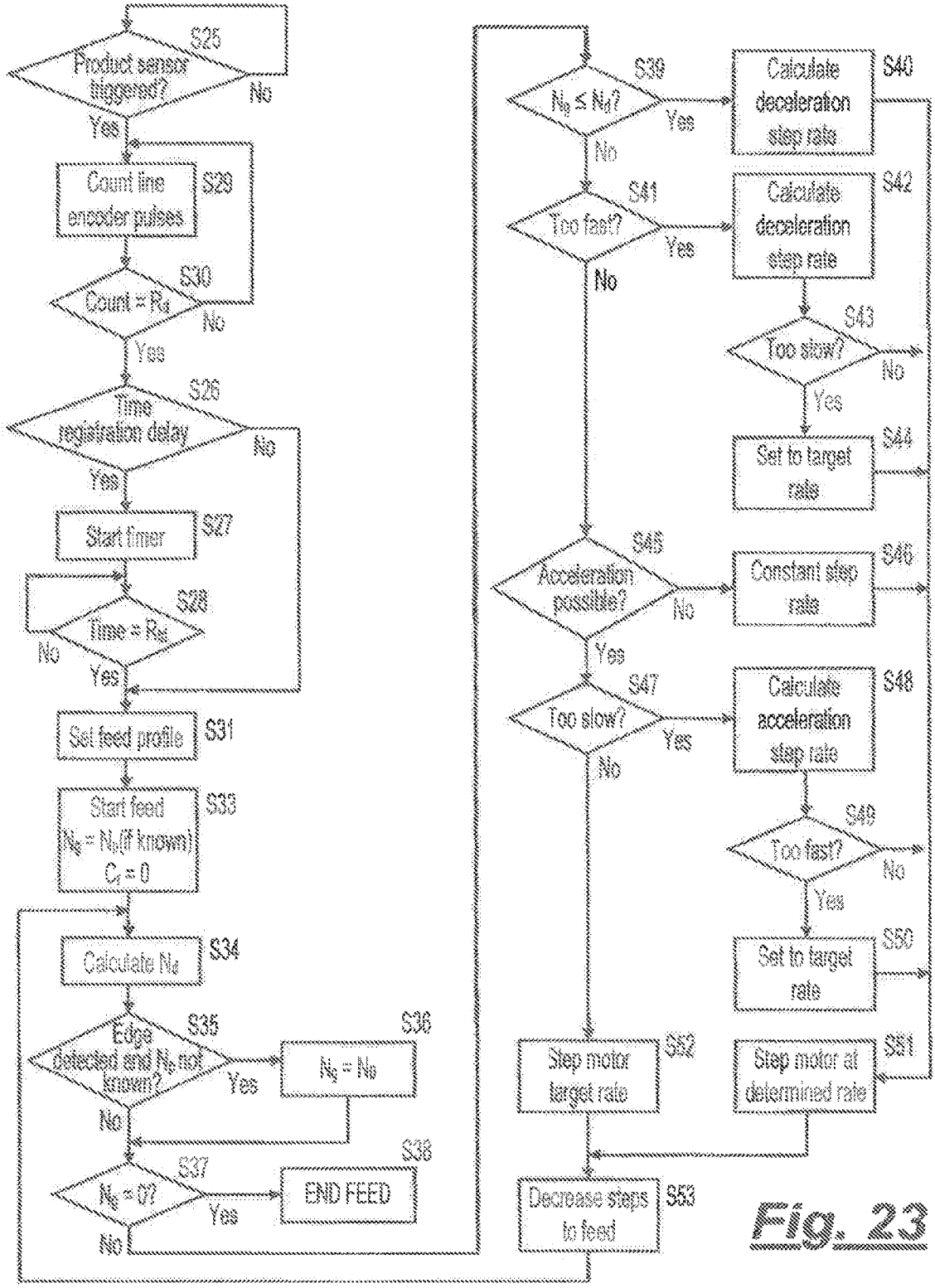
Figure 24:
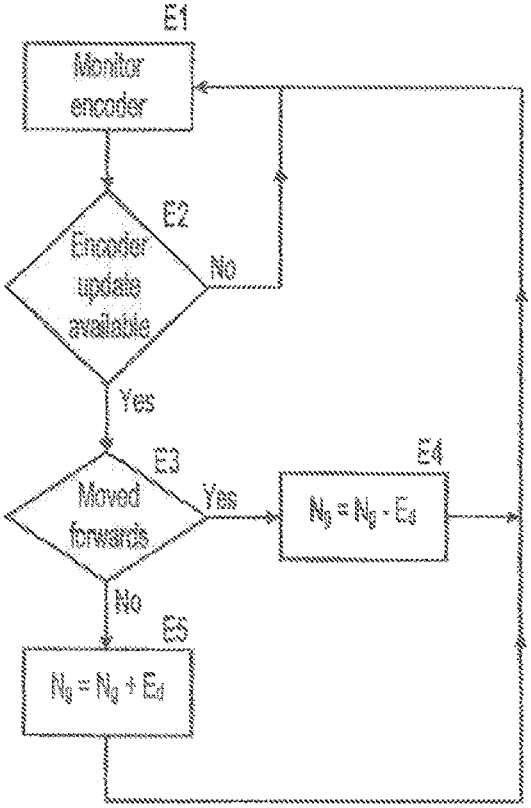
Figure 25:
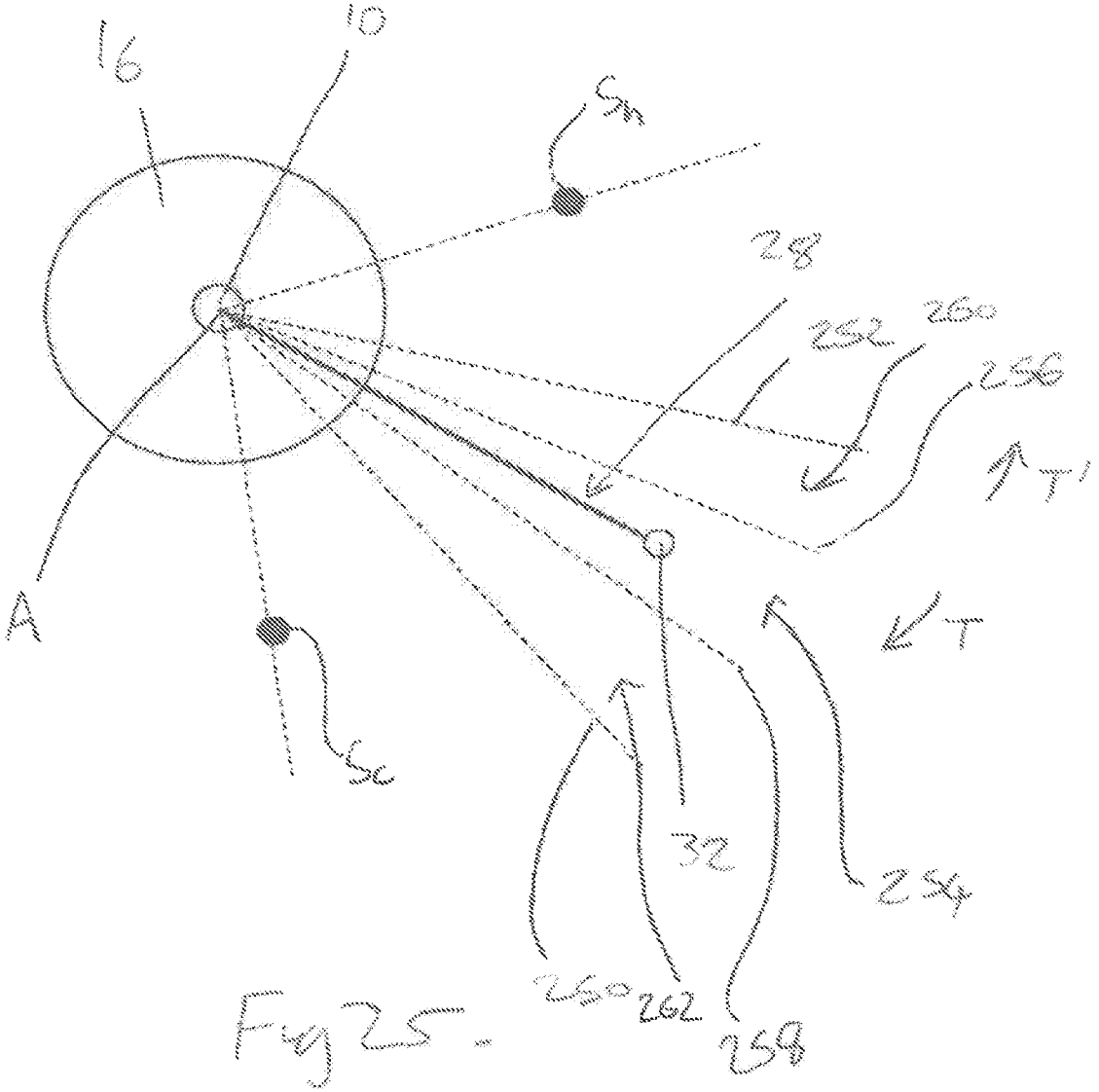
Figure 26:
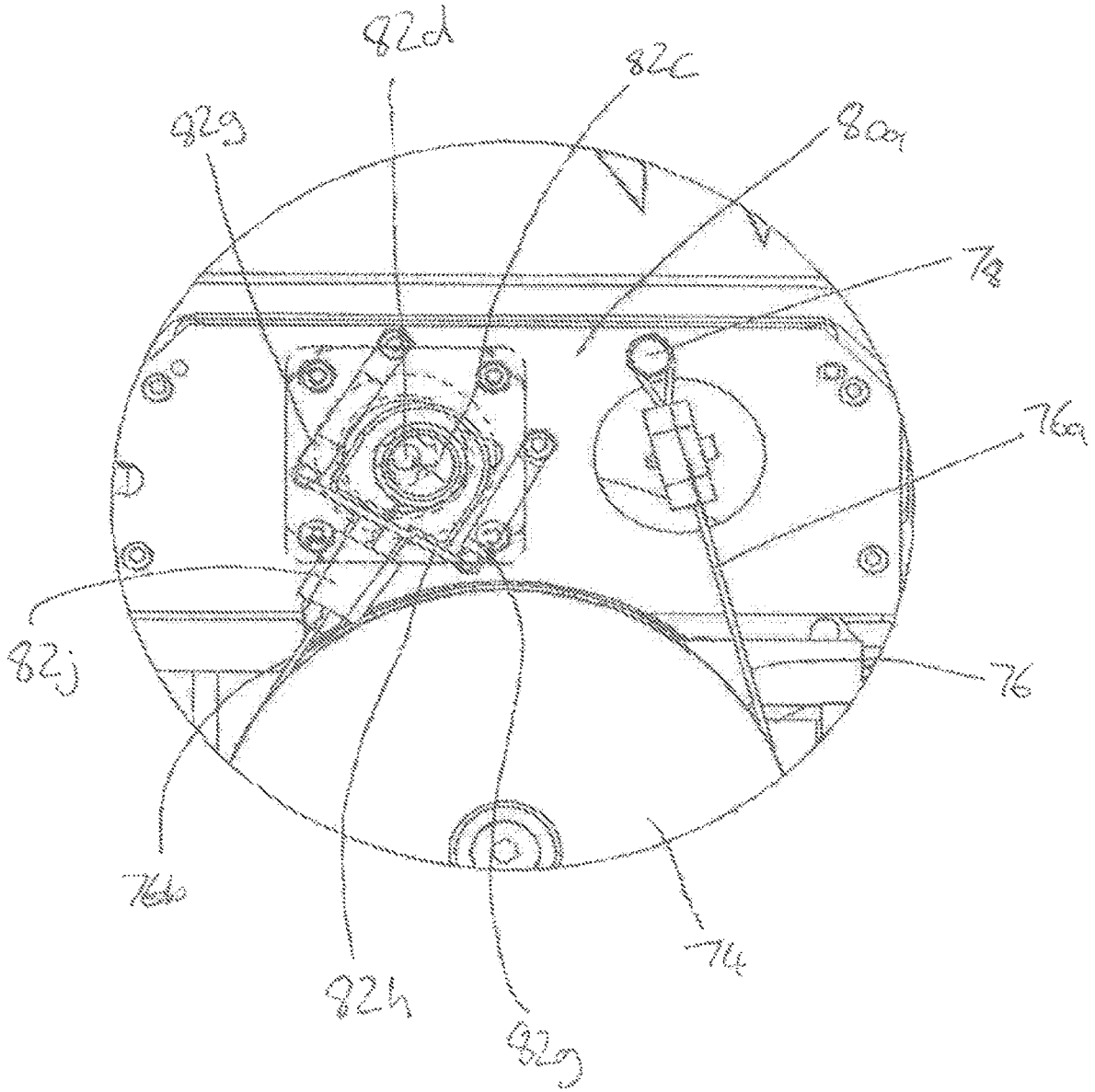

FIG. 23 is a flow chart of processing carried out during the labelling operation of FIG. 22;

FIG. 24 is a flow chart of processing carried out during an encoder increment/decrement routine which is implemented by some embodiments of the present invention whilst carrying out the processing shown in FIG. 23;

FIG. 25 is a schematic view of a portion of a labelling machine which implements the shown in FIG. 17*a*; and FIG. 26 shows a view of a modification to the alternative braking assembly shown in FIGS. 18 to 20.

FIGS. 1 and 2 show schematic side views of portions of two different types of labelling machine in accordance with separate embodiments of the present invention. FIG. 1 shows a labelling machine with no integrated printer and FIG. 2 shows a labelling machine with an integrated printer.

The labelling machines shown in FIGS. 1 and 2 both include a supply spool support 10 and a take up spool support 12. The supply spool support 10 and take up spool support 12 are both mounted for rotation about respective axes A and B. In the labelling machines shown in FIGS. 1 and 2 the axes A and B are substantially parallel to one another; however, in some embodiments this may not be the case. The take up spool is connected to a motor 14 such that the motor 14 can be powered in order to rotate the take up spool 12 about the axis B. In the labelling machines shown in FIGS. 1 and 2, the motor 14 is connected to the take up spool support 12 via a belt (not shown).

However, it will be appreciated that in other embodiments any appropriate linkage may be used to connect the motor 14 to the take up spool support 12. For example, while in the described embodiment the belt will provide a fixed transmission ratio between rotation of the motor shaft and rotation of the take up spool support, in other embodiments a linkage providing a variable transmission ratio (such as a gearbox) may be provided. Indeed, in still alternative embodiments the take up spool support 12 may be directly driven by the motor 14. By directly driven it is meant that the spool support may be mounted co-axially with the shaft of the motor 14, that is the shaft of the motor 14 may extend along the axis B. In the case where the take up spool support 12 is directly driven by the motor 14, the take up spool support may be mounted to a motor spindle of the motor 14. This arrangement is quite different from other arrangements which may use capstan rollers to contact the outside circumference of a spool or a spool support in order to rotate the spool and/or spool support.

In the labelling machine shown in FIGS. 1 and 2 the motor 14 is a stepper motor. An example of a suitable stepper motor is a 34H318E50B stepper motor produced by Portescap, USA. An example of a suitable belt which connects the motor 14 to the take up spool support 12 is a synchroflex timing belt. In this embodiment the gearing ratio for the belt drive is 4:1 whereby the motor revolves four times for every revolution of the take up spool support. It will be appreciated that in other embodiments any appropriate gearing ratio for the belt drive may be used.

In this case the stepper motor is capable of being controlled such that it can execute 1600 substantially equal angular movements per complete rotation of the stepper motor. These substantially equal angular movements may be referred to as micro-steps. Each micro-step is equivalent to a rotation of about 0.225° or about 0.00392 radians. In this case, the stepper motor has 200 steps per revolution, but the stepper motor is controlled to produce 8 micro-steps per step, such that the number of micro-steps per revolution is 1600. Because the belt drive gearing ratio is 4 to 1, the number of micro steps of the motor per revolution of the take up spool support is 6400. Stepper motors are generally driven by a stepper motor driver. In the case of the motor and control arrangement described above, if the stepper motor driver is commanded to advance one step, the stepper motor driver will provide a signal to the stepper motor which causes the stepper motor to rotate by one micro-step (i.e. about 0.225°). It will be appreciated that in other embodiments, the stepper motor may undertake any appropriate number of steps per complete rotation of the stepper motor, and the stepper motor may be controlled to produce any appropriate number of micro-steps per step of the stepper motor. Furthermore, the belt drive gearing ratio may be chosen such that the number of micro steps of the motor per revolution of the take up spool support is any appropriate desired number.

While the term 'step' is sometimes used to denote a physical property of a stepper motor, in the present description, the term 'step' is used to denote any desired angular movement of the stepper motor, for example a micro-step.

Stepper motors are an example of a class of motors referred to position-controlled motors. A position-controlled motor is a motor controlled by a demanded output rotary position. That is, the output position may be varied on demand, or the output rotational velocity may be varied by control of the speed at which the demanded output rotary position changes. A stepper motor is an open loop position-controlled motor. That is, a stepper motor is supplied with an input signal relating to a demanded rotation position or rotational velocity and the stepper motor is driven to achieve the demanded position or velocity.

Some position-controlled motors are provided with an encoder providing a feedback signal indicative of the actual position or velocity of the motor. The feedback signal may be used to generate an error signal by comparison with the demanded output rotary position (or velocity), the error signal being used to drive the motor to minimise the error. A stepper motor provided with an encoder in this manner may form part of a closed loop position-controlled motor.

An alternative form of closed loop position-controlled motor comprises a DC motor provided with an encoder. The output from the encoder provides a feedback signal from which an error signal can be generated when the feedback signal is compared to a demanded output rotary position (or velocity), the error signal being used to drive the motor to minimise the error. A DC motor which is not provided with an encoder is not a position-controlled motor.

It will be appreciated that in embodiments of the labelling machine other than those shown in FIGS. 1 and 2, the motor may take any convenient form. For example, the motor may be any appropriate open or closed loop position-controlled motor.

When the labelling machines shown in FIGS. 1 and 2 are in use, a supply spool of label stock may be mounted to the supply spool support such that the supply spool support 10 supports the supply spool. The label machine shown in FIG. 1 does not have a supply spool mounted to the supply spool support 10. However, the labelling machine shown in FIG. 2 does have a supply spool 16 mounted to the supply spool support 10. The supply spool 16 is mounted to the supply spool support 10 such that the supply spool 16 co-rotates with the supply spool support 10.

As can be seen best in FIG. 2, in use, label stock 18 extends between the supply spool support 10 (and in particular the supply spool 16 mounted to the supply spool support 10) and the take up spool support 12. A web path 20 is defined between the supply spool support 10 and take up spool support 12 by various components and, in use, the label stock is transported along the web path 20. In the labelling machines shown in FIGS. 1 and 2, first, second and third rollers (22, 24 and 26) define the web path 20 between the supply spool support 10 and take up spool support 12. It will be appreciated that in other embodiments of the labelling machine, components other than rollers may be used to define the web path 20. Suitable components may be those which impart only a small friction force to label stock when label stock contacts it.

The web path 20 is also defined by a dancing arm 28 and a labelling peel beak 30. The dancing arm 28 includes a dancing arm roller 32 mounted at one end of the dancing arm 28.

In use, the label stock 18 extends along the web path 20 from the supply spool support 10 (and in particular from the supply spool 16) around the first roller 22, around the dancing arm roller 32, around the second roller 24, around the labelling peel beak 30, around the third roller 26 and is wound onto the take up spool support 12 to form a take up spool 34.

It will be appreciated that in other embodiments of a labelling machine according to the invention any appropriate number of rollers (or any other appropriate components) may be used to define a desired shape/length of web path 20.

The dancing arm 28 is a movable element which is rotatable about axis A. That is to say, in the labelling machines shown in FIGS. 1 and 2, the axis of rotation of the dancing arm 38 is coaxial with the axis of rotation of the supply spool support 10 (and the supply spool 16). In other embodiments this need not be the case. For example, the dancing arm 28 may rotate about an axis which is spaced from the axis A of rotation of the supply spool support 10 (and supply spool 16 if attached).

It will also be appreciated that in the labelling machine shown in FIGS. 1 and 2, the dancing arm 28 is a movable element which defines the web path 20 and movement of the dancing arm 28 changes the length of the web path between the supply spool support 10 and take up spool support 12. It will be appreciated that in other labelling machines any other appropriate movable element may be used, providing that movement of the movable element changes the length of the web path between the supply spool support and take up spool support.

The labelling machine shown in FIG. 2 includes a printer 36 (however, as previously discussed, other embodiments of labelling machine according to the present invention need not include a printer). The printer in this case is a thermal transfer printer. However, it will be appreciated that other embodiments of labelling machine according to the present invention may include any appropriate type of printer, for example, an inkjet printer, a thermal printer or a laser marking system. The printer 36 includes a ribbon supply spool support 38, a ribbon take up spool support 40, a print head 42 and a ribbon guide member 44. In use, a spool of printer ribbon is mounted to the ribbon supply spool support 38, such that said spool of printer ribbon constitutes a supply spool 46 of printer ribbon which is supported by the ribbon supply spool support 38.

In use, print ribbon from the supply spool 46 passes along a print ribbon path past the print head 42 and is wound on to the ribbon take up spool support 40 so as to form a take up spool 48. In order for print ribbon to be transported from the ribbon supply spool support 38 to the ribbon take up spool support 40, at least the ribbon take up spool support 40 is connected to a motor such that the motor can rotate the ribbon take up spool support 40.

Because the printer 36 shown in FIG. 2 is a thermal transfer printer, the print ribbon is thermally sensitive such that, as the print ribbon passes the print head 42, at least a portion of the print head 42 can be selectively energised to heat a desired portion of the print ribbon and transfer ink from that portion of the print ribbon to an adjacent substrate. In this case the adjacent substrate is a label that forms part of the label stock 18. During operation of the printer 36, the guide block 44 comprises guide rollers which help to guide the print ribbon as it is transported from the ribbon supply spool support 38 to the ribbon take up spool support 40.

In some embodiments the printhead of the printer may be configured to press the ribbon and label web against a print roller (not shown) to effect printing. In some embodiments the print roller comprises a stainless steel shaft of diameter 8 mm and is coated with a non-slip coating. In one embodiment, the non-slip coating is a silicon rubber coating having a Shore A hardness of 50-55 and a thickness of 2.75 mm. Consequently, the print roller has a diameter of 13.5 mm. It is preferable that the print roller is resistant to bending under pressure from the printhead and has as small a moment of inertia as possible. A reasonable comprise between these two requirements is achieved when the shaft is made from stainless steel. The primary purpose of the print roller is to provide a backing support against which the printhead presses the ribbon and label web so as to effect thermal transfer printing onto a label. As such, the print roller acts as platen roller. The provision of a non-slip coating has the effect of ensuring that there is substantially no slippage between the print roller and the label web. Consequently, the print roller rotates consistently as the label web moves along the web path. This means that the rotation of the print roller is an accurate indicator of label web movement. Rotation of the print roller may be used in processing carried out by a controller in order to determine an amount of movement of the label web along the web path in the manner described below.

In some embodiments the labelling machine may include an encoder which is configured to monitor rotation of the print roller. In one particular embodiment the encoder which measures the rotation of the print roller comprises a magnet (part number BMN-35H which is marketed by Bomatec, Höri, Switzerland) which is mounted to the end of the print roller such that it co-rotates with the print roller, and an encoder chip (part number AS5040, marketed by ams R&D UK Ltd) which measures rotation of the magnet and hence print roller, and outputs a signal which is representative thereof. This output can be used by the controller to determine an amount of movement of the label web along the label web path.

In some embodiments the diameter of the print roller is known to the controller. Because the diameter of the print roller is known, and because the label web runs over the print roller as the label web passes through the printer, the amount of rotation of the print roller is proportional to the displacement of the label web along the label web path. Consequently, a sensor signal output by the encoder, which is indicative of the amount of rotation of the print roller, may be supplied to a controller such that the controller can determine the displacement of the label web along the label web path and, consequently, an amount of movement of the label web along the label web path.

Although the encoder in this embodiment measures a rotation of the printer roller in order to output a sensor signal which is indicative of an amount of movement of the label web along the label web path, in other embodiments this need not be the case. Any appropriate encoder which is capable of outputting a sensor signal which is indicative of an amount of movement of the label web along the label web path may be used. For example, an encoder which measures the rotation of a different roller which contacts the label web may be used.

In other embodiments a periodic property of the label stock may be used to determine an amount of movement of the label web along the label web path. In such embodiments, the encoder may measure a property of the label stock which is periodic in order to provide a sensor signal which is indicative of an amount of movement of a label web along the label web path. For example, the encoder may use a gap sensor. As previously discussed, as the label web advances along the label web path, the gap sensor will measure a periodic property of the label web (i.e. periodic electromagnetic transmission coefficient of the label web). If a pitch length of the labels (i.e. the distance between equivalent portions of adjacent labels) is known by the controller then the controller can use this information to calculate an amount of movement of the label web along the label web path based upon the periodic encoder signal.

The label stock which is used by either of the labelling machines shown in FIGS. 1 and 2 comprises a web and a plurality of labels attached to the web. The labels attached to the web are separable from the web. The labelling peel beak 30 is configured such that, during operation of either of the labelling machines shown in FIGS. 1 and 2, as the label stock 18 is transported along the web path 20 past the labelling peel beak 30, the labelling peel beak 30 separates a passing label from the web.

The separated label may then be attached to a desired article. An example of such a desired article is an item passing on a conveyor (not shown) of a production line. However, it will be appreciated that the desired article may be any appropriate article. In the case of the labelling machine shown in FIG. 2, it will be appreciated that, prior to the label being attached to a desired article, the printer 36 may print a desired image on the label. In some embodiments the printing may occur prior to the labelling peel beak 30 separating the label from the web of the label stock, and in other embodiments the printing of the image may occur after the labelling peel beak 30 separates the label from the web of the label stock.

During operation of the labelling machines shown in FIGS. 1 and 2 the motor 14 is energised to rotate the take up spool support 12 about its axis B. As this is done, the take up spool support 12 winds label stock 18 onto the take up spool support 12 to form a take up spool 34. The take up spool 34 will include the web of the label stock. Any labels separated from the web of the label stock as they pass the labelling peel beak 30 will not form part of the take up spool 34. In some embodiments the labelling peel beak 30 may be configured to selectively separate labels from the web. In this case, any labels which are not separated from the web of the label stock by the labelling peel beak 30 will be wound onto the take up spool support 12 and therefore form part of the take up spool 34.

The winding of the label stock 18 (and in particular the web of the label stock) onto the take up spool support 12 will cause the label stock 18 to move along the web path 20 in the direction indicated by arrows C (FIG. 2). The winding of the web of the label stock onto the take up spool support 12 causes label stock to be paid out from the supply spool 16 which is supported by the supply spool support 10.

This arrangement, whereby the take up spool support 12 is driven so as to transport the label stock in the direction C of label stock transport, and where the supply spool support 10 is not driven may be referred to as a pull-drag system. This is because, in use, as discussed below, the supply spool support 10 provides some resistance (or drag) to the movement of label web so as to provide tension in the label web. In this case friction within the system provides the drag. For example, the friction may include the friction between the supply spool support and the means which supports the supply spool support for rotation. Drag may also be provided by the inertia of the supply spool. In other embodiments the drag in a pull-drag system may be actively controlled. For example, in one embodiment a DC motor may be attached to the to the supply spool support and may be energised in a direction which is opposite to the direction in which the supply spool support rotates due to label stock being wound off the supply spool support and on to the take up spool support. In this case, the amount of drag that the DC motor provides to the system can be controlled by controlling the current supplied to the motor and therefore the torque applied by the motor.

In other embodiments of the labelling machine, the supply spool support 10 may be driven so that, in use, it rotates the supported supply spool 16. In some embodiments the supply spool support 10 may be driven for rotation in a direction which opposes movement of the label stock in the direction C of label stock transport (which is effected by the rotation of the take up spool support 12). This kind of arrangement is also referred to as a pull-drag system.

In other embodiments the supply spool support 10 may be driven such that it is rotated by a motor in a direction which is complementary to movement of the label stock in the direction C of label stock transport (which is effected by rotation of the take up spool support 12). This type of arrangement may be referred to as a push-pull system. It will be appreciated that in embodiments of the labelling machine which include a driven supply spool support 10, the supply spool support 10 may be driven by any appropriate motor. Examples of such motors include a DC motor or a position-controlled motor such as, for example, a stepper motor.

Figure 3:
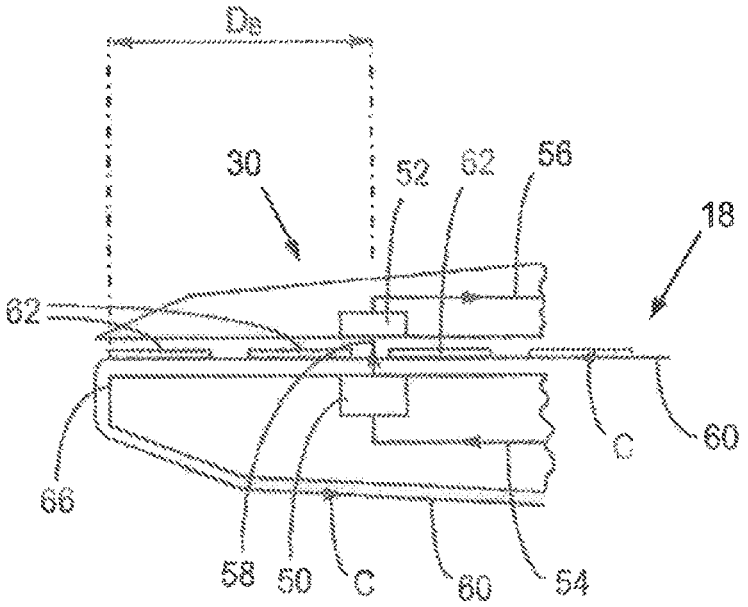
FIG. 3 shows a schematic cross section through a portion of a labelling peel beak which forms part of a labelling machine in accordance with an embodiment of the invention.

FIG. 3 shows a schematic cross-section through a labelling peel beak 30 which forms part of a labelling machine in accordance with an embodiment of the present invention. The labelling peel beak 30 includes a sensor comprising an electromagnetic radiation source 50 and an electromagnetic radiation detector 52. The electromagnetic radiation source 50 is powered by a power source via a power line 54. The sensor, and in particular the electromagnetic radiation detector 52, is configured to produce a sensor signal 56. The sensor may commonly be referred to as a gap sensor and is generally arranged to produce a sensor signal which differentiates between portions of the web which carry labels and portions of the web that do not. Although in this embodiment the labelling peel beak 30 includes the gap sensor, in other embodiments, the gap sensor may be located remote to the labelling peel beak at any appropriate position along the web path. In some embodiments it may be advantageous for the gap sensor to be located close to the labelling peel beak. Locating the gap sensor close to the labelling peel beak may reduce potential error in positioning a portion of the label stock at the labelling peel beak based upon a signal produced by the gap sensor.

In use, the electromagnetic radiation source 50 produces a beam 58 of electromagnetic radiation. Label stock 18 comprising a web 60 and a plurality of labels 62 attached to the web (and which are separable from the web) passes between the electromagnetic radiation source 50 and electromagnetic radiation detector 52 as the label stock 18 is transported in a direction C along a web path past the labelling peel beak 30. The beam 58 of electromagnetic radiation which is produced by the electromagnetic radiation source 50 passes through the label stock 18 and is incident on the electromagnetic radiation detector 52. The sensor signal 56 output by the electromagnetic radiation detector 52 is a function of an amount of electromagnetic radiation which is incident on the electromagnetic radiation detector 52. That is to say, the sensor signal 56 output by the electromagnetic radiation detector 52 is a function of the amount of electromagnetic radiation which is produced by the electromagnetic radiation source 50 and which passes through the label stock 18.

FIG. 4 shows a schematic plan view of a portion of label stock 18. The portion of label stock 18 shown in FIG. 4 has labels which are all substantially the same size and shape. Other label stock which may be used by the labelling machine may have labels which are of a different size and/or which may have different spacing therebetween. For example, some label stock which may be used by the labelling machine includes two types of label, each type having a different size and/or shape. The label stock may be such that along the length of the label stock the labels alternate between labels of a first type and labels of a second type. It can be seen from FIG. 3 that, when a portion of label stock 18 as shown in FIG. 4 passes between the electromagnetic radiation source 50 and electromagnetic radiation detector 52, the beam 58 of electromagnetic radiation will propagate in a direction which is substantially out the page in FIG. 4. The direction of propagation of the beam 58 of electromagnetic radiation may be substantially perpendicular to the plane of the substantially planar label stock 18.

The electromagnetic transmittance (i.e., what proportion of electromagnetic radiation incident on a material is transmitted through the material) of the web 60 of the label stock will commonly be different to the electromagnetic transmittance of the labels 52 of the label stock 18. Also the electromagnetic transmittance of two different thicknesses of a material will also be different (i.e., the electromagnetic transmittance through a relatively thick material will be less than the electromagnetic transmittance through a relatively thin material). Either of these two factors, or a combination of the two, will result in the electromagnetic transmittance of a portion of the label stock 18 which includes only the web 60 (for example at a position indicated by D, sometimes referred to in the art as a 'gap') will be different to (in this case greater than) the electromagnetic transmittance of a portion of the label stock 18 which includes both the web 60 and a label 62 (for example at a position indicated by E).

When the beam 58 of electromagnetic radiation produced by the electromagnetic radiation source 50 passes through a portion of the label stock with a relatively high electromagnetic transmittance (such as through the label stock 18 at position D within FIG. 4), then the amount of electromagnetic radiation which is incident on the electromagnetic radiation detector 52 will be greater than when compared to the amount of electromagnetic radiation incident on the electromagnetic radiation detector 52 when the beam 58 of electromagnetic radiation produced by the electromagnetic radiation source 50 passes through a portion of the label stock 18 which includes both the web 60 and a label 62 (for example at a position indicated by E in FIG. 4).

Consequently, the sensor signal 56 output by the electromagnetic radiation detector 52 will be different depending on whether the beam 58 of radiation produced by the electromagnetic radiation source 50 passes through a portion of the label stock 18 which has a relatively high transmittance (for example at the position D) or whether the beam 58 of electromagnetic radiation produced by the electromagnetic radiation source 50 passes through a portion of the label stock 18 which has a relatively low electromagnetic transmittance (for example at position E). For example, the sensor signal 56 produced by the electromagnetic radiation detector 52 of the sensor may be a voltage and the voltage may be greater when the beam of electromagnetic radiation 58 passes through a portion of the label stock 18 has relatively high electromagnetic transmittance compared to the voltage when the beam 58 of electromagnetic radiation passes through a portion of the label stock 18 with relatively low electromagnetic transmittance.

Because the label stock 18 will, in use, be transported along the web path in a transportation direction C, it will be appreciated that the beam 58 of radiation will alternate between passing through a portion of the label stock 18 which includes only the web 60 (e.g. as indicated at position D in FIG. 4), and a portion of the label stock 18 which includes the web 60 and a label 62 (e.g. as indicated at position E in FIG. 4). For ease of reference, a portion of label web 60 which has no label attached to it and which is between two adjacent labels 62 may be referred to as a gap. Two such gaps are indicated by shading 64 in FIG. 4.

The label stock 18 includes a plurality of labels 62 which have a label width $W_L$ which is substantially perpendicular to the transportation direction C, and a label length $L_L$ which is substantially parallel to the transportation direction C. The labels 62 are substantially similar as is the gap 64 between adjacent labels. The length of a gap is denoted $L_G$. The pitch length $L_P$ between adjacent labels is the sum of the label length $L_L$ and the gap length $L_G$ of the adjacent gap 64.

As the label stock 18 moves in the transportation direction C the electromagnetic radiation detector 52 of the sensor will produce a sensor signal 56 which is indicative of a periodic property of at least a portion of the label stock 18. In other words the sensor will produce a sensor signal 56 which is periodic given the nature of the label stock 18. In this case the electromagnetic transmittance of the label stock 18 can be said to be a periodic property of the label stock which varies along the length (in a direction generally parallel to the transportation direction C) of the label stock 18. That is to say, the sensor signal 56 will vary periodically as the beam 58 of electromagnetic radiation periodically passes through a gap 64, and then a label 62 affixed to the label web 60 in an alternating manner. The period of the periodic sensor signal 56 produced by the electromagnetic radiation detector 52 will be equal to the time taken for the label stock 18 to be transported in the transportation direction C by a distance equal to the pitch length $L_P$ (i.e., the sum of the label length $L_L$ and the gap length $L_G$.).

In general terms, where a leading label edge passes the electromagnetic radiation detector 52 the sensor signal 56 changes from having a relatively high value to a relatively low value. Similarly, where a trailing label edge passes the electromagnetic radiation detector 52 the sensor signal 56 changes from having a relatively low value to a relatively high value. The change in sensor signal 56 as the portion of label web shown in FIG. 4 passes the electromagnetic radiation detector is shown in FIG. 4*a* where the period of the signal p is marked. A transition from a gap to a leading edge of a label is represented by a signal transition from a relatively high value to a relatively low value. A transition from a trailing edge of a label to a gap is represented by a signal transition from a relatively low value to a relatively high value.

For some types of label stock the length of each label $L_L$ and the length of each gap $L_G$ will be substantially constant. Consequently, the pitch length $L_P$ for a given label stock 18 will also be substantially constant. The pitch length $L_P$, label length $L_L$ and/or gap length $L_G$ for a particular label length may be provided by the supplier of the label stock 18. Alternatively, the pitch length $L_P$, label length $L_L$ and/or gap length $L_G$ may be measured using any appropriate known way of measuring length. For example, an encoder may measure the rotation of a roller which contacts the label stock and this information may be used to determine displacement of the label stock along the label web path. By measuring the displacement of the label stock along the web path whilst the label stock passes the gap sensor, the gap sensor outputting the periodic sensor signal as discussed above, the pitch length $L_P$, label length $L_L$ and/or gap length $L_G$ can be measured.

Information relating to the pitch length $L_P$ of a particular label stock 18 may be provided to a controller of the labelling machine. Alternatively, information relating to the label length and the gap length of a particular label stock may be provided to the controller of the labelling machine such that the controller may use this information in order to calculate the pitch length of the label stock 18. In a further embodiment, the labelling machine may include a device which measures the pitch length $L_P$ (or the label length $L_L$ and gap length $L_G$ in order to calculate the pitch length $L_P$). It will be appreciated that any known measuring device may be used to measure such lengths.

In one embodiment the lengths $L_P$, $L_L$ and $L_G$ are measured as follows. The motive device which advances the label stock along the web path can be controlled by the controller such the controller can calculate the linear displacement of the label stock in any given time. Referring to FIG. 4*a*, it can be seen that the sensor signal 56 varies with position of the label stock depending on whether there is a label or a gap adjacent to the sensor. Consequently, in order to determine the length $L_L$ the controller can calculate the linear displacement of the label stock during the portion of the periodic signal 57 (which in this case has a relatively low value) measured by the sensor which is indicative of the presence of a label. Likewise, in order to determine the length $L_G$ the controller can calculate the linear displacement of the label stock during the portion of the periodic signal 59 (which in this case has a relatively high value) measured by the sensor which is indicative of the presence of a gap. In order to determine $L_P$ the controller can either add the linear displacements measured for $L_L$ and $L_G$, or the controller can calculate the linear displacement of the label stock during a portion of the periodic signal p.

The controller can calculate the linear displacement of the label web in various ways. One example is that the controller may calculate the diameter of the spool supported by the take up spool support. An example of how the controller may calculate the diameter of the spool supported by the take up spool support is described at a later point within the description. The controller can then control a stepper motor which drives the take up spool support so that it monitors the number of steps the stepper motor is commanded to take in a given time. By multiplying the number of steps the stepper motor is commanded to take in a given time by the known angular movement of the stepper motor per step, the controller can calculate the angular movement of the stepper motor and hence the take up spool support in said given time. By multiplying the radius (half the diameter) of the spool supported by the take up spool support and the angular movement of the take up spool support in said given time, the controller can calculate the linear displacement of the label stock due to label stock being wound on to the take up spool support during said given time. Such displacement information can be used to determine $L_L$, $L_G$ and/or $L_P$.

The controller of the labelling machine is configured to calculate a displacement of the web along the web path based upon the sensor signal 56 and a length of a component of the label stock 18. In this case, the sensor signal is provided by the electromagnetic detector and the length of a component of the label stock is the pitch length $L_P$ (i.e., the sum of the label length $L_L$ and the gap length $L_G$). In use the controller monitors the sensor signal 56 and counts the number of periods of the periodic sensor signal which are provided to it. As previously discussed, this corresponds to the number of times the beam 58 of electromagnetic radiation passes through a label 62 and an adjacent gap 64. Consequently, the controller calculates the displacement of the web along the web path by multiplying the number of periods of the sensor signal provided to it by the pitch length $L_P$ of the label stock 18.

In some embodiments, the controller may also be configured to monitor the period of the periodic sensor signal 56. The controller may then calculate a speed of the web along the web path by dividing the pitch length $L_P$ (i.e., the sum of the label length $L_L$ and the gap length $L_G$) by the period of the sensor signal 56.

FIG. 5 shows a perspective view of a portion of an embodiment of a labelling machine of the type shown in FIG. 1 or FIG. 2. FIG. 5 shows the supply spool support 10, the dancing arm 28 and a brake assembly 70. The supply spool support 10 includes a support disc 72 and a supply spool 16 of label stock supported by the supply spool support 10.

As previously discussed in relation to FIGS. 1 and 2, the labelling machine of which the supply spool 16 forms part also includes a take up spool support adapted to take up a portion of the web of the label stock. A web path is defined between the supply spool and the take up spool. The dancing arm 28 is a moveable element which, in use, defines a portion of the web path. In fact, in use, the label stock passes from the supply spool 16 and runs over the roller 32 which is mounted on the dancing arm 28. In FIG. 5, neither the take up spool, nor the web of the label stock running along the web path, are shown so as to aid clarity of the figure.

As previously discussed, the dancing arm 28 and supply spool support 10 are both mounted for individual rotation about a common axis A. In other embodiments, the supply spool support 10 and dancing arm 28 may rotate about their own respective axes.

FIGS. 6 to 11 show further different views of the brake assembly 70 which is configured to apply a variable braking force to the supply spool support 10, the braking force resisting rotation of the supply spool support 10. The brake assembly 70 includes a brake disc 74 which is attached to the supply spool support 10 such that it co-rotates with the supply spool support 10 (and consequently any supply spool which is supported by the supply spool support 10).

The brake assembly also includes a brake belt 76 which extends around part of the outer circumference 88 of the brake disc 74. The brake belt is fixed at a first end **76*a* to an attachment pin 78 which is part of a mounting block 80 which is fixed so that it does not rotate with the supply spool support 10. The brake belt 76 is attached at second end 76*b* via a spring 82 to a pin 84 of a lever arm 86. The spring may be any appropriate resilient biasing member. In one embodiment the spring 82** is tension spring number 523 having a rate of 4.48 N/mm produced by Kato-Entex Ltd, UK.

In the embodiment shown, the brake belt 76 has a generally rectangular cross-section and it contacts a portion of the outer circumference 88 of the brake disc 74 which has a substantially flat surface parallel to the axis A. That is to say, the substantially flat circumferential surface 88 of the brake disc 74 corresponds to the substantially flat surface of the belt 76 which engages the outer circumference 88 of the brake disc 74. It will be appreciated that in other embodiments of the labelling machine, the outer circumferential surface of the brake disc and the brake belt may have any appropriate corresponding profile. For example, the outer circumferential surface of the brake disc may include a v-shaped groove which cooperates with generally circular cross-section brake belt.

The brake belt 76 may be made from any appropriate material for example the brake belt may be made out of a combination of fabric and polymeric material or of polyurethane. In one embodiment the brake belt is 10 mm wide, 280 mm long and formed from a material referred to as Habasit TG04. In this embodiment the brake disc (which may be of any appropriate size in other embodiments) has a diameter of 100 mm.

The lever arm 86 is pivotally mounted to the mounting block 80 by a pivot pin 90. A first end of the lever arm 86 includes the pin 84. A second end of the lever arm 86 engages an armature 92 of a solenoid 94. An example of a suitable solenoid is a Multicomp MCSMT-3257S12STD solenoid supplied by Premier Farnell UK Limited.

As can be seen best in FIG. 7, the distance between the pivot pin 90 and the point **96*a* on the pivot arm 86 at which the armature 92 of the solenoid 94 engages the pivot arm 86 is greater that the distance between the pivot pin 90 and the pin 84 to which the brake belt 76 is attached. In this way, the lever arm 86 provides a mechanical advantage such that any force applied by the armature 92 of the solenoid 94 to the lever arm 86 is magnified when it is applied to the brake belt 76 via the pin 84**.

In use a resilient biasing member 98 (which in this embodiment is a spring different to the spring 82, but may be any other appropriate resilient biasing member) biases the lever arm 86 in a direction such that the spring 98 causes the brake belt 76 to contact the outer circumference 88 of the brake disc 74 so as to apply a braking force to the brake disc 74 and therefore resist rotation of the brake disc 74 and attached supply spool support 10. In one embodiment the spring 98 is compression spring number 940 having a rate of 0.94 N/mm produced by Kato-Entex Ltd, UK. The direction of the force applied by the spring 98 to the second end **76*b* of the brake belt 76 is denoted S in FIG. 7. This ensures that, when no power is supplied to the solenoid 94 (for example when the labelling machine is powered down), the spring 98 causes a braking force to be applied to the brake disc 74 and hence the supply spool support 10**.

Extension of the armature 92 of the solenoid 94 in the direction towards the lever arm 86 and as indicated by arrow F will cause the pin 84 to move in a direction of arrow F' which is substantially opposite to that of the arrow F. Consequently, if the solenoid 94 is energised such that the armature 92 moves towards the lever arm 86 in the direction F, this will cause the lever arm 86 to overcome the biasing force exerted on it by the spring 98 such that the pin 84 moves in the direction F'. This will cause the amount of braking force exerted by the brake belt 76 on the brake disc 74 to decrease. It follows that by controlling the position of the solenoid armature 92 (and hence controlling the position of the pin 84 via the lever arm 86) that the amount of braking force applied to the supply spool support 10 via the brake disc 74 can be varied.

The surface of the brake belt 76 which contacts the outer circumferential surface 88 of the brake disc 74 may be referred to as a first braking surface. The outer circumferential surface 88 of the brake disc 74 which is contacted by the first braking surface may be referred as a second braking surface. In a braking mode the controller controls the current supplied to the coil of the solenoid so as to urge the first braking surface against the second braking surface. As previously discussed, this is done by moving the armature 92 of the solenoid in a direction which is substantially opposite to the direction F (shown by arrow F'), thereby allowing the spring 98 to bias the end of the lever arm 86 which includes the pin 84 in a direction which is substantially parallel to the direction F (i.e. substantially in direction S). Due to the fact that the second end **76*b* of the brake belt 76 is connected to the pin 84 and due to the fact that the first end 76*a* of the brake belt 76 is attached to a fixed pin 78, movement of the pin 84 in a direction which is substantially parallel to the direction F causes the first braking surface to be urged against the second braking surface, thereby applying a braking force to the brake disc 74. The second braking surface 88 is part of the brake disc 74 which is attached to the supply spool support 10. Consequently the supply spool support 10 is associated with the second braking surface 88**.

As seen best in FIGS. 7, 8 and 10, the solenoid 94 includes a coil (not shown) housed within a solenoid housing 96 and the armature 92 which is a linearly moveable relative to the coil. One end of the armature 92 engages the lever arm 86. Attached to the other end of the armature 92 is a reflective element 99 which forms part of an armature position sensor. In one embodiment the reflective element 99 is a generally annular machined part made from white acetal material.

The armature position sensor further includes a transmitter 100 configured to transmit electromagnetic radiation and a receiver 102 which is configured such that electromagnetic radiation transmitted by the transmitter 100 and reflected by the reflective element 99 is incident on the receiver 102. The transmitter 100 and receiver 102 can be seen most clearly in FIG. 8. In this embodiment the transmitter 100 is a light emitting diode and the receiver 102 is a photodiode. Both the transmitter 100 and the receiver 102 are supported by a sensor support 104 which is in a fixed positional relationship with regard to the body 96 of the solenoid 94 (and hence the coil of the solenoid contained within the body 96). In one embodiment the transmitter 100 and receiver 102 are a single part, HDSL-9100-021 proximity sensor, produced by Avago Technologies, U.S. Inc.

In use, the transmitter 100 (in this case an LED) transmits electromagnetic radiation in a direction such that it is incident on the reflective element 99. The reflective element 99 reflects at least a portion of the electromagnetic radiation which is incident on it. Some of the electromagnetic radiation which is reflected by the reflective element 99 is incident on the receiver 102. As previously discussed, in this case, the receiver 102 is a photodiode. Consequently the voltage and/or current of a signal output by the photodiode is indicative of the amount of electromagnetic radiation which is reflected by the reflective element 99 and incident on the receiver 102.

When the armature 92 of the solenoid 94 is moved the position of the reflective element 99 relative to the transmitter 100 and receiver 102 will change. The further the reflective element 99 is away from the transmitter 100 and receiver 102 (i.e. the further the armature 92 of the solenoid 94 is moved in the direction F) the less electromagnetic radiation produced by the transmitter 100 and reflected by the reflective element 99 will be incident on the receiver 102. Consequently, in this case where the receiver is a photodiode, the less the magnitude of the voltage and/or current signal produced by the receiver 102. It follows that the receiver 102 of the armature position sensor outputs a signal (which may be referred to as an armature position signal) which is indicative of the position of the armature 92 relative to the coil of the solenoid 94. It will be appreciated that the armature position signal is also indicative of the position of a lever arm 86 and hence of the braking force which is being applied by the brake belt 76 (which is attached to pin 84 of the lever arm 86) to the brake disc 74 and hence to the supply spool support 10.

In a standard solenoid of the type used in FIG. 7, the extent of relative movement between the armature and the coil is dependent on the current supplied to the coil. The armature of the solenoid is biased relative to the coil by a resilient biasing member (not shown) towards a first end position. Hence, when no current is supplied to the coil, the solenoid is biased towards the first end position. When current of a particular magnitude is applied to the coil of the solenoid the armature overcomes the biasing force which urges it into the first end position such that the armature moves towards a second end position. Removing the current provided to the coil will result in the armature being urged by the resilient biasing member back to the first end position. Consequently, solenoids tend to be bi-stable, i.e. depending on the operating state of the solenoid, the armature tends to be located relative to the coil at the first end position or the second end position. The armature cannot be reliably located relative to the coil at a position between the first end position and the second end position.

A labelling machine described herein includes a solenoid control system which includes a solenoid controller and is configured to control the current supplied to the coil of the solenoid based upon the armature position signal output by the armature position sensor so as to urge the armature towards a desired rest position relative to the coil which is intermediate the first and second end positions of the solenoid discussed above. The solenoid controller implements a conventional PID (proportional, integral and derivative) algorithm as part of a closed loop system in order to control the current supplied to the coil of the solenoid.

FIG. 14 shows a diagrammatic representation of the PID control algorithm implemented by the solenoid controller. At any given time a set point value SP(t) is provided to the control algorithm. The set point value SP(t) is indicative of the desired position of the armature of the solenoid relative to the coil. The set point signal SP(t) is provided to one input of a subtractor 110. A feedback signal FB(t) which is indicative of the actual position of the armature relative to the coil of the solenoid is supplied to a second input of the subtractor 110. The subtractor 110 subtracts the feedback signal FB(t) from the set point signal SP(t) and outputs an error signal E(t).

The error signal E(t) is supplied to three portions of the PID algorithm. These are the proportional component P, the integral component I, and the derivative component D. As can be seen from the figure, the proportional component P outputs a signal which is given by a constant $K_P$ multiplied by the error signal E(t). The integral component I outputs a signal which is given by a constant $K_I$ multiplied by the integral of the error signal E(t). The derivative component D of the algorithm outputs a signal which is given by a constant $K_D$ multiplied by a derivative of the error signal E(t) with respect to time.

An adder 112 combines the signals output by the proportional P, integral I and derivative D components of the algorithm. The output from the adder 112 is provided to a coil driver 114. The coil driver 114 is connected across the coil of the solenoid so that it can apply a voltage across the coil. The coil driver 114 supplies a pulse width modulated voltage signal across the coil of the solenoid. The coil driver 114 controls the duty cycle of the pulse width modulated voltage signal applied across the coil as a function of the signal output to it by the adder 112 of the PID control algorithm.

By varying the duty cycle of the pulse width modulated voltage applied across the coil of the solenoid, the current supplied to the coil, and hence the position of the armature of the solenoid relative to the coil, can be changed. An armature position sensor 116 outputs an armature position signal which is indicative of the position of the armature relative to the coil of the solenoid. The armature position signal may also be referred to as the feedback signal FB(t). In the previously described embodiment shown in FIGS. 5 to 13, the armature position sensor 116 includes the transmitter 100, the reflective element 99 and the receiver 102. As previously discussed, it is the receiver 102 which outputs the armature position signal. Details of the operation of the armature position sensor can be found in the description above. However, it will be appreciated that any appropriate armature position sensor (which is capable of producing an armature position signal which indicative of the position of the armature relative to the coil) may be used.

A conventional PID controller is configured such that an increase in the signal output by the adder which combines the proportional, integral and derivative components (e.g. 112 in FIG. 14) causes an increase in the feedback signal. However in the case of the embodiment previously described with reference to FIG. 14 the opposite occurs. An increase in the signal output by the adder 112 results in an increase in the current in the coil provided by the coil driver 114, which causes a decrease in the feedback signal FB(t) produced by the armature position sensor 116. This may be compensated for in a number of ways. For instance, the range of the feedback signal may be inverted such that a small signal is generated when the reflector is close to the transmitter, and a larger signal generated when the reflector is further away from the transmitter. Alternatively, the connections of the signals to the subtractor 110 may be swapped.

A suitable frequency for the pulse width modulated voltage is approximately 10 kHz. That is to say, during each $1/10{,}000$ of a second the voltage applied is taken high, and then low again. Within each $1/10{,}000$ of a second the duration for which the signal is high and the duration for which the signal is low are varied, however in each case the sum of the duration for which the signal is high and the duration for which the signal is low is always equal to $1/10{,}000$ of a second. Of course, any appropriate frequency of pulse width modulated voltage may be used.

The armature position sensor is calibrated as follows. The solenoid is caused to enter a de-energised state by the controller. In this state, substantially no current is provided to the coil of the solenoid. The armature is urged to the limit of its movement in the direction F' by the biasing force of the spring 98 (an also by any resilient biasing member within the solenoid). At this point the controller records the value of the signal output by the armature position sensor. This value may be referred to as the maximum braking value because it corresponds to the configuration of the brake assembly (in this case the position of the armature) in which the maximum braking force is applied to the spool support by the brake assembly.

The solenoid is then caused to enter a fully energised state by the controller. In this state, enough current is provided to the coil of the solenoid such that the armature is urged against the biasing force of the spring 98 to the limit of its movement in the direction F. At this point the controller records the value of the signal output by the armature position sensor. This value may be referred to as the minimum braking value because it corresponds to the configuration of the brake assembly (in this case the position of the armature) in which the minimum braking force is applied to the spool support by the brake assembly.

In this embodiment the exact relationship between armature position and braking force applied by the brake assembly to the spool support is unknown. What is known is that when the armature position sensor outputs a signal to the controller which has a value equal to the maximum braking value, then the braking force applied by the brake assembly to the spool support is a maximum. Likewise, when the armature position sensor outputs a signal to the controller which has a value equal to the minimum braking value, then the braking force applied by the brake assembly to the spool support is a minimum. When the armature position sensor outputs a signal to the controller which has a value between the minimum braking value and the maximum braking value, then the braking force applied by the brake assembly to the spool support is between the minimum and maximum braking force. The closer the value of the signal output by the armature position sensor to the maximum braking value, the closer the braking force applied by the brake assembly to the spool support is to the maximum braking force. Likewise, the closer the value of the signal output by the armature position sensor to the minimum braking value, the closer the braking force applied by the brake assembly to the spool support is to the minimum braking force. In other embodiments the armature position sensor may be calibrated such that the relationship between armature position and braking force applied by the brake assembly to the spool support is known.

In order to avoid the armature colliding with a portion of the coil or an end-stop (if present) during operation, a limited range of the full movement of the armature may be used. That is to say, the solenoid controller and/or PID algorithm may be configured such that the coil driver provides a maximum current to the coil which is less than the current required for the solenoid to enter its fully energised state; and such that the coil driver provides a minimum current to the coil which is greater than the current required for the solenoid to enter its de-energised state.

Extension of the armature 92 of the solenoid 94 in the direction towards the lever arm 86 and as indicated by arrow F will cause the pin 84 to move in a direction of arrow F' which is substantially opposite to that of the arrow F. Consequently, if the solenoid 94 is energised such that the armature 92 moves towards the lever arm 86 in the direction F, this will cause the lever arm 86 to overcome the biasing force exerted on it by the spring 98 such that the pin 84 moves in the direction F'. This will cause the amount of braking force exerted by the brake belt 76 on the brake disc 74 to decrease. It will be appreciated that in other embodiments the brake assembly may be configured such that energising the solenoid increases the braking force applied to the spool support and de-energising the solenoid decreases the braking force applied to the spool support. In other embodiments any suitable braking arrangement may be used, for example brake disc and brake pad, brake drum and brake shoe or appropriate motor as discussed in more detail below.

Any appropriate gain constants $K_P$, $K_I$ and $K_D$ may be used. In some embodiments, at least one of these constants may be equal to zero. However, in a preferred embodiment, all of these constants are non-zero.

In some embodiments, an offset may be applied to ensure that with zero error between the set point signal and the feedback signal, a control signal is generated which is in the centre of the range of valid control signals.

In some embodiments, the PID control algorithm may incorporate a dead band. In such embodiments, the error signal E(t) is set to zero if the feedback signal FB(t) is within a given range of the set point signal SP(t). For example, the dead band may operate such that if the difference between the set point signal SP(t) and the feedback signal FB(t) is less than ±1% of the set point signal SP(t) then the error signal E(t) is set to zero. Alternatively, if the difference between the set point signal SP(t) and the feedback signal FB(t) is less than ±1% of a maximum possible set point signal (i.e. the set point signal which is equivalent to a desired fully energised state of the coil of the solenoid, or a desired de-energised state of the solenoid) then the error signal E(t) is set to zero. If, in either of these cases, the feedback signal FB(t) falls outside of this range then the error signal E(t) is calculated in the manner already described by the subtractor 110.

Other embodiments incorporating a dead band may function in a slightly different manner. These embodiments operate in the same manner as the dead band previously described except that if the feedback signal FB(t) falls outside of the dead band then the error signal E(t) is calculated by calculating the difference between the feedback signal FB(t) and the edge of the dead band which is closest to the feedback signal FB(t). For example, if the dead band is ±1% of the set point signal SP(t), and the feedback signal FB(t) has a value of the set point signal SP(t) plus 1% of the set point signal SP(t) plus μ, then the value of the error signal is −μ. Likewise, if the dead band is ±1% of the set point signal SP(t), and the feedback signal FB(t) has a value of the set point signal SP(t) minus 1% of the set point signal SP(t) and minus μ, then the value of the error signal is μ. In an alternative example, if the dead band is ±1% of the maximum possible set point signal (i.e. the set point signal which is equivalent to a desired fully energised state of the coil of the solenoid, or a desired de-energised state of the solenoid), and the feedback signal FB(t) has a value of the set point signal SP(t) plus 1% of the maximum possible set point signal, plus μ, then the value of the error signal is −μ. Likewise, if the dead band is ±1% of the maximum possible set point signal, and the feedback signal FB(t) has a value of the set point signal SP(t) minus 1% of the maximum possible set point signal SP(t) and minus μ, then the value of the error signal is μ.

Where a non-zero value is used for $K_D$, some form of low pass filtering (a concept which is well known in the art) may be used to reduce the noise present in the feedback signal. That is to say low pass filtering may be used either to reduce the amount of relatively high frequency noise from the derivative component D of the PID algorithm (compared to the relatively low frequency desired portion of the derivative component D of the PID algorithm) or to reduce the amount of relatively high frequency noise from the feedback signal (compared to the relatively low frequency desired portion of the feedback signal). It will be appreciated that if a low pass filter is used as a form of low pass filtering, then the cut-off frequency of the low pass filter would be chosen (in a manner well known in the art) such that relatively high frequency noise from the derivative component D of the PID algorithm or feedback signal is attenuated but the relatively low frequency desired portion of the derivative component D of the PID algorithm or feedback signal is allowed to pass.

The reason a form of low pass filtering may be used to remove noise if a non-zero value of $K_D$ is used is because the derivative term acts to amplify the rate of change of the feedback signal and is thus particularly sensitive to high frequency content as this has a greater rate of change than low frequency content (assuming equal amplitude). The noise may be caused by various factors. For example, the noise may be intrinsic to the emitter/detector arrangement, it may be electronic circuit noise, it may be electromagnetically-induced interference or it may be any other noise source. In the case where the armature position sensor comprises a radiation detector, noise may be caused by the presence of unintended radiation. One example of a form of low pass filtering includes a simple averaging algorithm. The averaging algorithm may take a number of samples of the feedback signal FB(t) or the derivative component D of the PID algorithm and then output the mean value of those samples. However, any appropriate form of low pass filtering or any appropriate known method of reducing noise may be used.

It is possible that a braking assembly included in a labelling machine (as described above or otherwise) may include at least one component that is subject to wear over time. Once said at least one component of the braking assembly has worn to the extent that performance of the labelling machine is unacceptably adversely affected then said at least one component of the braking assembly may require replacement. In order to replace said at least one component it may require that the labelling machine is shut down at an inconvenient time which results in down time of a production line of which the labelling machine forms part.

One embodiment which obviates or mitigates this problem is discussed below. The controller may include a memory. The controller may be configured so as to monitor a parameter which is indicative of the state of the braking assembly and to maintain (store and update) a value in the memory which is indicative of the accumulated use of the braking assembly. For example, the controller may be configured to monitor the set point signal and/or feedback signal of a control algorithm which controls the braking assembly. In one example incorporating the braking assembly above, the output of the armature position sensor (or feedback signal FB(t)) is monitored by the controller and the controller maintains the value in the memory as a function of the output of the armature position sensor (or feedback signal FB(t)) over time.

For example, the armature position sensor may output a signal (e.g. a voltage) which increases in magnitude as the braking force applied by the solenoid increases. The controller may monitor the output of the armature position sensor and periodically (i.e. after every time a fixed period of time passes) add the output of the armature position sensor at that time to the value currently stored in the memory. In this way, the greater the magnitude of the value stored in the memory, the greater the amount of braking force (over time) that has been applied by the braking assembly. The controller may monitor the magnitude of the value. It is thought that the total braking force applied over time is proportional to the accumulated value stored in the memory and to the wear of components of the braking assembly.

Consequently, if the controller detects that the magnitude of the value exceeds a predetermined value which has been chosen to indicate a potential level of wear of a component of the braking assembly which may be unacceptable (but some time before the component fails), then the controller may be configured to output a signal indicating that the braking assembly requires maintenance. The controller may be configured to output a signal indicating that the braking assembly requires maintenance if the value stored in the memory falls within any appropriate predetermined range.

The signal which indicates the braking assembly requires maintenance may be supplied to a suitable indicator (e.g. an audible and/or visual indicator) which is configured to indicate that the braking assembly requires maintenance to an operator of the labelling machine. The braking assembly may then be maintained at the next convenient opportunity—for example when the production line of which the labelling machine forms part is powered down or when the production line is experiencing downtime for another reason. In this way inconvenient downtime of the production line caused by servicing/maintenance of the braking assembly is avoided.

Within the braking assembly described above, examples of components which may be subject to wear and hence require maintenance/replacement include the brake belt 76, the brake disc 74 or the solenoid 94. It will be appreciated that in other embodiments the components of the braking assembly which may be subject to wear may be any appropriate components.

In the embodiment discussed above the output of the armature position sensor (or feedback signal FB(t)) is monitored by the controller and the controller maintains the value in the memory as a function of the output of armature position sensor (or feedback signal FB(t)) over time. If, over time, the controller detects that the magnitude of the value exceeds a predetermined value which has been chosen to indicate a potentially unacceptable level of wear of a component of the braking assembly, then the controller outputs a signal indicating that the braking assembly requires maintenance. Any appropriate method of monitoring a parameter which is indicative of the state of the braking assembly so as to detect a potential wear condition of the braking assembly may be used.

In another example, incorporating the braking assembly described above, the output of the armature position sensor (or feedback signal FB(t)) is monitored by the controller and the controller records a value in the memory which is indicative of the output of the armature position sensor (or of the feedback signal FB(t)) during the first use of the labelling machine (or the first use of the labelling machine after the braking assembly has been maintained. For example, the controller may determine and record a value in the memory which is indicative of the average output of the armature position sensor (or the average of the feedback signal FB(t)) whilst the labelling machine transfers the first reel of label stock from the supply spool support to the take up spool support (or whilst the labelling machine transfers the first reel of label stock after maintenance of the braking assembly from the supply spool support to the take up spool support). The controller is configured to subsequently monitor the output of the armature position sensor (or feedback signal FB(t)) and, in a similar manner to that done in relation to the first reel of label stock, calculate a value indicative of the average output of the armature position sensor (or the average of the feedback signal FB(t)) whilst the labelling machine transfers each subsequent reel of label stock from the supply spool support to the take up spool support. The controller may be configured to output a signal indicating that the braking assembly requires maintenance if the value indicative of the average output of the armature position sensor (or the average of the feedback signal FB(t)) whilst the labelling machine transfers a subsequent reel of label stock from the supply spool support to the take up spool support differs by more than a predetermined amount from the value stored in the memory indicative of the average output of the armature position sensor (or the average of the feedback signal FB(t)) whilst the labelling machine transfers the first reel of label stock from the supply spool support to the take up spool support. For example, the controller may be configured to output a signal indicating that the braking assembly requires maintenance if the value indicative of the average output of the armature position sensor (or the average of the feedback signal FB(t)) whilst the labelling machine transfers a subsequent reel of label stock from the supply spool support to the take up spool support differs by more than approximately 20% from the value stored in the memory indicative of the average output of the armature position sensor (or the average of the feedback signal FB(t)) whilst the labelling machine transfers the first reel of label stock from the supply spool support to the take up spool support.

In the embodiment discussed above each valve indicative of the average output of the armature position sensor (or the average of the feedback signal FB(t)) whilst the labelling machine transfers a reel of label stock from the supply spool support to the take up spool support may be determined by the controller as follows. As the labelling machine transfers a reel of label stock from the supply spool support to the take up spool support, the controller may periodically take a number of readings of the output of the armature position sensor (or the average of the feedback signal FB(t)). In order to determine the average, the controller then sums the readings and divides the summed readings by the number of readings.

It will be appreciated that although the braking arrangement described is configured so as to enable a braking force to be applied to the supply spool support, in other embodiments, the same brake assembly may be used in conjunction with the take up spool support, so as to apply a braking force to the take up spool support.

It will also be appreciated that, although a particular brake assembly is described above which utilises a brake belt, brake disc and actuating solenoid, in other embodiments, any appropriate brake assembly may be used providing the brake assembly is capable of selectively applying a braking force to the relevant spool support.

For example, the brake assembly may include a motor that is mechanically linked to the relevant spool support (e.g. the supply spool support) such that the motor rotates with the spool support. In one example the motor may be a DC motor. As is well known, by controlling the amount of current provided to the DC motor, the amount of torque exerted by the DC motor can be controlled. Consequently, by driving the DC motor in a direction such that it opposes the direction of rotation of the spool support, and by controlling the amount of current provided to the DC motor, it is possible to control the amount of torque the DC motor applies to the relevant spool support in order to oppose (or resist) the rotation of the relevant spool support. The torque applied by the motor to oppose the rotation of the relevant spool support may be referred to as a braking torque.

In another example the motor may be a stepper motor. An un-powered stepper motor has a holdback torque, which is a torque of the stepper motor which opposes rotation of the stepper motor. The amount of holdback torque can be changed by changing an electrical resistance that is connected across each of the windings of the stepper motor. For example, such a technique is described in U.S. Pat. No. 5,366,303. The greater the electrical resistance connected across each winding the greater the holdback torque of the stepper motor. Consequently, by controlling the electrical resistance connected across each winding of the stepper motor, it is possible to control the braking torque of the stepper motor.

As previously discussed in relation to FIGS. 2 and 5, the labelling machine includes a moveable element in the form of a dancing arm 28 having a roller 32.

Considering FIGS. 11, 12 and 13 together, the dancing arm 28 also includes a generally annular portion 120 which is mounted for rotation about the axis A and about shaft 122 by bearings 124. The shaft 122 connects the supply spool support 10 to the brake disc 74 such that the supply spool support 10 and the brake disc 74 co-rotate. The supply spool support 10, brake disc 74 and connecting shaft 122 are mounted for rotation relative to the mounting block 80 about axis A by a second set of bearings 126.

As seen best in FIG. 11, an arm 128 projects from the annular portion 120 of the dancing arm 28. A first end 130*a* of a resilient biasing member 130 (which in this case is a tension spring, but may, in other embodiments, be any appropriate resilient biasing member) is attached to the arm 128 via a pin 132. In one embodiment the spring 130 is tension spring number 2137 having a rate of 1.05 N/mm produced by Kato-Entex Ltd, UK. As can be seen best in FIG. 7, a second end 130*b* of the resilient biasing member 130 is fixed via a pin to the mounting block 80. In FIG. 7, the pin used to secure the second end 130*b* of the resilient biasing member 130 to the mounting block 80 has been omitted for clarity. The resilient biasing member 130 biases the dancing arm 28 in the clockwise direction as shown in FIG. 7. This direction is indicated by arrow G.

The labelling machine includes a sensor configured to produce a sensor signal indicative of the position of the moveable element (in this case dancing arm 28). The sensor is configured to produce a sensor signal indicative of the position of the moveable element. In this case the sensor produces a sensor signal indicative of the rotational position of the moveable element. As best seen in FIG. 11 the sensor includes a multipole strip magnet 140 which is attached to a circumferential surface 142 of the annular portion 120 of the dancing arm 28.

FIG. 15 shows a schematic plan view of a portion of the multipole strip magnet 140 which has been removed from the annular portion 120 of the dancing arm 28 and has been laid flat in the plane of the paper. The multipole strip magnet 140 is such that along its length $L_S$ there are alternating regularly spaced north N and south S magnetic pole regions 143. The length of each pole region 143 is $L_P$. In some embodiments the pole length $L_P$ may be 1 mm or 2 mm. The multipole strip magnet 140 may be attached to the circumferential surface 142 of the annular portion 120 using any appropriate method, for example, using adhesive.

The sensor configured to produce a sensor signal indicative of the position of the moveable element also includes a magnetic sensor (not shown) which is mounted to sensor support 144. The magnetic sensor is mounted with sufficient proximity to the multipole strip magnet 140 such that the magnetic sensor can readily sense the magnetic field produced by the multipole magnetic strip 140. The magnetic sensor may be of any appropriate type. For example it has been found that a magnetic sensor which comprises a plurality of Hall Effect sensors (also referred to as Hall elements) is capable of providing approximately 1000 sensor pulses for a full sweep of the dancing arm 28 when using a multipole magnet strip which has a pole length $L_P$ of 2 mm. In this example, the magnetic sensor which comprises a plurality of Hall elements is an AS5304 integrated Hall IC and the magnetic strip is an AS5000-MS20-50 multipole magnetic strip, both produced by ams AG, Austria. A full sweep of the dancing arm 28 is an angular displacement of the dancing arm between the extents of the dancing arm's angular movement.

It will be appreciated that, given the knowledge of the pole length $L_P$ of the multipole strip magnet 140 and also knowing the diameter of the circumferential surface 142 to which the multipole magnetic strip 140 is attached, it is possible to count signal pulses provided by the magnetic sensor as the dancing arm 28 rotates in order to determine angular displacement of the dancing arm 28. Furthermore, if it is known that for a full sweep of the dancing arm 28 a particular number of pulses are generated by the magnetic sensor and further known that a full sweep of the dancing arm 28 represents motion of the dancing arm through an arc of a particular angle (which can be measured based upon physical restrictions on dancing arm movement) it is a straightforward matter to determine the angular displacement from a 'home' position (described below) based upon a number of pulses generated by the magnetic sensor since the dancing arm 28 was in that home position.

FIG. 16 shows a schematic representation of a portion of a labelling machine as shown in the previous figures. It is explained with reference to FIG. 16 how an angular displacement of the dancing arm 28 can be used to calculate a change in the length of the web path 20 between the supply spool support 10 and take up spool support 12.

A portion of the web path 20 is formed by the loop extending between the rollers 22 and 24 via the roller 32. The length L of the portion of the web path 20 extending between the rollers 22 and 24 via the roller 32 can be calculated as a function of the position of the dancing arm 28 (and hence roller 32).

With reference to FIG. 16, the dancing arm 28 has a length r and defines an arc through which roller 32 travels. The length r is the linear distance between the axis of rotation A of the dancing arm 28 and the centre of the roller 32. The dancing arm 28 has a home position, which may be defined as the position in which the line r is coincident with a line $r_h$. During operation it can be determined whether the dancing arm 28 is in the home position by the triggering of a home position sensor (not shown), such as a micro-switch or any other appropriate position sensor.

Once the home position sensor has been triggered, an angular displacement of the dancer arm 28 from the home position can be measured by the sensor (in this case the magnetic sensor), which outputs a sensor signal indicative of the position of the moveable element. This position signal takes the form of a series of pulses indicating an angular displacement of the dancer arm 28 from the home position as described above.

For ease of reference, an angle θ representing the angular displacement of the dancer arm 28 is measured from a horizontal (x) axis, shown in FIG. 16. It can be seen from FIG. 16 that the angle θ can be calculated from an angle $\theta_h$ indicating angular displacement of the dancer arm from the home position, and an angle $\theta_{h'}$ of the home position from a vertical (y) axis by the equation:

$$\theta = \frac{\pi}{2} - \theta_h - \theta_{h'} \tag{1}$$

The axis A of rotation of the dancer arm 28 is used as a reference point for relative measurements, with horizontal (x-axis) and vertical (y-axis) displacements referring to the horizontal and vertical distance from that point.

It will be appreciated that the relative positions of roller 22 and roller 24 to the axis of rotation A of the dancer arm 28 are fixed and as such are known. The position of the roller 22 is defined by coordinates ($x_{r1}$, $y_{r1}$). Similarly, the position of the roller 24 is described by coordinates ($x_{r2}$, $y_{r2}$).

The position of the roller 32 is defined by coordinates ($x_{r3}$, $y_{r3}$), although it will be appreciated that as the roller 32 moves (as the dancing arm 28 moves) the values of these coordinates will not be fixed, and as such, both $x_{r3}$ and $y_{r3}$ are functions of the angle θ and length r and can be calculated as follows:

$$y_{r3} = r \sin \theta \tag{2}$$

$$x_{r3} = \sqrt{r^2 - y_{r3}^2} \tag{3}$$

The distance $p_1$ between the centre of roller 22 and the centre of roller 32, and the distance $p_2$ between the centre of roller 24 and the centre of roller 32, is given by Pythagoras' Theorem from the known positions of each of the rollers according to the following equations:

$$p_1 = \sqrt{(x_{r3} - x_{r1})^2 + (y_{r3} + y_{r1})^2} \tag{4}$$

$$p_2 = \sqrt{(x_{r3} - x_{r2})^2 + (y_{r3} + y_{r2})^2} \tag{5}$$

The line between the centres of rollers 22 and 32 has an angle c from the y-axis, which can be calculated according to following equation:

$$\varepsilon = \tan^{-1}\left(\frac{x_{r3} - x_{r1}}{y_{r3} + y_{r1}}\right) \tag{6}$$

The line between the centres of rollers 24 and 32 has an angle γ from the y-axis, which can be calculated according to the following equation:

$$\gamma = \tan^{-1}\left(\frac{x_{r3} - x_{r2}}{y_{r3} + y_{r2}}\right) \tag{7}$$

The web path 20 will follow a substantially straight line between each of the rollers 22, 24, 32 it contacts. At the point of contact between the web path 20 and each of the rollers 22, 24, 32 (and in particular an outer circumferential surface of each of the rollers 22, 24, 32) the web path 20 is tangential to the respective roller.

The angle between the web path 20 (between rollers 22 and 32) and the line $p_1$ between the centres of the rollers 22 and 32 is a which can be calculated according to the equation:

$$\alpha = \sin^{-1}\left(\frac{\frac{d_{r1}}{2} + \frac{d_{r3}}{2}}{p_1}\right) \tag{8}$$

where $d_{r1}$ is the diameter of roller 22, and $d_{r3}$ is the diameter of roller 32.

The angle between the web path 20 (between rollers 24 and 32) and the line $p_2$ between the centres of the rollers 24 and 32 is β, which can be calculated according to the equation:

$$\beta = \sin^{-1}\left(\frac{\frac{d_{r2}}{2} - \frac{d_{r3}}{2}}{p_2}\right) \tag{9}$$

where $d_{r2}$ is the diameter of roller 24.

The length of the web path 20 between each of the rollers 22, 24 and 32 can now be calculated. The length 1, of the web path 20 between the rollers 22 and 32 can be calculated according to the following equation:

$$l_1 = \sqrt{p_1^2 - \left(\frac{d_{r1}}{2} + \frac{d_{r3}}{2}\right)^2} \tag{10}$$

The length $l_2$ of web path 20 between the rollers 24 and 32 can be calculated according to the following equation:

$$l_2 = \sqrt{p_2^2 - \left(\frac{d_{r2}}{2} - \frac{d_{r3}}{2}\right)^2} \tag{11}$$

In order to calculate the total length L of the web path 20 between the location at which the web path 20 contacts roller 22 and the location at which the web path 20 contacts roller 24, the lengths of the arcs which are made by the web path 20 at the circumference of each of the rollers 22, 24 and 32 where the web path 20 contacts the rollers must be calculated.

As discussed above, at the point of contact with each roller, the web path 20 is tangential to the respective roller. Therefore, because the x-axis and y-axis are orthogonal, an angle between a normal to each respective roller at the point of contact of the web path to the respective roller and the x-axis is the same as the angle between the web path 20 and the y-axis.

The angle between the y-axis and the web path 20 between rollers 22 and 32 is given by $\varepsilon-\alpha$. The angle between the y-axis and the web path 20 between rollers 24 and 32 is given by $\gamma-\beta$.

The length of each arc can be calculated as the product of the radius of the respective roller and the angle subtended by the arc, with each of the arcs calculated as follows:

$$\text{arc}_1 = \left(\frac{\pi}{2} + \alpha - \varepsilon\right) \cdot \frac{d_{r3}}{2} \tag{12}$$

where $\text{arc}_1$ is a length of an arc between a point at which the web makes contact with roller 32 on the left-hand side (with respect to FIG. 16) and the uppermost point on the circumference of roller 32 (again with respect to FIG. 16). $\text{arc}_1$ is illustrated in FIG. 16 by the portion of the circumference of the roller 32 between the dotted line 'a' and the dotted line 'b'.

The angle subtended by the arc in equation (12) is derived as follows. Angles at the rotational axis of roller 32 are considered. The angle subtended between the y-axis and the line $p_1$ between the centres of rollers 22 and 32 is $\varepsilon$. The line $p_1$, web path 20 and dotted line 'a' form a right angled triangle. Within this right angled triangle, the angle subtended between line $p_1$ and the web path 20 is $\alpha$. Consequently, the angle subtended by the line $p_1$ and dotted line 'a' is $\pi/2-\alpha$. Because the angle subtended by the arc in equation (12) is the angle subtended between the y-axis and dotted line 'a', it is given by the sum of $\varepsilon$ and $\pi/2-\alpha$, subtracted from $\pi$. This is equal to $\pi/2+\alpha-\varepsilon$ as included in equation (12).

$$\text{arc}_2 = \left(\frac{\pi}{2} + \gamma - \beta\right) \cdot \frac{d_{r3}}{2} \tag{13}$$

where $\text{arc}_2$ is the length of the arc between the uppermost point on the circumference of roller 32 (with respect to FIG. 16) and the point at which the web makes contact with roller 32 on the right-hand side of roller 32 (again with respect to FIG. 16). $\text{arc}_2$ is illustrated in FIG. 16 by the portion of the circumference of the roller 32 between the dotted line 'b' and the dotted line 'c'. The angle between the horizontal (having regard to the orientation of the figure) and dotted line 'c' is $\gamma-\beta$. Consequently, the angle between dotted line 'b' (i.e. the vertical) and dotted line 'c' is $$\frac{\pi}{2} + \gamma - \beta.$$

$$\text{arc}_3 = \left(\frac{\pi}{2} - \gamma + \beta\right) \cdot \frac{d_{r2}}{2} \tag{14}$$

where $\text{arc}_3$ is the length of the arc between point at which the web makes contact with roller 24 on the right-hand side (with respect to FIG. 16) and the lowermost point on the circumference of roller 24 (again with respect to FIG. 16). $\text{arc}_3$ is illustrated in FIG. 16 by the portion of the circumference of the roller 24 between the dotted line 'd' and the dotted line 'e'. The angle between the horizontal (having regard to the orientation of the figure) and dotted line 'd' is $\gamma-\beta$.

Consequently, the angle between dotted line 'e' (i.e. the vertical) and dotted line 'd' is.

$$\frac{\pi}{2} - \gamma + \beta.$$

$$\text{arc}_4 = \left(\frac{\pi}{2} + \alpha - \varepsilon\right) \cdot \frac{d_{r1}}{2} \tag{15}$$

where $\text{arc}_4$ is the length of the arc between the point at which the web makes contact with roller 22 on the right-hand side (with respect to FIG. 16) and the lowermost point on the circumference of roller 22. $\text{arc}_4$ is illustrated in FIG. 16 by the portion of the circumference of the roller 22 between the dotted line 'f' and the dotted line 'g'. The angle subtended by the arc in equation (15) is derived as follows. Angles at the rotational axis of roller 22 are considered. The angle subtended between the y-axis and the line $p_1$ between the centres of rollers 22 and 32 is $\varepsilon$. The line $p_1$, web path 20 and dotted line 'f' form a right angled triangle. Within this right angled triangle, the angle subtended between line $p_1$ and the web path 20 is $\alpha$. Consequently, the angle subtended by the line $p_1$ and dotted line 'f' is $\pi/2-\alpha$. Because the angle subtended by the arc in equation (15) is the angle subtended between the y-axis and dotted line 'f', it is given by the sum of $\varepsilon$ and $\pi/2-\alpha$, subtracted from $\pi$. This is equal to $\pi/2+\alpha-\varepsilon$.

The total length L of web path 20 between where the web path 20 contacts roller 22 and where the web path 20 contacts roller 24 is calculated as follows:

$$L = l_1 + l_2 + \text{arc}_1 + \text{arc}_2 + \text{arc}_3 + \text{arc}_4 \tag{16}$$

It will be appreciated that while the length L has been calculated between the lowermost point on the circumference of roller 22 (being the point at which the normal to the web path 20 is parallel with the y-axis) and the lowermost point on the circumference of roller 24 (again being the point at which the normal to the web path 20 is parallel with the y-axis), the portion of the web path 20 considered could in fact be any portion which includes the portion of the web path 20 which has a length that varies as a function of the position of the movable element (in this case dancing arm 28) and in such a case it would be apparent to the skilled person, from the foregoing description, how the length of the portion of the web path 20 of interest should be calculated.

Furthermore, in use, the absolute length L may be used as an intermediate value to allow the measurement of a differential length $\Delta L$ which represents the difference in web path length between the dancer arm 28 being in a first position, having web path length $L_{pos1}$ (determined using equation (16) above) and the dancer arm 28 being in a second position, having web path length $L_{pos2}$ (also determined using equation (16) above. The differential length $\Delta L$ can be calculated according to the equation:

$$\Delta L = L_{pos1} - L_{pos2} \tag{17}$$

It will be appreciated that the differential tape path length ΔL can be calculated for a plurality of further dancer arm positions, and that one of the positions may be the home position.

It will be appreciated from the foregoing description that given knowledge of various fixed dimensions (e.g. roller diameters, angular location of the home position relative to the y axis, distances between roller centres etc.) the length of the web path between the roller and roller 24 can the calculated in the manner described.

It will be appreciated that although one particular method of calculating a change in web path length has been described, any appropriate method of calculating a change in web path length may be utilised. For example, in one embodiment, the web path may extend from a first, fixed roller to a second, movable roller and then to a third, fixed roller adjacent to the first roller. The second, movable roller moves in a linear manner relative to the first and third rollers. In this embodiment, movement of the second roller by a distance d along its linear path results in a change in web path length of 2d. Furthermore, although in the described embodiment the sensor which produces a signal indicative of the position of the moveable element (in this case dancing arm 28) is an angular position sensor, any appropriate sensor may be used. For example, at least one ultrasonic or laser distance measurer may be used to measure the position of the moving element.

The controller may be configured to calculate a displacement of the web of the label stock along the web path based upon the sensor signal produced by the sensor which is indicative of the position of the moveable element.

For example, if the supply spool is paying out label stock at a known linear speed along the web path (determined, for example, using one of the techniques described above) for a known time, and during this time the sensor produces a signal which is indicative of a change in position of the moveable element, then the controller may calculate the change in the length of the web path between the take up spool support and supply spool support which has occurred during said time. Consequently, the controller may calculate the displacement of the web along the web path during said time by adding the displacement of the web along the web path due to the supply spool paying out the label stock and the displacement of the web along the web path due to a change in the length of the web path between the take up spool support and the supply spool support.

Similarly, if the take up spool is taking up label stock at a known linear speed along the web path for a known time, and during this time the sensor produces a signal which is indicative of a change in position of the moveable element, then the controller may calculate the change in the length of the web path between the take up spool support and supply spool support which has occurred during said time. Consequently, the controller may calculate the displacement of the web along the web path during said time by adding the displacement of the web along the web path due to the take up spool taking up the label stock and the displacement of the web along the web path due to a change in the length of the web path between the take up spool support and the supply spool support. For any given period of time the sum of the displacement of the web along the web path due to the take up spool taking up the label stock and the displacement of the web along the web path due to a change in the length of the web path between the take up spool support and the supply spool support is equivalent to the length of label stock removed from supply spool in said given period of time.

As previously discussed, if the displacement of the web along the web path on to a take up spool or off a supply spool is known in combination with the amount of rotation of the take up spool or supply spool whilst said known displacement of the web has occurred, then it is possible to calculate the diameter of said take up spool or supply spool in accordance with equation 18.

$$D_S = \frac{L_{WP}}{n\pi} \tag{18}$$

where $D_S$ is the spool diameter, $L_{WP}$ is the displacement of the web along the web path (determined, for example, by monitoring of the periodic signal 56 output from the electromagnetic radiation sensor 52, or by using an encoder monitoring the rotation of a roller, for example a print roller) and n is the number of rotations of the spool support during the displacement of the web along the web path.

The controller may be configured to calculate the diameter of one of the spools in this manner based upon calculated displacement of the web along the web path (which is in turn based upon the sensor signal which is indicative of the position of the moveable element) and a rotation signal produced by a rotation monitor. The rotation monitor may include a sensor which produces pulses indicative of a given degree of rotation which can be counted, or, alternatively, the rotation monitor may count step pulses which are provided to a position controlled motor, such as a stepper motor.

An example of a suitable rotation monitor is a tachometer mounted to one of the spool supports. A further example of an appropriate rotation monitor is a trigger device which produces a signal every time the spool (and hence the spool support supporting the spool) rotates through a given portion of a complete rotation.

For example, a trigger device may include a reed sensor and at least one magnet, or a Hall Effect sensor and at least one magnet. In one embodiment, a pair of magnets are attached to a spool support such that they are angularly spaced about the axis of rotation of the spool support by 180 degrees. The Hall Effect sensor is located at a portion of the labelling machine which does not rotate with the spool support and such that for every full rotation of the spool support in a given direction, both of the two magnets pass the Hall Effect sensor and hence the Hall Effect sensor outputs two pulses for every full rotation of the spool support in a given direction.

A labelling machine of the type described herein may include a brake assembly (for example, but not limited to, that previously described). In this embodiment the controller is configured to calculate the diameter of the spool mounted to one of the spool supports based upon the sensor signal indicative of the position of the moveable element and the rotation signal indicative of the rotation of the spool the diameter of which is to be measured. In addition, in this embodiment, the brake assembly is configured to apply a braking force to the other one of said spool supports (i.e. the spool support other than that supporting the spool whose diameter it is desired to calculate).

In this embodiment, the controller is configured to calculate the diameter of said spool supported by said one of said spool supports based upon the sensor signal which indicates movement of the dancing arm 28 when the brake assembly applies a braking force to the other of said spool supports which is sufficient to substantially prevent rotation of the other of said spool supports. This is now described in more detail.

Referring back to FIG. 2 for ease of reference, in this embodiment, the brake assembly (not shown in FIG. 2) applies a braking force to the supply spool support 10 which is sufficient to substantially prevent rotation of the supply spool support 10 and supported supply spool 16. Whilst the brake assembly substantially prevents rotation of the supply spool support 10 and supported spool 16, the controller controls the motor 14, which in this case is a stepper motor, so as to rotate the motor 14 a predetermined number of steps. Rotating the motor 14 a predetermined number of steps is equivalent to rotating the take up spool support 12 and supported spool 34 by a predetermined angle. This is due to the fact that, as noted above, the motor 14 rotates a known number of steps for a single complete rotation and also due to the fact that the nature of any gearing between the motor 14 and the take up spool support 12 is known.

In this case, the take up spool support 12 is rotated in a direction such as to wrap web of the label stock 18 on to the take up spool support 12 such that the web of the label stock travels along the web path in the direction C. It will be appreciated that, in other embodiments, the motor 14 and hence take up spool support 12 may be rotated in the opposite direction.

Rotation of the take up spool support 12 such that the web of the label stock 18 travels along the web path 20 in the direction C whilst a supply spool support 10 (and hence supported supply spool 16) are substantially prevented from rotating will cause tension in the web to increase. The increase in tension in the web will cause the dancing arm to move against the biasing force provided by the spring 130 (not shown in FIG. 2, but shown in FIG. 7, which biases the dancing arm in an anti-clockwise direction) in a clockwise direction so as to reduce the length of the web path 20 between the supply spool support 10 and take up spool support 12.

The clockwise movement of the dancing arm 28 whilst the motor 14 is driven a predetermined number of steps will be sensed by the sensor configured to produce a sensor signal indicative of the position of the moveable element (in this case the magnetic sensor). In accordance with the equations set out above, the controller calculates the change in the length (equation (17)) of the web path 20 between the supply spool support 10 and take up spool support 12 during the time the motor 14 is driven based upon the change of position of the dancing arm 28.

Due to the fact that the supply spool support (and hence supported supply spool 16) is prevented from rotating during this procedure, any change in the length of the web path 20 between the supply spool support 10 and take up spool support 12 will have been caused by that amount of web being wound on to the take up spool 34 supported by the take up spool support 12.

The controller can calculate the number of rotations of the take up spool support 12 (and hence supported take up spool 34) which have occurred due to the controller rotating the motor 14 a predetermined number of steps. The controller can also calculate the change in the length of the web path 20 between the supply spool support 10 and take up spool support 12 based upon the change in position of the dancing arm 28. Finally, the controller can calculate the diameter of the take up spool 34 supported by the take up spool support 12 in accordance with equation (18) above.

The apparatus and method used to calculate the diameter of one of the spools above may be utilised when the machine is started up (to thereby provide an initial measurement of spool diameter) and/or may be used periodically as the labelling machine is operating so as to periodically measure and update the diameter of the relevant spool. For example, the brake may be applied whilst the take up spool support is being rotated during labelling, the rotation of the take up spool causing movement of the dancing arm and thereby allowing determination of the take up spool diameter during labelling.

In one embodiment of the method described above, before carrying out the processing set out above, the controller is arranged to release the brake completely such that the dancing arm 28 assumes its home position (given action of the spring 130). This provides a known starting point for measurement of the angular displacement of the dancing arm 28 using the methods described above.

It will be appreciated that the sensor configured to produce a sensor signal indicative of the position of the moveable element of the labelling machine previously described is a sensor which measures relative displacement (in this case angular displacement) and uses this in combination with a known position (in this case the home position) in order to determine an absolute position (in this case angular position). In some embodiments the sensor configured to produce a sensor signal indicative of the position of the moveable element may be any appropriate sensor which measures relative displacement and uses this in combination with a known position in order to determine absolute position. In other embodiments the sensor configured to produce a sensor signal indicative of the position of the moveable element may only measure relative displacement. In further embodiments the sensor configured to produce a sensor signal indicative of the position of the moveable element may measure absolute position directly.

Some known labelling machines include a dancing arm which is mechanically linked to a brake assembly. In one example of these known labelling machines, if the tension within the label stock is too great then the tension in the label stock will cause the dancing arm to move so that a brake which forms part of the brake assembly and which is mechanically linked to the dancing arm is released to thereby reduce braking force acting on the supply spool support and thereby reduce the tension in the label stock. Conversely, if the tension in the label stock is too little, the tension in the label stock will cause the dancing arm to move such that the brake applies an increased braking force to the supply spool support to thereby increase tension in the label stock.

These known labelling machines suffer from several problems. First, the system can oscillate such that the dancing arm oscillates between two positions whilst trying to maintain tension in the label stock. This can be problematic due to the fact that the oscillating nature of the system may cause the label stock to become misaligned on the rollers which define the web path and hence become misaligned when it reaches the labelling peel beak. This may lead to incorrect positioning of labels on to a product or may lead to the labelling machine becoming jammed. Secondly, the oscillating nature of the dancing arm means that the movement of the dancing arm is not entirely predictable. As such, there is the possibility that the dancing arm will collide with other parts of the labelling machine or may present a hazard to a user operating the labelling machine. The labelling machine according to some of the embodiments described herein provides a way of obviating or mitigating at least one of these problems.

The dancing arm position is indicative of the tension within the label stock due to the fact that the dancing arm is mounted for rotation about axis A and is biased in the direction G by the spring 130. It will be appreciated that direction G in FIG. 2 is opposite to direction G in FIG. 7 because FIGS. 2 and 7 show opposite sides of the labelling machine, and in particular of the supply spool support and attached brake disc. Due to the fact that the spring 130 is a variable force spring (i.e. a spring which generally obeys Hooke's Law), the force exerted by the spring will vary with the position of the dancing arm 28 (and hence the amount of extension of the spring). In particular, the greater the extension of the spring i.e. the further the dancing arm 28 is rotated about axis A in the direction opposite to that indicated by G the greater the force exerted by the spring (in order to urge the dancing arm 28 in the direction G) will be. A component of the force applied by a spring 130 to the dancing arm will, in use, be applied to the label stock 20, thereby providing a tension within the label stock 20. Consequently, some embodiments described herein allow the dancing arm 28 to be maintained in a substantially constant position to thereby maintain tension in the label stock 18 substantially constant. For example, in some embodiments, the dancing arm may be maintained in a position such that if the labelling machine is orientated as shown in FIG. 2 the dancing arm 28 is substantially horizontal.

In order to control the position of the dancing arm 28, an embodiment of the present invention is provided with a sensor configured to produce a sensor signal indicative of the position of the dancing arm 28. In this case the sensor is the magnetic sensor previously discussed which measures the change in magnetic field caused by the movement of the multipole strip magnet which is affixed to a portion of the dancing arm 28.

It will be appreciated that, although the moving element of this embodiment is a dancing arm, it is within the scope of the invention for the moveable element to be any appropriate moveable element which can define a portion of the web path. Furthermore, it will also be appreciated that although the sensor of this embodiment is the magnetic sensor as described, any appropriate sensor which is configured to produce a sensor signal indicative of the position of the moveable element may be used.

The present embodiment of the invention also includes a brake assembly configured to apply a variable braking force to one of said spool supports (in this case the supply spool support, however, in other embodiments, it may be the take up spool). The brake assembly may apply the variable braking force based upon the sensor signal indicative of the position of the moveable element. It will be apparent that the braking force applied to the supply spool support will resist rotation of the supply spool support (and hence of the supply spool supported by the supply spool support).

This arrangement has the advantage that, unlike the known labelling machines in which the dancing arm is mechanically linked to a brake of a brake assembly, the position of the dancing arm 28 is mechanically decoupled from the braking force which is applied to the supply spool by the brake assembly. By mechanically decoupling the brake assembly from the dancing arm it is possible for processing to be performed on the sensor signal indicating dancing arm position so as to calculate what braking force should be applied to the supply spool support by the brake assembly.

In one embodiment, the brake assembly previously discussed which utilises a controlled solenoid to provide a variable braking force via a brake belt acting on a brake disc may be used. In this situation, the braking force applied to the supply spool support 10 via the brake belt 76 and brake disc 74 depends upon the position of the armature 92 of the solenoid 94.

The control scheme used in order to control the current supplied to the coil of the solenoid in order to position the armature of the solenoid at a desired location relative to the coil has already been discussed and so will not be repeated here. However, that control scheme requires that the control algorithm as shown schematically in FIG. 14 is provided with a set point signal SP(t). The set point signal SP(t) is determined by a second control algorithm which will be referred to as the dancing arm position control algorithm.

The dancing arm position control algorithm is implemented by a controller (which may or may not be the same controller as previously discussed controllers).

A schematic view of a known dancing arm position control system which includes a known dancing arm position control algorithm implemented by the controller is shown schematically in FIG. 17.

The controller is provided with a dancing arm position set point signal SP2(*t*) which is indicative of the desired position of the dancing arm (and hence the desired tension within the label stock) at any given time. For example, in some embodiments the dancing arm position set point signal SP2(*t*) may correspond to a position of the dancing arm such that if the labelling machine is the same as that in FIG. 2, the dancing arm may be substantially horizontal. Of course, in other embodiments the dancing arm position set point signal SP2(*t*) may correspond to any desired dancing arm position. The dancing arm position set point signal SP2(*t*) is provided to one input of a subtractor 200. Another input of the subtractor 200 is supplied with a feedback signal FB2(*t*) (described below) and the subtractor 200 outputs an error signal E2(*t*) which is the difference between the dancing arm position set point signal SP2(*t*) and the feedback signal FB2(*t*).

The error signal E2(*t*) is supplied to three portions of the PID algorithm. These are the proportional component P, the integral component I, and the derivative component D. As can be seen from the figure, the proportional component P outputs a signal which is given by a constant $K_{P2}$ multiplied by the error signal E2(*t*). The integral component I outputs a signal which is a constant $K_{I2}$ multiplied by the integral of the error signal E2(*t*). The derivative component D of the algorithm outputs a signal which is given by a constant $K_{D2}$ multiplied by a derivative of the error signal E2(*t*) with respect to time.

An adder 202 combines the signals output by the proportional P, integral I and derivative D components of the algorithm. The output of the adder 202 is a signal which is indicative of the desired position of the solenoid armature relative to the coil in order to produce a desired braking force which acts on the supply spool support. Consequently, the output of the adder 202 may be referred to as the set point signal SP(t) which forms part of the solenoid armature position control scheme described earlier. Consequently, the signal SP(t) output by the adder 202 is provided to a solenoid armature position control scheme 204 which was described above with reference to FIG. 14.

By controlling the braking force which is applied by the brake assembly to the supply spool support, as previously discussed, this will affect the tension within the label stock and consequently affect the position of the dancing arm 28.

The position of the dancing arm 28 is measured by the magnetic sensor 206 which has previously been described.

The magnetic sensor 206 outputs a sensor signal indicative of the position of the dancing arm. This signal constitutes the feedback signal FB2(*t*) which is provided to the first subtractor 200. It is preferred that the value of the signal FB2(*t*) should increase as output of the adder 202 (i.e. the control signal to the brake assembly via the solenoid armature position control scheme) is increased. If this is not the case then the same functionality may be achieved by swapping over the inputs to the subtractor 200.

Any appropriate gain constants $K_{P2}$, $K_{I2}$ and $K_{D2}$ may be used. In some embodiments, at least one of these constants may be equal to zero. However, in a preferred embodiment, all of these constants are non-zero.

As is common in the art, the gain constants $K_{P2}$, $K_{I2}$ and $K_{D2}$ of the dancing arm position control algorithm and the gain constants $K_P$, $K_I$ and $K_D$ of the solenoid armature position control algorithm may be determined empirically or by using commercially available PID tuning software. In either case, it is desirable that the value of the gain constants $K_{P2}$, $K_{I2}$ and $K_{D2}$ of the dancing arm position control algorithm are chosen such that the signal SP(t) output by the dancing arm position control algorithm to the solenoid armature position control algorithm has values which are substantially between the minimum braking value and the maximum braking value.

In some embodiments, the PID control algorithm may incorporate a dead band. In such embodiments, the error signal E2(*t*) is set to zero if the feedback signal FB2(*t*) is within a given range of the set point signal SP2(*t*). For example, the dead band may operate such that if the difference between the set point signal SP2(*t*) and the feedback signal FB2(*t*) is less than ±5% of the set point signal SP2(*t*) (or of the maximum possible value of the set point signal, which corresponds to a desired maximum braking value or a desired minimum braking value of the set point signal) then the error signal E2(*t*) is set to zero. If the feedback signal FB2(*t*) falls outside of this range then the error signal E2(*t*) is calculated in the manner already described by the subtractor 200.

As previously discussed, other embodiments incorporating a dead band may function in a slightly different manner. These embodiments operate in the same manner as the dead band previously described except that if the feedback signal FB2(*t*) falls outside of dead band then the error signal E2(*t*) is calculated by calculating the difference between the feedback signal FB2(*t*) and the edge of the dead band which is closest to the feedback signal FB2(*t*). For example, if the dead band is ±5% of the set point signal SP2(*t*), and the feedback signal FB2(*t*) has a value of the set point signal SP2(*t*) plus 5% of the set point signal SP2(*t*) plus μ, then the value of the error signal is −μ. Likewise, if the dead band is ±5% of the set point signal SP2(*t*), and the feedback signal FB2(*t*) has a value of the set point signal SP2(*t*) minus 5% of the set point signal SP2(*t*) and minus μ, then the value of the error signal is μ. In another embodiment, if the dead band is ±5% of the maximum possible set point (which corresponds to a desired maximum braking value or a desired minimum braking value of the set point signal), and the feedback signal FB2(*t*) has a value of the set point signal SP2(*t*) plus 5% of the set point signal SP2(*t*) plus μ, then the value of the error signal is −μ. Likewise, if the dead band is ±5% of the maximum possible set point signal SP2(*t*), and the feedback signal FB2(*t*) has a value of the set point signal SP2(*t*) minus 5% of the set point signal SP2(*t*) and minus μ, then the value of the error signal is μ.

In some embodiments, the derivative term D within the PID algorithm may be calculated not as a function of the derivative of the error signal E2(*t*), but rather by multiplying a speed of the dancing arm by a constant $K_{s2}$. The speed of the dancing arm may be calculated based upon the rate of change of the magnetic field detected by the magnetic sensor as the multipole magnetic strip attached to a portion of the dancing arm moves past the magnetic sensor. Alternatively, the speed of the dancing arm may be calculated based upon the rate of change of the signal output by the magnetic sensor.

In some embodiments, the dancing arm position control algorithm may be implemented such that if the measured dancing arm position differs from the desired dancing arm position set point in a direction such that the brake must be applied in order to bring the dancing arm position towards the set point, the algorithm may provide an output to the braking assembly which causes the braking assembly to apply the maximum braking force, the braking assembly only applying less than the maximum braking force when the measured dancing arm position differs from the desired dancing arm position set point in a direction opposite to that in which the brake must be applied in order to bring the dancing arm position towards the set point. When the measured dancing arm position differs from the desired dancing arm position set point in a direction opposite to that in which the brake must be applied in order to bring the dancing arm position towards the set point a PID algorithm as discussed above may be implemented in the usual way—in other words, a non-symmetric PID algorithm may be used.

In some embodiments, the integral term of the PID algorithm may have a relatively small constant $K_{I2}$ or the set point for the integral term may be different to the set point for the proportional and differential terms. This may be useful in control systems which include an integral term because the integral portion of the PID algorithm 'remembers' previous positions of the dancing arm and hence attempts to apply an incorrect correction to that which is required. For example, the correction determined by the integral term may be greater than required, less than required or in the wrong direction. This problem may occur when a labelling machine is in a first steady state (for example, continual dispensing of labels at a first rate) and then changes to a second steady state (for example, continual dispensing of labels at a second rate). It may take time for the integral term to change its output from the ideal value for the first state, to the ideal value for the second state. In such a situation the integral term may be incorrect for a period of time after the operation of the labelling machine changes to the second state.

In order to mitigate the problem described above, in some embodiments, the set point for the integral component of the PID algorithm may be equivalent to a dancing arm position which, if the labelling machine is orientated as shown in FIG. 2, is about 5 degrees clockwise from the set point position for the proportional and differential terms. Furthermore, in some embodiments, a limit to the degree of effect which the integral term may contribute to the overall amount of correction may be applied. For example, the contribution of the integral term to the applied braking may be limited. In one example, if the braking force is provided by a braking assembly including a stepper motor as shown in FIGS. 18 to 20, the contribution of the integral term of the PID sum may be limited to an equivalent of 50 microsteps of the stepper motor.

In the above described embodiment the controller implements the dancing arm position control algorithm such that the controller evaluates and applies the PID algorithm 1000 times per second. In other embodiments the controller may evaluate and control the dancing arm position at any appropriate rate.

It will be appreciated that although within the presently described embodiment the dancing arm position control scheme includes a PID algorithm, other embodiments of the invention may use any appropriate control scheme so as to control the position of the dancing arm (or other suitable moving element).

Some embodiments the labelling machine may include a motive device which is configured to propel the web along the web path from the supply spool towards the take up spool. For example, the motive device may include a single motor which drives the take up spool support, motors which drive each of the take up spool support and supply spool support, or a motor driving a platen roller in combination with a motor driving at least one of the take up spool support and supply spool support. The controller may be configured to control both the motive device and the brake assembly based upon the sensor signal (in this case the signal output by the magnetic sensor) so as to urge the dancing arm towards a desired position. Urging the dancing arm towards a desired position is equivalent to attempting to obtain a desired tension in the label stock, for the reasons previously discussed. Consequently, the controller enables control of the motive device and the brake assembly based upon the sensor signal so as to obtain a desired tension in the label stock and maintain said tension in the label stock between predetermined limits.

The brake assembly 70 within the described embodiments is said to be capable of applying a variable braking force. This is because, the position of the armature of the solenoid determines the extension of the spring 82 and therefore the braking force applied to the spool support. The armature is controlled so that it can take any position between the extents of movement of the armature.

In other embodiments, the brake assembly need not be capable of applying a variable braking force. For example, in some embodiments the brake assembly may only have two states: a braked state and an un-braked state. In the braked state the brake assembly applies a greater braking force to the spool support than in the un-braked state. In one embodiment, the brake assembly may be controlled by the controller as a function of the sensor signal indicative of the position of the movable element (e.g. dancing arm) such that when the controller determines that the sensor signal indicative of the position of the movable element indicates that more braking force applied to the spool support is required, then the controller commands the brake assembly to enter its braked state. Conversely, the brake assembly may be controlled by the controller as a function of the sensor signal indicative of the position of the movable element (e.g. dancing arm) such that when the controller determines that the sensor signal indicative of the position of the movable element indicates that less braking force applied to the spool support is required, then the controller commands the brake assembly to enter its un-braked state.

In another embodiment in which the brake assembly has only braked and un-braked states, the brake assembly (in particular, in this case, the coil of the solenoid of the brake assembly) may be provided with a pulse width modulated signal (in this case a voltage signal across the coil of the solenoid). A coil driver which is controlled by the controller may control the duty cycle of the pulse width modulated voltage signal applied across the coil as a function of the sensor signal provided to the controller which is indicative of the position of the movable element.

By varying the duty cycle of the pulse width modulated voltage applied across the coil of the solenoid, the current supplied to the coil can be changed. This results in a change in the position of the armature of the solenoid relative to the coil and hence a change in the braking force applied by the brake assembly to the spool.

The desired tension within the label stock (and hence the desired position of the dancing arm) may be dependent on various factors. For example the desired tension may be greater than the minimum tension required to keep the label stock taut enough as it passes a print head so that the printer can successfully print on the labels of the label stock. In addition, the desired tension may be dependent on the width and/or thickness of the web of the label stock (i.e. perpendicular to the web path). The desired tension may be chosen such that the stress within the web of the label stock (which is given by the tension in the web divided by the cross sectional area of the web; where the cross sectional area of the web is the product of the width of the web and the thickness of the web) is less than the breaking stress of the web. This ensures the tension in the web does not lead to the web of the label stock snapping. For example, in some embodiments, the desired tension in the web may be between 1N and 50N.

In some labelling machines the desired tension of the label stock is determined (e.g. calculated) by a controller based upon the width of the label stock and is subsequently set. In some labelling machines the width of the label stock is input into the controller of the labelling machine by a user. In some applications, reliance on a user inputting the width of the label stock may lead to problems. For example, if the width of the label stock is inputted incorrectly, then the labelling machine may incorrectly determine and set tension within the label stock. Incorrect label stock tension may lead to the label stock breaking or to the label stock being fed incorrectly by the labelling machine.

Although the above described embodiment discusses urging the moveable element (e.g. dancing arm) towards a desired position (for example, by setting a desired dancing arm position set point within the dancing arm position control algorithm) in order to control the tension of the label stock. In other embodiments the movable element may be urged towards a desired position for any other appropriate purpose.

For example, in some embodiments the movable element may be biased by a constant force spring (i.e. such that the spring does not obey Hooke's Law). In such embodiments, because the force applied to the movable element by the spring is substantially constant regardless of the position of the movable element, the tension of the label stock will be substantially constant regardless of the position of the movable element. It follows that, in such embodiments, moving the movable element will not change the tension in the label stock and hence urging the movable element towards a desired position cannot be used to set tension in the label stock.

Regardless of what type of biasing member biases the movable element, because the movable element defines a portion of the web path, movement of the movable element will cause the path length of the web path between the supply and take-up spools to change. Changing the path length of the web path between the supply spool and take-up spool may allow differences between the speed at which the take up spool is taking up label stock and the speed at which the supply spool is paying out label stock to be accommodated. For example, if the take up spool support is driven to advance label stock along the web path and the take up spool support is accelerated, the take up spool may accelerate more quickly than the supply spool. This may be because the supply spool has a relatively large moment of inertia. This difference in acceleration between the take up spool and supply spool may be compensated for by the dancing arm moving so as to reduce the path length of the web path between the supply spool and take-up spool. Conversely, if the take up spool support is driven to advance label stock along the web path and the take up spool support is decelerated, the take up spool may decelerate more quickly than the supply spool. Again, this may be because the supply spool has a relatively large moment of inertia. This difference in deceleration between the take up spool and supply spool may be compensated for by the dancing arm moving so as to increase the path length of the web path between the supply spool and take-up spool.

If the movable element has a limited extent of movement, between a first extent at which the path length of the web path between the supply and take up spools is a maximum, and a second extent at which the path length of the web path between the supply and take up spools is a minimum, it may be desirable to urge the movable element towards a position which minimises the likelihood that the movable element will reach the limits of its extent of movement in trying to compensate for differences between the speed at which the take up spool is taking up label stock and the speed at which the supply spool is paying out label stock during operation of the labelling machine. If the movable element reaches a limit of its extent of movement then it will be unable to compensate for any further difference between the speed at which the take up spool is taking up label stock and the speed at which the supply spool is paying out label stock. The inability to compensate for any further difference between the speed at which the take up spool is taking up label stock and the speed at which the supply spool is paying out label stock may result in excess tension in the label stock (which may result in breakage of the label stock) or may result in too little tension in the label stock (which may result in the label stock becoming slack).

In some embodiments the position which minimises the likelihood that the movable element will reach the limits of its extent of movement may be a position which is substantially equidistant between the limits of its extent of movement. In other embodiments, the characteristics of the labelling machine may be such that the position which minimises the likelihood that the movable element will reach the limits of its extent of movement may be a position which is closer to one of the limits of its extent of movement than the other. For example, in a labelling machine in which the take up spool support is driven to advance label stock along the web path and in which the supply spool can be braked, the position which minimises the likelihood that the movable element will reach the limits of its extent of movement may be closer to the limit of the extent of the movement of the movable element which corresponds to the maximum path length of the web path between the supply and take-up spools. The reason for this is that a brake on the supply spool support makes it a lot less likely that there will be a difference between the speed at which the take up spool is taking up label stock and the speed at which the supply spool is paying out label stock when the take-up and supply spools are decelerating. As such, the movable element is less likely to have to move in a direction towards the limit of the extent of movement of the movable element which corresponds to the maximum path length of the web path between the take-up and supply spools. It follows that the position which minimises the likelihood that the movable element will reach the limits of its extent of movement may be closer to the extent of the movement of the movable element which corresponds to the maximum path length of the web path between the supply and take-up spools.

A schematic view of a control system according to the present invention which includes a supply speed control algorithm implemented by the controller according to the present invention is shown schematically in FIG. 17*a*.

Whereas the previously described known dancing arm position control algorithm aims to generally locate the dancing arm at a desired position (or within a desired range of positions), the supply speed control algorithm according to the present invention, which is implemented by the controller, operates in a different manner. In general terms, the supply speed control algorithm of the present invention attempts to both locate the dancing arm at a position which ensures that the tension within the label stock (also referred to as label web) is greater than a predetermined minimum tension, and simultaneously seeks to maintain the speed at which label stock is removed from the supply spool (by the action of the motor driving the take up spool) generally constant. The reasons for this are set out below.

As previously discussed, the maintenance of the correct tension within the label stock may be important to the operation of a labelling machine. For example, it may be desirable for the tension in the label stock to be above a minimum tension value such that if labels are removed from the label stock using a peel beak, the peel beak can effectively remove the labels; and if the labelling machine is a print and apply labelling machine, such that the quality of the print carried out by the printer onto the labels of the label stock is satisfactory. By attempting to maintain the speed at which label stock is removed from the supply spool substantially constant, this ensures that the speed of rotation of the supply spool is generally constant. This may reduce mechanical stress and strain experienced by parts of the labelling machine. That is to say, because the supply spool rotates at a substantially constant speed, rapid acceleration and/or deceleration of the supply spool is ideally avoided. Such repeated rapid accelerations and/or decelerations require portions of the labelling machine to either exert a torque/force on the supply spool and/or to accommodate such forces when they are exerted. Such torque/forces may lead to wear of components of the labelling machine. Consequently, maintaining the speed of the supply spool generally constant may improve the longevity and/or reliability of the labelling machine.

Furthermore, some known labelling machines are controlled in a manner which results in the speed of the supply spool rapidly fluctuating. Such fluctuations, whilst not necessarily detrimental to the labelling machine other than with regards to wear (as discussed above), may make the operation of the labelling machine look ungainly. By maintaining the speed of the supply spool substantially constant, this may make the operation of the labelling machine appear smoother and better controlled, thereby providing an aesthetic improvement which enhances the user experience.

Whereas the previously described known dancing arm control algorithm utilised the error between desired dancing arm position and measured dancing arm position in order to determine the set point SP(t) provided to the solenoid armature position control scheme 204, the supply speed control algorithm of the present invention (as shown in FIG. 17*a*) utilises the difference between a target supply spool speed and a measured supply spool speed so as to determine set point provided to the brake control apparatus.

In more detail, a schematic view of the supply speed control system which includes the supply speed control algorithm implemented by a controller according to the present invention is shown in FIG. 17*a*. The controller which implements the supply speed control algorithm may or may not be the same controller as any controller previously discussed within this document.

The controller is provided with a supply speed set point signal SP3(*t*) which is indicative of a target supply spool speed at any given time. The supply speed set point signal SP3(*t*) is provided to one input of a subtractor 172. Another input of the subtractor 172 is supplied with a feedback signal FB3(*t*) (described below) and the subtractor 172 outputs an error signal E3(*t*) which is the difference between the supply speed set point signal SP3(*t*) and the feedback signal FB3(*t*). The error signal E3(*t*) is supplied to three portions of a PID algorithm. These are the proportional component P, the integral component I, and the derivative component D. As can be seen from the Figure, the proportional component outputs a signal which is given by a constant $K_{P3}$ multiplied by the error signal E3(*t*). The integral component I outputs a signal which is given by a constant $K_{I3}$ multiplied by the integral of the error signal E3(*t*). The derivative component D outputs a signal which is given by a constant $K_{D3}$ multiplied by a derivative of the error signal E3(*t*) with respect to time.

An adder 174 combines the signals output by the proportional P, integral I and derivative D components of the algorithm. The output of the adder 174 is a signal which is indicative of the desired position of the solenoid armature relative to the coil (or, alternatively, the desired configuration of any other braking assembly, for example, the desired position of the stepper motor and attached cam piece—see below) in order to produce a desired braking force which acts on the supply spool support. Consequently, the output of the adder 174 may be referred to as the set point signal SP(t), which forms part of the solenoid armature position control scheme 204 which was described above with reference to FIG. 14 (or which may be provided to a portion of any other appropriate type of braking assembly, for example the position controlled motor controller of a braking assembly including a position controlled motor—again as discussed below).

By controlling the braking force which is applied to the brake assembly to the supply spool support, as previously discussed, this will not only affect the tension within the label stock and the position of the dancing arm 28, but will also directly affect the speed of rotation of the supply spool support (and consequently the linear speed of the label web which is being pulled off the supply spool support by the take up motor).

The speed at which label stock is removed from the supply spool may be defined in any appropriate way. For example, the speed may be a rotation speed of the supply spool. In the present embodiment, the speed at which label stock is removed from the supply spool is defined as the linear speed of the label stock along the web path as it is pulled from the supply spool.

The speed at which the label stock is removed from the supply spool within the presently described embodiment may be measured in any appropriate way.

In some embodiments the motive device which drives the label stock along the web path is a motor which drives the take up spool for rotation. In such embodiments the speed of rotation of the take up spool will be known by the controller (because the controller controls the take up motor to drive the take up spool at the desired speed). In an example where the take up spool is driven by a stepper motor, the speed of rotation of the take up spool may be deduced by the controller based on the rate of steps that the take up motor executes. Provided the number of steps per revolution of the take up motor is known, then it is straightforward to calculate the angular speed of rotation of the take up motor by dividing the step rate of the take up motor by the number of steps for a revolution of the take up motor and (if the angular speed is measured in radians) multiplying this quantity by $2\pi$. The controller may then multiply the angular rate of rotation of the take up spool by the diameter of the take up spool so as to determine the linear rate at which label stock is taken onto the take up spool. The diameter of the take up spool may be determined in any appropriate manner including any of those discussed within this document.

Alternatively, the linear speed at which label stock is taken up onto the take up spool may be measured by a roller and associated encoder which contacts the label stock. In embodiments which include a moveable element such as a dancing arm, the roller may contact the label stock at a position downstream of the point along the web path which is defined by the roller of the movable element. In embodiments of labelling machine which are print and apply labelling machines the roller and associated encoder used to measure the linear speed at which label stock is taken up onto the take up spool may be the print roller.

As previously discussed in relation to FIG. 16, the controller is also capable of determining any change in web path length between the supply spool and the take up spool as a function of movement of the dancing arm 28 (see in particular differential length $\Delta L$ as defined in equation 17). The controller may be configured to calculate the rate of change of the differential length $\Delta L$. The rate of change of the differential length $\Delta L$ may be thought of as the speed at which the dancing arm 28 adds (or subtracts) additional length to the path length between the supply spool and take up spool. If the take up spool is winding label stock onto the take up spool at a given linear speed, then, because the dancing arm changes the path length (and hence length of label stock) between the take up spool and the supply spool, the speed at which the path length changes as a result of the movement of the dancer arm will affect the linear speed at which label stock is removed from the supply spool.

In particular, if the differential length $\Delta L$ as defined in equation 17 is positive, then the path length between the take up spool and supply spool has reduced between the first position and the second position. Conversely, if the differential length $\Delta L$ as defined in equation 17 is negative, then the path length between the take up spool and supply spool has increased between the first position and the second position. It follows that if the rate of change of the differential length $\Delta L$ is positive, then this represents decreasing path length and if the rate of change of the differential length $\Delta L$ is negative, then this represents an increase in the path length between the take up spool and supply spool. It follows that in order to determine the linear speed at which label stock is removed from the supply spool, the rate of change of the differential length $\Delta L$ is subtracted from the linear speed at which label stock is wound onto the take up spool.

It will be appreciated that, although within the described embodiment, the linear speed at which label stock is removed from the supply spool is determined by subtracting the rate of change of the differential web path length caused by movement of the dancing arm from the linear speed at which label stock is wound onto the take up spool, in other embodiments the linear speed at which label stock is removed from the supply spool may be determined in any appropriate way. For example, the linear speed at which the label stock is wound onto the take up spool may be determined using a combination of any appropriate method for determining the speed of rotation of the supply spool and any appropriate method for determining the radius of the supply spool. Alternatively, a roller which contacts the label stock and an associated encoder may be used. In embodiments which include movable element (e.g. dancing arm) the roller may contact the label stock at a position upstream of the movable element.

As previously discussed in relation to FIG. 17*a*, the controller is configured to apply the supply speed control algorithm so as to control the brake assembly based upon a sensor signal which is indicative of a speed at which label stock is removed from the supply spool so as to cause the speed at which the label stock is removed from the supply spool by the motive device (motor driving take up spool) to tend towards or achieve a target supply spool speed indicated by the target supply spool speed set point signal SP3(*t*).

The target supply spool speed (and hence supply spool speed set point signal SP3(*t*)) may be chosen to have any appropriate value. For example, in the case when the labelling machine is operated in a continuous mode of operation (in which label stock is accelerated from rest to a labelling speed, the label stock moves at the labelling speed for a period of time, and then the label stock is decelerated to rest), the target supply spool speed during a labelling operation may be set to be substantially equal to the average speed of the label stock along the web path during the complete labelling operation. In some embodiments the target supply spool speed during a labelling operation may be set to be substantially equal to a determined average speed of the label stock during the labelling operation for only the portion of the labelling operation which has already been completed. Alternatively, the target supply spool speed during a labelling operation may be set to be substantially equal to a measured average speed of the label stock along the web path during a previous labelling operation. Alternatively, the target supply speed during a labelling operation may be set to be substantially equal to the instantaneous speed of the label stock along the web path. The speed of the label stock along the web path during a labelling operation may be measured using any appropriate method (whether discussed in this document or otherwise) for determining linear speed of the label stock. The controller may then be configured to calculate the relevant average speed of the label stock along the web path during the relevant labelling operation based on measurement of the speed of the label stock taken during the relevant labelling operation. The determined average speed of the label stock during the labelling operation for only the portion of the labelling operation which has already been completed, measured average speed of the label stock along the web path during a previous labelling operation, and instantaneous speed of the label stock along the web path, may refer to the relevant speed of the portion of the label stock advanced during the labelling operation. This portion of the label stock may be the portion of the label stock downstream of the movable element and/or the linear speed at which label stock is wound on to the take up spool.

For example, the labelling machine may comprise a linear displacement sensor (for example a roller of known diameter which contacts the label stock—such as, but not limited to the print roller, as discussed elsewhere within this document—and an associated encoder). The linear displacement sensor may be configured to output a linear speed signal based on a linear displacement of the label stock along the web path and the controller may be configured to determine the average speed of the label stock along the web path during the labelling operation based on the linear speed signal.

Depending on the operating condition of the labelling machine, the target supply spool speed may be adjusted by the controller. This is discussed in more detail below.

FIG. 25 shows a schematic depiction of a portion of a labelling machine in accordance with an embodiment of the present invention. The Figure shows the supply reel 16 mounted to the supply reel support 10, as well as a movable element in the form of a dancing arm 28 with associated roller 32 (in other embodiments, the movable element may be any appropriate movable element). As previously discussed, in this embodiment the dancing arm 28 rotates about an axis A which is the same axis about which the supply spool support 10 and supply spool 16 also rotate.

The extent of the permitted rotation of the dancing arm 28 about the axis A is defined by first and second stops $S_h$ and $S_c$. The stop $S_h$ is a stop which defines the home position (referred to earlier) of the dancing arm and the stop $S_c$ is a crash-stop roller.

As discussed later within this document, some embodiments of labelling machine according to the present invention include a manual override for the brake assembly which enables the user to manually reduce the braking force applied by the brake assembly (for example, to replace the label stock or re-web the label machine whilst the machine is in a powered-down state). As shown FIG. 25, line 250 indicates the position of the dancing arm 28 at which the braking force applied by the braking assembly is manually reduced.

In the mechanical override position 250, the mechanical system of the manual override arrangement may cause the brake arrangement to be completely released. In order to ensure there is no interference in operation between the mechanical manual brake override arrangement and the electro-mechanical system by which the controller attempts to control the braking arrangement, it is desirable that the controller is configured such that, when the dancing arm is located at the mechanical override position 250, the brake assembly control signal the controller supplies to the brake assembly causes the brake assembly to be in a fully released configuration (i.e. not applying a braking force). This may prevent a failure in the braking arrangement actuator—for example, stalling of the stepper motor used within the embodiment of the braking assembly described below in relation to FIGS. 18 to 20.

As previously discussed, the resilient biasing member (not shown within FIG. 25), exerts a force on the label stock via the movable element to thereby determine the tension within the label stock. The force exerted by the resilient biasing member on the movable element is dependent on the position of the movable element. For example, if the resilient biasing member is a spring, the position of the movable element affects the extension of the spring and therefore the force exerted by the spring on the movable element and hence label stock. In the embodiment shown in FIG. 25 movement of the dancing arm in the direction T will result in the force applied to the label stock by the dancing arm increasing, thereby increasing tension in the label stock.

Line 252 within FIG. 25 corresponds to a set point position of the dancing arm 28. When the dancing arm 28 is located at the set point position indicated by line 252 the resilient biasing member exerts a force on the label stock such that the tension within the label stock is a minimum desirable tension. This minimum desirable tension may be predetermined and may be a minimum tension which is required within the label stock for the labelling machine to function correctly. For example, it may be a minimum tension required so that labels can be efficiently removed from the label web by a label application (such as a peel beak) and/or, in the case of a print and apply labelling machine, a minimum tension acquired such that the printer can print with an acceptable print quality on the labels of the label stock.

The set point position may be determined by the controller based on user input and/or may be based on an operating characteristic of the labelling machine: for example, the width of the label stock, the speed at which the labelling machine is operating, the type of printhead used by the printer, and/or the orientation of the labelling machine with respect to gravity. In relation to the width of the label stock, in some situations, a relatively narrow width of label stock will require a greater minimum tension than that required for a wider width of label stock. The greater minimum tension required by the relatively narrow width of label stock will result in the requirement for a greater minimum force which needs to be exerted on the label stock by the dancing arm in order to achieve the desired minimum tension within the label stock. Consequently, in some embodiments, for a relatively narrow width of the label stock the set point position of the dancing arm may be further away from the home stop $S_h$ (i.e. the further in the direction T) as compared to the set point position for a wider width of label stock. Considerations relating to an increased minimum label web tension for a relatively narrow width of label stock (as compared to a wider width of label stock) may be particularly relevant when the labelling machine is operating at relatively low labelling speeds. In relation to the orientation of the labelling machine with respect to gravity, it will be appreciated that in some orientations of the labelling machine with respect to gravity, the effect of gravity will increase the force applied by the dancing arm to the label stock (thereby increasing tension of the label stock), and in other orientations gravity may oppose, mitigate or have no effect on the force exerted by the dancing arm on the label stock (thereby reducing or not affecting the tension of the label stock). The set point position may be chosen so that the minimum tension in the label stock in an orientation of the labelling machine in which gravity assists the force applied by the dancing arm is substantially the same as that when the labelling machine is in an orientation in which gravity opposes or does not affect the force imparted by the dancing arm on the label stock.

It will be appreciated that it is desirable for the position of the dancing arm 28 to be controlled by the controller such that the controller attempts to prevent the dancing arm from moving beyond the set point position 252 in the direction T' (thus leading to a reduction in the tension within the label stock below the minimum desired tension).

Furthermore, it is not desirable for the position of the dancing arm to move beyond position 250 in the direction T, because doing so will result in the manual override of the brake assembly being activated, thereby removing the controller's ability to control the braking apparatus to apply the desired braking force to the supply spool port 10.

In addition to being undesirable for the dancing arm to move in the direction T' beyond position 252 and in the direction T beyond the position 250, it will be appreciated that it is also undesirable for the dancing arm to be urged in the direction T' so that it collides with stop $S_h$ and/or for the dancing arm 28 to be urged in the direction T such that it collides with stop $S_c$. If the dancing arm collides with the stops with any significant force, there is the possibility that the labelling machine will be damaged. In addition, any collision will result in a detrimental user experience because it may be aesthetically displeasing for parts of the labelling machine to collide with other parts of the labelling machine. In addition, if the dancing arm collides with the stop $S_c$, this may result in the label stock being damaged of snapping, and/or may result in the label applicator (e.g. label peel beak) being damaged.

Within the presently described embodiment of the invention, the controller is configured to implement a number of different control zones between the set point position 252 and the manual override position 250. These are discussed in more detail below.

The labelling machine includes a first operating zone 254 which is bounded by a first border 256 and a second border 258. The first operating zone 254 corresponds to a first range of positions of the movable element (in this case dancing arm 28) between when the dancing arm is located at the position of the first border 256 and when the dancing arm is located at the second border 258. The first operating zone 254 may be referred to as the normal operating zone.

The labelling machine also includes a second operating zone 260. The second operating zone 260 corresponds to a second range of positions of the movable element (in this case dancing arm 28) between the position of the dancing arm 28 when the dancing arm is at the set point position 252 and the position of the dancing arm when it is located at the border 256. In the described embodiment, the labelling machine is configured such that the second operating zone 260 is adjacent the first operating zone 254 such that the second range of positions of the movable element is adjacent the first range of positions of the movable element. However, it will be appreciated that in other embodiments the first operating zone 254 may be spaced from the second operating zone 260 so that the second range of positions of the movable element is spaced from the first range of positions of the movable element.

The second operating zone 260 may be referred to as the braking zone.

In some embodiments the labelling machine may be configured such that the braking zone is sized to ensure that it is possible to bring a supply spool to rest substantially at the same time as the movable arm reaches the setpoint position (for example, at the end of a labelling operation, or series of labelling operations). If the braking zone is too small, the arm may overshoot the setpoint position (thereby resulting in the tension in the label stock falling below the minimum desired tension). Consequently, in some embodiments the size of the braking zone is determined dynamically by the controller based upon the speed and diameter of the supply spool.

In some embodiments the controller is configured to determine the braking zone as follows. The controller determines the diameter of the supply spool using any appropriate spool diameter determination method, such as any of those discussed within this document. The controller then determines the correct size of braking zone for a linear speed of label stock removed from the supply spool of 500 mm/s. This is achieved by interpolating between a size of 250 encoder steps for a 400 mm diameter supply spool (the diameter of a particular supply spool when the spool has not yet been used) and a size of 100 encoder steps for a 82 mm diameter supply spool (the diameter of said particular supply spool when the spool has been fully used). By encoder steps, what is meant is pulses produced by the sensor configured to produce a sensor signal indicative of the position of the moveable element of the type discussed earlier within this document.

If the linear speed of label stock removed from the supply spool is not 500 mm/s the size of the braking zone calculated by the controller for the linear supply speed of 500 mm/s is scaled by the controller for the current linear supply speed. This is achieved by dividing the size of the braking zone calculated by the controller for the linear supply speed of 500 mm/s by 500 and multiplying this number by the current linear supply speed in mm/s. The linear speed of label stock being removed from the supply spool is determined using any appropriate method, such as any of the methods discussed within this document.

Regardless of the determined size of the braking zone, in some embodiments the controller is configured to apply a minimum braking zone size of 10 encoder steps.

Within the present embodiment, one of the limits of the second range of positions of the movable element is the set point position 252 (i.e. a minimum tension position of the movable element which corresponds to a predetermined minimum desired tension within the label stock). In other embodiments, the minimum tension position may be at any appropriate position relative to the second range of positions of the movable element. For example, the minimum tension position may be spaced from the second range of positions.

The labelling machine is configured such that it includes a third operating zone 262. The third operating zone 262 corresponds to a third range of positions of the movable element (in this case dancing arm 28). The third range of positions of the dancing arm corresponds to between the location of the dancing arm 28 when it is located at the second border 258 and the position of the dancing arm 28 when it is located at the manual override position 250. The third operating zone 262 may be referred to as the acceleration zone. Within the present embodiment, the third operating zone 262 is located adjacent the first operating zone 254 such that the third range of positions of the movable element is adjacent the first range of positions of the movable element. However, it will be appreciated that in other embodiments the first operating zone 254 may be spaced from the third operating zone 262 so that the third range of positions of the movable element is spaced from the first range of positions of the movable element.

In addition, the labelling machine is configured such that the first operating zone 254 is between the second and third operating zones 260, 262 such that the first range of positions of the movable element is between the second and third ranges of positions of the movable element.

As discussed above within the present document, the labelling machine includes a sensor configured to produce a sensor signal indicative of the position of the dancing arm 28. Details of the construction and operation of the sensor are not set out here again so as to avoid repetition. The signal produced by the sensor which is indicative of the position of the dancing arm 28 is supplied to the controller so that the controller has information as to position of the dancing arm 28.

In some embodiments, if the sensor signal provided to the controller is indicative of the dancing arm being within the second operating zone 260, the controller modifies the target supply spool speed from its current value so that the target supply spool speed is reduced. Referring again to FIG. 17*a*, the labelling machine is configured such that when the target supply spool speed SP3(*t*) is reduced, the signal SP(t) output by the supply speed control algorithm is such that the brake assembly control signal output by the controller (i.e. by the solenoid position control algorithm 204) commands the brake assembly to apply an increased braking force to the supply spool support. The increased braking force applied to the supply spool support will reduce the speed of the supply spool support. For example, in some embodiments, assuming an ideal linear system, to slow the supply spool to a new speed the supply spool speed control loop will momentarily apply extra braking until the new speed is achieved, before resuming the original degree of braking which was being utilised before the target supply speed was modified to the new, reduced speed.

For a given speed of rotation of the take up spool, a reduction in the speed of the supply spool will result in a reduction in the web path length between the take up spool and the supply spool by movement of the dancing arm 28 in the direction T, thereby both increasing tension in the label stock and moving the dancing arm towards the first operating zone 254. The dancing arm 28 will continue to move as long as a speed difference between the linear speed at which label stock is removed from the supply spool and the linear speed at which label stock is wound on to the take up spool.

As previously discussed, the controller is configured such that when the dancing arm position sensor signal received by the controller is indicative of the dancing arm being within the second operating zone 260, the controller modifies the target supply spool speed (or a value indicative thereof) so that it is reduced. This reduction of target supply spool speed may be any appropriate reduction in supply spool speed. In some embodiments the supply spool speed may be reduced to a current instantaneous speed of the label stock along the label web path. The current instantaneous speed of the label stock along the label web path may be determined by the controller in any appropriate manner—for example by subtracting the rate of change of the differential path length from the linear speed at which the label stock is taken up onto the take up spool as previously discussed, or by use of a sensor which measures a speed of the label stock along the web path. Alternatively, the controller may modify the target supply spool speed so that the target supply spool speed is reduced to a live average speed of the label stock along the label web path based on movement of the label stock along the label web path since commencement of the current labelling operation. That is to say, once the labelling machine receives a command signal for a labelling operation to commence, the controller commences the labelling operation whilst simultaneously receiving at least one sensor signal which enables the controller to determine the instantaneous label web speed. As the labelling operation progresses, because the controller has information as to the amount of time which has elapsed since the labelling operation commenced, and information as to the instantaneous speed of the label web moving along the label web path at all times during the labelling operation, the controller can determine the live average speed of movement of the label stock along the web path.

In some embodiments, the reduction in the target supply spool speed may cause the dancing arm to return to the normal operating zone. The target supply spool speed in the normal operating zone may be one of the following: 1. the average speed of the last complete labelling operation, 2. the live average speed for the portion of the current labelling operation so far completed, or 3. the current instantaneous speed. In all three cases the relevant speed is the linear speed at which the label stock is wound on to the take up spool (or, if the labelling machine includes a movable element, the speed of the label stock along the web path at a point downstream of the movable element). In other embodiments the controller may be configured such that the target supply spool speed in the normal operating zone is determined by interpolating, based on the diameter of the supply spool, between the live average speed for the portion of the current labelling operation so far completed (when all the label web has been removed from the supply spool—end of spool), and the current instantaneous speed of the label stock (when none of the label stock has been removed from the supply spool—beginning of spool). The diameter of the supply spool may be determine using any appropriate spool diameter determination method including, but not limited to, those discussed in this document.

In some embodiments the target supply spool speed when the movable element is in the braking zone is equal to the target supply spool speed when the movable member is in the normal operating zone multiplied by a coefficient, the value of which lies between 0.0 and 1.0. In some embodiments the target supply spool speed when the movable element is in the accelerating zone is equal to the target supply spool speed when the movable member is in the normal operating zone multiplied by a coefficient, the value of which lies between 1.0 and 2.0.

In some embodiments the extent to which the target supply speed is reduced when the dancing arm 28 is located in the second operating zone 260 increases as the distance of the dancing arm from the first region 254 increases (and/or the distance between the position of the dancing arm and the set point position 252 decreases). In some embodiments the controller is configured such that when the controller receives a signal from the dancing arm position sensor which is indicative of the dancing arm position sensor being located at the set point position 252, the brake assembly control signal output by the controller causes the brake assembly to be fully engaged (i.e. applying the maximum possible braking force). In some embodiments of the invention which undergo an intermittent printing cycle, the operation of the controller when the dancing arm is located in the second operating zone, as discussed above, may ensure that the dancing arm does not overshoot the set point position 252 by achieving progressive braking. In some embodiments of the present invention in which the labelling machine operates in a continuous labelling mode, the operation of the controller discussed above when the dancing arm is in the second operating zone may act to oppose movement of the dancing arm from the normal operating zone to the braking zone.

In some embodiments according to the present invention, the controller is configured such that when the dancing arm position sensor provides a sensor signal to the controller which is indicative of the movable element being within the third operating zone 262, the controller modifies the target supply spool speed (or value indicative thereof) SP3(*t*) so that the target supply spool speed is increased. The labelling machine is configured such that when the target supply spool speed SP3(*t*) is increased, the signal SP(t) output by the supply speed control algorithm is such that the brake assembly control signal output by the controller (i.e. by the solenoid position control algorithm 204) commands the brake assembly to apply an decreased braking force to the supply spool support. The decreased braking force applied to the supply spool support will increase the speed of the supply spool support. For a given speed of rotation of the take up spool, an increase in the speed of the supply spool will result in an increase in the web path length between the take up spool and the supply spool by movement of the dancing arm 28 in the direction T', thereby both decreasing tension in the label stock and moving the dancing arm towards the first operating zone 254.

As previously discussed, the controller is configured such that when the dancing arm position sensor signal received by the controller is indicative of the dancing arm being within the third operating zone 262, the controller modifies the target supply spool speed (or a value indicative thereof) is increased. This increase of target supply spool speed may be any appropriate increase in supply spool speed. In some embodiments the supply spool speed may be increased to a current instantaneous speed of the label stock along the label web path. The current instantaneous speed of the label stock along the label web path may be determined by the controller in any appropriate manner—for example by subtracting the rate of change of the differential path length from the linear speed at which the label stock is taken up onto the take up spool as previously discussed, or by use of a sensor which measures a speed of the label stock along the web path. Alternatively, the controller may modify the target supply spool speed so that the target supply spool speed is increased to a live average speed of the label stock along the label web path based on movement of the label stock along the label web path since commencement of the current labelling operation. Discussion as to the determination of a live average speed as given above and so is not repeated here.

In some embodiments the extent to which the target supply speed is increased when the dancing arm 28 is located in the third operating zone 262 increases as the distance of the dancing arm from the first region 254 increases (and/or the distance between the position of the dancing arm and the manual override position 250 decreases). As previously discussed, in some embodiments the controller is configured such that when the controller receives a signal from the dancing arm position sensor which is indicative of the dancing arm position sensor being located at the manual override position 250, the brake assembly control signal output by the controller causes the brake assembly to be fully released (i.e. applying the minimum possible braking force). In some embodiments of the invention which undergo an intermittent printing cycle, the operation of the controller when the dancing arm is located in the third operating zone, as discussed above, may ensure that the dancing arm does not overshoot the manual override position 250 by achieving progressive braking. In some embodiments of the present invention in which the labelling machine operates in a continuous labelling mode, the operation of the controller discussed above when the dancing arm is in the third operating zone may act to oppose movement of the dancing arm from the normal operating zone to the accelerating zone.

In some embodiments, with long labels and high feed speeds the dancing arm may enter the mechanical override zone (i.e. move past the manual override position in the direction T, as indicated in FIG. 25). In general, in such embodiments, this is permissible, provided, as discussed above, the brake is fully released at (and beyond) the manual override position 250, and as long as the arm does not collide with the crashstop $S_c$. In some embodiments, as the arm approaches the crashstop, the force exerted on the dancing arm by the resilient biasing member which biases the dancing arm in the direction T' (i.e. out of the mechanical override zone) increases very rapidly. This, coupled with the fully-released brake, ensures that the dancing arm stops moving in the direction T and returns in the direction T' before the crashstop roller $S_c$ is reached.

If, during operation of the labelling machine, the dancing arm 28 (which may move in a generally oscillatory manner during operation of the labelling machine) remains within the normal operating zone 254, then no modification of the target supply spool speed in relation to the position of the dancing arm 28 is required.

In embodiments of the present invention in which the labelling machine undergoes a continuous mode of operation in which the label stock is accelerated from rest to a labelling speed, the label stock continues moving at the labelling speed for a desired period of time, and then the label stock is decelerated to rest. Whilst the labelling machine undergoes a labelling operation in the continuous mode of operation, the dancing arm will oscillate based on the movement of the label stock. In particular, in general, whilst the label stock is being advanced the dancing arm will move in a direction which reduces the path length between the supply spool and the take up spool (direction T in FIG. 25). Conversely, when the label stock is stationary, the dancing arm will move in a direction in which the path length between the supply spool and take up spool increases (direction T' in FIG. 25).

In some embodiments the controller of the labelling machine may be configured so as to monitor the signal provided to the controller by the dancing arm position sensor and, based upon the signal indicative of the position of the dancing arm, determine the average position of the dancing arm during a labelling operation. For example, the controller may be configured to take the maximum angular position of the dancing arm (or value indicative thereof) and subtract from this the minimum angular position of the dancing arm (or value indicative thereof) during a labelling operation, and then divide the difference by 2 so as to arrive at the average position of the dancing arm during the labelling operation. In some embodiments, this calculated average dancing arm position may be compared to a target dancing arm position (which may or may not be the same as the target arm position discussed previously within this document). For example, in some embodiments, the target arm position may be a position which equivalent to the label stock having a particular desired tension and/or the target arm position may be located substantially in the centre of the normal operating zone, which is equivalent to the position of the dancing arm as shown in FIG. 25. In other embodiments, any appropriate target arm position may be used.

In a similar manner to the previously described braking and accelerating operating zones, in some embodiments the controller may be configured such that if the determined average position of the dancing arm during a labelling operation (or value indicative thereof) is located in the direction T from the target arm position (i.e. such that, on average, the tension in the label stock during the labelling operation is greater than the tension in the labelling stock when the dancing arm is at the target dancing arm position, then the controller may be configured to modify the target supply spool speed so that the target supply spool speed is increased. As previously discussed, this will result in the amount of braking applied by the brake assembly to the supply spool being decreased. In some embodiments, the greater the extent that the average dancing arm position during the labelling operation is spaced from the target dancing arm position in the direction in which tension within the dancing arm is increased, the greater the extent to which the controller may modify the target supply spool speed so as to increase the target supply spool speed and, consequently, the greater the extent to which the controller may control the brake assembly so that the braking force exerted by the braking assembly on the supply spool is reduced.

Likewise, in some embodiments the controller may be configured such that if the determined average position of the dancing arm during a labelling operation (or value indicative thereof) is located in the direction T' from the target arm position (i.e. such that, on average, the tension in the label stock during the labelling operation is less than the tension in the labelling stock when the dancing arm is at the target dancing arm position, then the controller may be configured to modify the target supply spool speed so that the target supply spool speed is decreased. This will result in the amount of braking applied by the brake assembly to the supply spool being increased. In some embodiments, the greater the extent that the average dancing arm position during the labelling operation is spaced from the target dancing arm position in the direction in which tension within the dancing arm is decreased, the greater the extent to which the controller may modify the target supply spool speed so as to decrease the target supply spool speed and, consequently, the greater the extent to which the controller may control the brake assembly so that the braking force exerted by the braking assembly on the supply spool is increased.

The calculation of the average dancing arm position during a labelling operation and/or the modification of the target supply spool speed in consequence thereof may be carried out at any appropriate time. For example, in some embodiments, the average dancing arm position for a first labelling operation may be determined by the controller and the controller may then modify the target supply spool speed for a second labelling operation which is after the first labelling operation.

The previously described embodiment operates such that the average position of the dancing arm for an entire labelling operation is determined and then compared to a target arm position in order to determine whether the controller should modify the target supply spool speed. In other embodiments, the average arm position may be calculated twice per labelling operation and compared to a target arm position. This would result in a quicker correction than carrying out the modification to the target supply spool speed once per labelling operation. Calculating the average dancing arm position twice per labelling operation and comparing this to the target arm position is possible because, under ideal conditions, the movement of the dancing arm during a labelling operation (i.e. when the label stock is advanced by the labelling machine) and the movement of the dancing arm between labelling operations (i.e. when the label sock is stationary) is substantially equal but opposite.

As previously discussed, in some embodiments, the controller may set the target supply spool speed so that it is equal to the average feed speed of the previous labelling operation. An aim of doing so is to achieve substantially constant speed rotation of the supply spool. As previously discussed, the average speed of the label stock along the web path may be determined by a roller and associated encoder such as, for example, an encoder on the print roller.

The operation of the labelling machine in the way described above may be characterised by a downwards movement (in the sense of FIG. 25) of the dancing arm 28 during a labelling operation. This is movement of the dancing arm 28 in the direction T, which is equivalent to increasing the tension in the label stock and reducing the path length between the supply spool and take up spool. The operation of the labelling machine is further characterised by an upward movement (in the sense of FIG. 25) of the dancing arm 28 between label feeding operations. Within FIG. 25, this is movement of the dancing arm 28 in the direction T', which is equivalent to decreasing the tension in the label stock and increasing the web path length between the supply spool and the take up spool.

If the pitch of the labels of the label stock changes, or the distance between products to which the labels are to be applied by the labelling machine changes, then this will result in a change in the amount of dancing arm movement during operation of the labelling machine. In particular, a decrease in label pitch, or an increase in the distance between products to which the labels to be applied by the labelling machine, will cause the difference between the labelling speed and the average speed of the label stock along the label web path during a labelling operation to increase. In turn, this will result in the amount of movement of the dancing arm during operation of the labelling machine increasing. Conversely, if the label pitch increases, or the distance between products to which the labels are to be applied by the labelling machine decreases, the difference between the labelling speed and the average speed of the label stock along the label web path during a labelling operation to decrease. Consequently, in this case, the amount of movement of the dancing arm during operation of the labelling machine will decrease.

The labelling speed (or target feed speed) is the speed at which the label stock has to be advanced along the label web path so as to match the speed of a product which is to be labelled by the labelling machine. For example, if during a labelling operation the label stock is accelerated from 0 mm/s to 500 mm/s, prints and dispenses a label, then decelerates back to 0 mm/s, the labelling speed is 500 mm/s.

In a continuous operating mode of a labelling machine, assuming the entire swing of the dancing arm is within the normal operating zone 254, during a labelling operation the arm moves in direction T towards the crash stop position $S_c$ at a rate substantially equal to half the difference between the labelling speed and the linear speed at which the supply spool pays out label stock. Between labelling operations the dancing arm moves back towards the home position stop $S_h$ (i.e. in the direction T' such that the web path between the supply spool and take up spool increases) at a rate substantially equal to half the linear speed that label stock is being removed from the supply spool. The reason that the speed of movement of the dancing arm is substantially half the difference between the labelling speed and the linear speed at which the supply spool pays out label stock or half the linear speed that label stock is being removed from the supply spool is that the dancing arm bisects the label web path. That is to say, the rate at which the path length between the supply spool and the take up spool changes is approximately twice the rate of movement of the dancing arm.

It follows from the above that if the linear supply spool speed and the labelling speed are the same, the arm will be stationery during a labelling operation. However, if there is a great difference between the linear supply spool speed and the labelling speed, the dancing arm will move considerably. It follows that in instances in which the linear supply spool speed and labelling speed are sufficiently different for a label stock having a particular label pitch, the movement of the dancing arm will become so great that it cannot be contained within the normal operating zone 254. As such, the dancing arm position will, at some points during its movement, encroach into the braking zone 260 and/or the acceleration zone 262. It follows that, during operation of the labelling machine, whilst the dancing arm is moving back and forth, at least one of the extremes of the movement of the dancing arm the target supply spool speed is modified, causing additional braking at one extreme of the movement of the dancing arm and/or reduced braking at the other extreme of the movement of the dancing arm. Because of the modification(s) to the target supply spool speed which occur at least one of the extremes of movement of the dancing arm, it may no longer be possible to maintain a constant speed of supply spool rotation. Furthermore, if the movement of the dancing arm becomes significantly large, there is a risk that the dancing arm will collide with either of the stops $S_h$ or $S_c$. As previously discussed, collision of the dancing arm with either of the stops may be undesirable.

In order to address this potential issue, in a situation in which the labelling speed would otherwise be very different to the average speed of the label stock along the web path during a labelling operation, thereby leading to considerable movement of the dancing arm, the target supply speed is set not to the average speed of the label stock along the label web path of the previous labelling operation, but to a different value which is chosen to reduce the amount of arm movement, rather than to try to maintain constant supply spool speed.

In some embodiments, the modified supply spool target speed which is used when there is a significant difference between the supply spool speed and the labelling speed (and/or if the signal provided to the controller by the dancing arm position sensor is indicative of significantly large movement of the labelling arm during operation of the labelling machine) is the current instantaneous label feed speed (i.e. a speed at which the label web is currently moving along the web path—for example, as measured by a roller, such as a print roller, and an appropriate associated encoder), or the current live average label feed speed (i.e. the average speed of the label stock along the web path since the current labelling operation was commenced—explanation as to how the controller may determine such a quantity has been discussed further above, and is therefore not discussed further here so as to avoid repetition). Both the these quantities, which may be used as modified target supply spool speeds in the case where movement of the dancing arm would otherwise be unacceptable, are quantities which attempt to match the target supply spool speed to the label feed speed whilst a labelling operation is in progress.

It has been found that modifying the target supply speed so that it is equal to the current instantaneous label feed speed (i.e. the instantaneous speed of the label stock along the label web) may give better performance during the early life of the supply spool (i.e. when relatively little label stock has been removed from the supply spool onto the take up spool) because a relatively large amount of braking is required as a labelling operation ends.

When the portion of a labelling operation which involves the label stock being advanced along the label web path completes, the instantaneous speed of the label stock along the web path drops to zero. In this case, if the controller is configured to modify the target supply speed so that it is equal to the current instantaneous label feed speed, the target supply speed would also drop to zero. However, in some embodiments, the controller is configured to utilise a minimum target supply speed (as discussed in more detail below). Due to the minimum target supply speed, the controller attempts to ensure that the minimum supply speed is always applied while the dancing arm is returning to the setpoint position during the portion of the labelling operation in which the label stock is not being advanced along the web path by the motive device. Therefore as the portion of the labelling operation which involves the label stock being advanced along the label web path completes, the supply spool and the dancing arm are quickly decelerated to a low speed, which is maintained until the dancing arm position sensor indicates that the setpoint position has been reached, at which point both are the dancing arm and supply spool are halted so as to avoid overshooting the setpoint.

This method may be advantageous during the earlier life of a supply spool (i.e. when there is a relatively large amount of label stock wound onto the supply spool). During the earlier life of a supply spool its diameter, and hence mass, will be relatively large (as compared to the later life of the supply spool when there is relatively little label stock wound on the supply spool because label stock has been wound onto the take up spool). It follows that during the earlier life of the supply spool, the moving supply spool will have a relatively large inertia. Consequently, a greater amount of braking is required to decelerate the supply spool during the earlier life of the supply spool. In this situation, when a relatively great braking force is required to decelerate the supply spool it may be beneficial to 'stagger' the braking from labelling speed to minimum supply speed and then from minimum supply speed to rest.

In addition it has been found that, in some embodiments, towards the end of the life of the supply spool (i.e. when a relatively large amount of label stock has been removed from the supply spool onto the take up spool) modifying the supply spool target speed so that it equals the current live average speed (i.e. average speed of the label stock along the web path during the current labelling operation) may give better performance. This is because towards the end of the life of the supply spool reel, relatively gentle braking of the label stock is required.

At the end of supply reel there is relatively little label stock on the supply spool (as compared to the earlier life of the supply spool) and hence the moving supply spool has relatively small inertia. The relatively small inertia of the moving supply spool may mean that a relatively small braking force applied by the braking assembly can quickly bring the supply spool to a halt. As previously discussed, a labelling operation includes a portion during which the label stock is advanced along the web path by the motive device and a subsequent portion in which the label stock is not advanced along the web path by the motive device. Towards the end of a labelling operation (i.e. during the portion in which the label stock is not advanced along the web path by the motive device) the current live average speed of the label stock will be continually decreasing. Therefore, towards the end of a labelling operation, if the controller is configured to modify the target supply spool speed to the current live average speed of the label stock, the brake is more gradually applied. This allows the dancing arm to smoothly return to the setpoint position.

In some applications, if the controller is not configured to, towards the end of the life of the supply spool, modify the supply spool target speed so that it equals the current live average speed, it is possible the dancing arm will halt prematurely (i.e. before reaching the setpoint position) on its return, due to excessive braking.

In the examples above, in which the target supply spool speed is modified by the controller in order to attempt to reduce the extent of movement or potential movement of the dancing arm, the motion of the labelling machine may be characterised by an intermittent motion of both the dancing arm and the supply spool.

In some embodiments, when the labelling machine is operating in a continuous labelling mode, if the average speed of a previous labelling operation is reduced due to either a low labelling speed or a low throughput of the labelling machine, the target supply spool speed determined by the controller may become so slow that operation of the labelling machine appears laboured. In such embodiments, in order to improve the user experience and aesthetics of the labelling machine a minimum target supply speed may be implemented. In this case the controller is not permitted to modify the target supply speed so that it is below the minimum target supply speed. Consequently, this prevents the operation of the labelling machine from looking laboured.

In some embodiments, if the instantaneous or average feed speed of the label stock along the web path is significantly below the minimum target supply speed, the controller is configured to modify the target supply speed so that it is slightly greater than the minimum target supply speed.

In more detail, when the average feed speed of the label stock is less than the minimum target supply speed, the time between portions of adjacent labelling operations in which the label stock is advanced along the label web path by the motive device is so great that the dancing arm will have time to return to the setpoint position before the next labelling operation commences. Consequently the operation of the labelling machine becomes intermittent. At these speeds the dancing arm returns to the setpoint position relatively slowly. This can make the operation of the labelling machine appear laboured and/or ungainly. In some embodiments, if the average feed speed of the label stock decreases below the minimum target supply speed, the controller is configured to modify the target supply speed such that it is increased above the minimum target supply speed to produce a quicker return of the dancing arm to the setpoint position. A quicker return of the dancing arm to the setpoint position may be aesthetically pleasing in that it prevents the operation of the labelling machine from appearing laboured and/or ungainly.

In some embodiments, the controller is configured such that the further the average feed speed of the label stock is below the minimum target supply speed, the greater the increase in the modified target supply speed above the minimum target supply speed. In such embodiments, the controller is configured such that as average feed speed of the label stock decreases towards the minimum target supply speed, the target supply speed traces the average feed speed of the label stock down to the minimum target supply speed. As the average feed speed of the label stock decreases beyond the minimum target supply speed, the controller modifies the target supply speed such that it 'folds back' and increases as the average feed speed of the label stock decreases further away from the minimum target supply speed. In some embodiments the controller modifies the target supply speed such that it increases as the average feed speed of the label stock decreases further away from the minimum target supply speed until a suitable limit is reached. For example, in an embodiment in which the minimum target supply speed is 50 mm/s the controller modifies the target supply speed such that it increases as the average feed speed of the label stock decreases further away from the minimum target supply speed until target supply speed reaches 100 mm/s, beyond which the target supply speed is not increased further with any further decrease of the average feed speed of the label stock.

In these conditions, the operation of the labelling machine is such that the rotation of the supply spool is intermittent. That is to say, during an end portion of each labelling operation (whilst the portion of label stock which was advanced during the labelling operation is at rest) the supply spool comes to rest and the dancing arm returns to the set point position 252 of the dancing arm. Because the machine operates such that the supply spool moves at the minimum target speed and then halts, and then continues operating at the minimum supply speed, etc., the labelling machine according to this embodiment of the invention appears to have a more certain and reassuring operation.

If the labelling speed is less than the minimum target supply spool speed then the supply spool control algorithm will always try to feed label stock into the label web path faster than the take up spool is driven to wind label stock out of the web path and onto the take up spool. In this situation the dancing arm will never move away from the setpoint position. The supply spool instead oscillates between a state in which the dancing arm is located at the setpoint position and hence the controller fully applies the brake; and a state in which the dancing arm is located one step (as measured by the dancing arm position sensor) below setpoint (i.e. in the direction T), such that the controller releases the brake to attempt to achieve the minimum target supply spool speed. The arm may judder at the setpoint position. Therefore the minimum target supply speed is set to 50 mm/s or 75% of the labelling speed, whichever is lower. This means that during the feed the arm will move away from the setpoint in an uninterrupted smooth sweep (as opposed to juddering).

In some embodiments it has been found that at very low feed speeds (for example below 40 mm/s) control of the supply spool speed becomes erratic. Without wishing to be bound by theory, it is thought that this may be due to the effects of static and/or dynamic friction, and/or low speed encoder effects such as noise that the encoder produces leading to the encoder no longer outputting a signal which is truly representative of the speed of the label web along the label web path.

In light of the above problem, some embodiments of labelling machine according to the present invention include a low speed mode of operation. The controller may be configured such that below a particular label stock speed along the web path, the labelling machine enters the low speed mode of operation. For example, in one particular embodiment the controller may place the labelling machine in the low speed mode of operation when the controller determines that the label stock is moving along the label web path at a speed which is less than 40 mm/s.

In the low speed mode of operation the controller is configured to modify the target supply spool speed so as to set it to 0 for part of a labelling operation. The consequence of setting the target supply speed to 0 is that the solenoid position control algorithm (or position-controlled motor controller as discussed later in this document) enters a state in which the brake assembly is placed in a fully engaged configuration such that the brake assembly applies the maximum possible braking force to the supply spool. Because the brake assembly is supplying the maximum braking force such that the supply spool is substantially prevented from rotating, the rotation of the take up spool by the take up motor causes the label stock path length to decrease by movement of the dancing arm in the direction T.

At a predetermined point through the feed (which may, for example, be a time elapsed since the labelling operation commenced or a distance moved by the label stock along the web path during the current labelling operation) the target supply spool speed is modified by the controller to a non-zero value. Consequently, the controller causes the braking assembly to at least partially release the brake so that the supply spool begins to rotate, thereby feeding label stock into the web path and thereby causing the dancing arm to move in a direction in which the web path length between the supply spool and take up spool increases (and/or the tension in the label web decreases). The dancing arm moves towards the set point position 252.

In some embodiments the non-zero value of the target supply spool speed may be 50 mm/s.

The point at which the controller is configured to modify the target supply spool speed from 0 to the non-zero value may, in some embodiments, be calculated such that the dancing arm returns to the set point position 252 at approximately the same time as the labelling operation is completed. This may be achieved in any appropriate way, one example of which is set out below.

It is known that in ideal conditions the displacement of the dancing arm in the first portion of the labelling operation in which the target supply spool speed is set to 0 should be equal and opposite to the displacement of the dancing arm in the second portion of the labelling operation in which the target speed is set to a non-zero value. It is also known that the rate of change of path length during the first portion of the labelling operation is zero, whereas the rate of change of the path length during the second portion of the labelling operation is equal to the labelling speed minus the non-zero value of the supply spool speed (e.g. 50 mm/s). It follows that the controller can deduce the duration of the first portion of the labelling operation such that the dancing arm displacements for each of the first portion of the labelling operation and the second portion of the labelling operation are equal but opposite.

There is a limit to the allowable dancing arm displacement, which is equal to the mechanical override position. If the limit is reached the dancing arm will return to the setpoint position early. This means that it arrives back at the setpoint before the labelling operation is complete. In this case, when the arm arrives at the setpoint the brake is applied and the arm starts to move back towards the mechanical override position—and so on until the labelling operation completes.

In some embodiments, the controller implements the following calculation to determine the changeover point at which the supply spool target speed is modified by the controller from zero to a non-zero value.

The controller calculates the speed at which the label web path between the supply spool and take up spool changes during the two portions of the labelling operation. This speed for the first portion ($v_1$) of the labelling operation is simply the labelling speed ($v_{lab}$) because the supply spool is not moving. For a positive labelling speed the speed at which the label web path between the supply spool and take up spool changes is negative. As such:

$$v_1 = -v_{lab} \tag{18a}$$

This speed for the second portion of the labelling operation is the labelling speed subtracted from the linear supply spool speed during the second portion of the labelling operation ($v_{sup}$). As such:

$$v_2 = v_{sup} - v_{lab} \tag{18b}$$

During the second portion of the labelling operation, in one embodiment, the supply spool may be fed at a fixed rate equal to 50 mm/s. It follows that the speed at which the label web path between the supply spool and take up spool changes for the second portion of the labelling operation for the embodiment mentioned above is 50 mm/s minus the labelling speed.

The change in label web path length during the first portion of the labelling operation ($\Delta L_1$) is:

$$\Delta L_1 = t_1 v_1 \tag{18c}$$

Where $t_1$ is the (time) duration of the first portion of the labelling operation and $v_1$ is the speed at which the label web path between the supply spool and take up spool changes during the first portion of the labelling operation.

Likewise, the change in label web path length during the second portion of the labelling operation ($\Delta L_2$) is:

$$\Delta L_2 = t_2 v_2 \tag{18d}$$

Where $t_2$ is the (time) duration of the second portion of the labelling operation and $v_2$ is the speed at which the label web path between the supply spool and take up spool changes during the second portion of the labelling operation.

Ideally, the change in label web path length during the first portion of the labelling operation is equal and opposite to change in label web path length during the second portion of the labelling operation, if the dancing arm is to finish where it started. It follows that:

$$\Delta L_2 = -\Delta L_1 \tag{18e}$$

therefore, $$t_2 v_2 = -(t_1 v_1) \tag{18f}$$

It is also known that the total (time) duration of the labelling operation ($t_{lab}$) will be equal to the sum of the (time) duration of the first portion of the labelling operation and the (time) duration of the second portion of the labelling operation. As such, it follows that:

$$t_{lab} = t_1 + t_2 \tag{18g}$$

Substituting (18g) into (18f) gives:

$$(t_{lab} - t_1) v_2 = -(t_1 v_1) \tag{18h}$$

It follows:

$$t_1 (v_2 - v_1) = t_{lab} v_2 \tag{18i}$$

And so:

$$t_1 = \frac{t_{lab} v_2}{(v_2 - v_1)} \tag{18j}$$

Finally, considering equations 18a and 18c, and multiplying both sides by $v_1$, the following is obtained:

$$t_1 v_1 = \frac{v_1 (t_{lab} v_2)}{(v_2 - v_1)} \tag{18k}$$

It follows that:

$$\Delta L_1 = \frac{-v_{lab} t_{lab} v_2}{(v_2 - v_1)} \tag{18l}$$

And that:

$$\Delta L_1 = \frac{-s_{lab} v_2}{(v_2 - v_1)} \tag{18m}$$

Where $s_{lab}$ is the linear distance of label stock wound onto the take up spool during the labelling operation.

Finally the controller determines the change in dancing arm position during the first portion of the labelling operation which corresponds to $\Delta L_1$ (the calculated change in label web path length during the first portion of the labelling operation). This change in dancing arm position may be converted into an equivalent signal received from dancing arm position sensor. For example, if the dancing arm position sensor outputs a pulse every time the dancing arm moves by a given angular distance (which is equivalent to a change in path length between the supply spool and the take up spool as set out earlier in this document), then the controller can determine how many pulses received from the dancing arm position sensor are equivalent to the calculated change in label web path length during the first portion of the labelling operation. It follows that the controller can monitor the number of pulses received from the dancing arm position sensor since the first portion of the labelling operation has commenced and terminate the first portion of the labelling operation and commence the second portion of the labelling operation once the number of pulses received from the dancing arm position sensor since the first portion of the labelling operation commenced is equivalent to the calculated change in label web path length during the first portion of the labelling operation.

The controller will also apply a limit to the position of the dancing arm in dancing arm position sensor encoder steps at which is equal to the point the mechanical override activates.

In some embodiments, hysteresis may be applied such that the controller is configured such that once the labelling machine is operating in the low speed mode, the labelling speed at which the controller takes the labelling machine out of the low speed operating mode is a speed which is greater than the labelling speed below which the controller places the labelling machine in the low speed mode. For example, in some embodiments, the labelling speed (or speed at which the label stock moves along the label web path) at which the controller is configured to place the place the labelling machine into the low speed operating mode may be 40 mm/s, whereas the labelling speed (or speed of the label stock along the label web) above which the controller is configured to take the labelling machine out of the low speed mode may be 60 mm/s. By having a different speed for entering the low speed mode as compared to the speed for leaving the low speed mode, the labelling machine is prevented from oscillating into and out of the low speed operating mode when the labelling machine is operating at speeds close to the low speed operating mode threshold speed. By preventing the labelling machine from oscillating into and out of the low speed mode, this may enable the machine to run in a smoother manner which may provide aesthetic and/or wear benefits as previously discussed.

In some of the examples given above, the target supply spool speed is modified by the controller in order to attempt to reduce the extent of movement or potential movement of the dancing arm. Reducing the extent of movement (or potential movement) of the dancer arm allows a greater minimum web tension to be achieved as compared to known, less well controlled dancing arm position control schemes. This is because, as discussed in relation to FIG. 25, the closer to the crash stop $S_c$ (i.e. the further in the direction T) the dancing arm is located, the greater the force acting on the label web (and hence the greater the tension in the label web). Because the range of movement of the dancing arm is reduced using the dancing arm control schemes discussed above (as compared to other known less-well controlled methods), the dancing arm position setpoint can be moved closer to the crash stop position $S_c$ (i.e. to a position equivalent to a greater tension in the label web) without the dancer arm colliding with the crash stop (which is undesirable for the reasons already discussed above). Not only does being able to set a greater minimum web tension increase the range of operating label web tensions for a particular label web at which the labelling machine can operate, but it may also enable the labelling machine to operate with a greater range of label web widths and thicknesses.

FIGS. 18 and 19 show a perspective view of a portion of a further embodiment of labelling machine of the type shown in FIG. 1 or FIG. 2. FIG. 18 shows the dancing arm 28 and an alternative brake assembly 70*a*. The brake assembly 70*a* may be substituted for the brake assembly 70 shown in FIGS. 5 to 11.

As before, the dancing arm 28 and supply spool support (not shown within FIG. 18) are both mounted for individual rotation about a common axis A. In other embodiments, the supply spool support and dancing arm 28 may rotate about their own respective axes.

The brake assembly 70*a* is configured to apply a variable braking force to the supply spool support, the braking force resisting rotation of the supply spool support. Although the brake assembly 70*a* is configured to apply braking force to the supply spool support, in other embodiments the brake assembly 70*a* may be used to apply a braking force to the take-up spool support.

The brake assembly 70*a* includes a brake disc 74 which is attached to the supply spool support such that it co-rotates with the supply spool support (and consequently any supply spool which is supported by the supply spool support).

The brake assembly also includes a brake belt 76 which extends around part of the outer circumference 88 of the brake disc 74. The brake belt 76 is fixed at a first end 76*a* to an attachment pin 78 which is mounted to a mounting block 80*a* which is fixed so that it does not rotate with the supply spool support. The brake belt 76 is attached at a second end 76*b* to an end piece 82*a*. The end piece 82*a* includes a socket 82*b*.

In the embodiment shown, the brake belt 76 has a generally rectangular cross-section and it contacts a portion of the outer circumference 88 of the brake disc 74 which has a substantially flat surface parallel to the axis A. That is to say, the substantially flat circumferential surface 88 of the brake disc 74 corresponds to the substantially flat surface of the belt 76 which engages the outer circumference 88 of the brake disc 74. It will be appreciated that in other embodiments of the labelling machine, the outer circumferential surface of the brake disc and the brake belt may have any appropriate corresponding profile. For example the outer circumferential surface of the brake disc may include a v-shaped groove which cooperates with generally circular cross-section brake belt.

The brake belt 76 may be made from any appropriate material. For example, the brake belt may be made of a combination of fabric and polymeric material, a combination of metal and polymeric material or of a polymeric material on its own. In one embodiment the brake belt is made out of steel reinforced polyurethane. In one embodiment the brake belt may be 10 mm wide, 280 mm long and formed from material referred to as Habasit TG04. In another embodiment the brake belt is a T2.5 synchroflex timing belt which has a width of 10 mm and a length of 280 mm. In this case the belt is formed from steel reinforced polyurethane and has teeth having a standard T profile according to DIN7721. Such belts are available from Beltingonline, Fareham, UK. Because this belt has teeth it is mounted such that the flat surface of the belt (i.e. the opposite surface to that which has the teeth) is the surface which contacts the brake disc. In other embodiments the belt may be mounted such that the toothed side of the belt contacts the brake disc. In the above described embodiments the brake disc (which may be of any appropriate size in other embodiments) has a diameter of 100 mm.

A generally disc-shaped cam 82*c* (also referred to as cam piece) is mounted on the end of a shaft 82*d* which is supported for rotation relative to the mounting block 80*a* about an axis F via a bearing which supported by the mounting block 80*a*. The cam piece is 82*c* is mounted to the shaft 82*d* such that the cam piece 82*c* is eccentric with respect to axis F of rotation of the shaft 82*d*. The cam piece 82*c* is mounted to the shaft 82*d* such that the cam piece 82*c* rotates with the shaft 82*d* when the shaft 82*d* rotates about axis F. Furthermore, the cam piece 82 is received by the socket 82*b* of the end piece 82*a* such that the end piece 82*a* may freely rotate relative to the cam piece 82*c*. For example, a bearing may be located between cam piece 82*c* and end piece 82*a* to enable relative rotation therebetween.

The shaft 82*d* and attached cam piece 82*c* may be driven for rotation about axis F by any appropriate drive apparatus. In some embodiments the drive apparatus includes a position controlled motor which drives the shaft 82*d*. The position controlled motor may be any appropriate position controlled motor, for example a servo controlled motor or a stepper motor. In the present embodiment the shaft 82*d* is the shaft of the position controlled motor, the position controlled motor (indicated schematically by broken lines in FIG. 19) being mounted to the mounting block 80*a*. In other embodiments the shaft 82*d* may be mechanically linked to the position controlled motor by an appropriate linking arrangement. For example, the position controlled motor and shaft may be mechanically linked by a belt, chain or the like. In other embodiments the cam (cam piece) may be driven for rotation by a position controlled motor in any appropriate manner. For example, in some embodiments the cam may be driven for rotation by the position controlled motor without driving an intermediate shaft to which the cam is mounted—for example a belt driven by the position controlled motor may directly drive the cam.

In the described embodiment the position controlled motor is a stepper motor. In particular it is a 42 mm frame size Sanyo Denki motor (part number 103H5205-5210) marketed by Sanko Denki Europe SA, 95958 Roissy Charles de Gaulle, France.

Referring now to FIG. 19, the position controlled motor and attached cam piece 82 are shown in an initialisation position. It will be appreciated that if the position controlled motor is energised so as to rotate the shaft 82*d* and attached cam piece 82*c* in a clockwise direction (as shown in FIG. 19), then the end piece 82*a* may be urged in a direction (e.g. towards the brake disc 74) such that the brake belt 76 is loosened around the brake disc 74. In other words, the tension in the brake belt 76 is reduced. Put another way, when the shaft 82*d* and attached cam piece 82*c* are rotated in a clockwise direction, the cam will urge (in this case via the end piece 82*a*) at least a portion of the second braking surface (the surface of the brake belt 76*b* which may contact the brake disc 74 in order to produce the braking force) towards the first portion of the belt 76*a* or in other words away from the cam or the second portion of the belt 76*b* (along the path of the brake belt between first and second ends 76*a*, 76*b*), thereby urging the second braking surface (i.e. the relevant surface of the belt 76) in a direction out of contact with the first braking surface (i.e. the braking surface of the brake disc 74). Consequently, energising the position controlled motor such that it causes the shaft 82*d* and attached cam piece 82*c* to rotate in a clockwise direction from the initialisation position shown in FIG. 19 will cause the braking force exerted by the belt 76 on the braking disc 74 (and hence attached spool support) to be reduced.

Conversely, if the position controlled motor is energised so as to rotate the shaft 82*d* and attached cam piece 82*c* in an anti-clockwise direction from the initialisation position shown in FIG. 19, then this will cause at least a portion of the brake belt 76 to be moved away from the first end 76*a* of the brake belt 76 (along the belt path between the first and second ends 76*a*, 76*b* of the belt 76). In other words, when the position controlled motor is energised such that the shaft 82*d* and attached cam piece 82*c* are rotated in an anti-clockwise direction from the position shown in FIG. 19, the tension in the brake belt 76 is increased, thereby increasing the braking force exerted on the brake disc 74. Put another way, then the cam (cam piece) is rotated in an anti-clockwise direction by the position controlled motor, the cam (cam piece) urges at least a portion of the second braking surface (surface of the belt 76 which contacts the brake disc 74 so as to apply the braking force) in a direction such that the second braking surface is urged towards the first braking surface (i.e. the outer circumference of the brake disc 74). In particular, the cam (cam piece 82*c*) urges a portion of the second braking surface towards the cam or second portion of the belt 76*b*, or in other words away from the first portion of the belt 76*a* and retaining pin 78 (along the path of the brake belt between first and second ends 76*a*, 76*b*).

In the way described above, the braking force applied to the spool support by the frictional interaction between the brake disc 74 and brake belt 76 can be controlled by controlling the position of the cam (e.g. cam piece 82*c*) using the position controlled motor. The brake assembly 70*a* is capable of applying a variable braking force to the supply spool support via the attached brake disc 74. Within this context, variable braking force may be taken to mean a range of braking forces, not merely a first braking force when the brake assembly is in a brake engaged position and a second lesser braking force when the brake assembly is in a brake disengaged position. For example, controlling the position controlled motor such that, in the context of FIG. 19, it causes the cam piece 82*c* to be rotated anti-clockwise will increase the braking force on the spool support, whereas controlling the position controlled motor such that the cam piece 82*c* is rotated clockwise will result in a reduced braking force applied to the spool support. It will be appreciated that within the embodiment shown in FIG. 19, if the cam piece 82*c* were rotated by more than about 90° clockwise or anti-clockwise from the initialisation position shown in FIG. 19, then the situation will be reversed (whilst the cam piece 82*c* is rotated by more than about 90° clockwise or anti-clockwise from the initialisation position)—i.e. further clockwise movement will result in increased braking force and anti-clockwise movement will result in decreased braking force.

Although within the previously described embodiment the first braking surface is the outside diameter of the brake disc 74 and the second braking surface is the surface of the brake belt 76, which can contact the brake disc, in other embodiments the first and second braking surfaces may be any appropriate first and second braking surfaces provided that when the first and second braking surfaces are urged into contact (or together, or towards one another) via the position controlled motor, friction between the first and second braking surfaces thereby producing the braking force. For example, the second braking surface may, in some embodiments, not be a brake belt—for example, it may be a brake pad, brake shoe etc. Likewise, the first braking surface may not form part of a brake disc. Any appropriate cooperating first and second braking surfaces and corresponding braking method may be used.

A resilient biasing member (which in this embodiment is a spiral spring 82*e*, but may be any other appropriate resilient biasing member) biases the shaft 82*d* and attached cam piece 82*c* in a direction such that, within FIG. 19, the shaft 82*d* and cam piece 82*c* are urged in an anti-clockwise direction.

In the illustrated embodiment the spiral spring has a 25.4 mm outer diameter and an 11 mm inner diameter. The spring consists of 4.5 turns of 0.31 mm thick spring steel having a width of 3.20 mm and produces 33.6 Nmm of force at 1.5 turns of deflection from its natural state. Of course, any appropriate type of spiral spring may be used in other embodiments.

The spiral spring 82*e* is fixed at a first, outer end to the mounting block 80*a* by fixing bolt 82*f* and at a second inner end (not shown) to the cam piece 82*c*. The resilient biasing member biases the cam piece 82*c* in a direction to cause the brake belt 76 to contact the outer circumference 88 of the brake disc 74 so as to apply a braking force to the brake disc 74 and therefore resist rotation of the brake disc 74 and attached spool support. The biasing of the cam by the resilient biasing member (and hence the biasing of the brake belt towards the brake disc) ensures that when no power is supplied to the position controlled motor (for example when the labelling machine is powered down), the resilient biasing member causes a braking force to be applied to the brake disc 74 and hence the spool support. This may help to prevent the spool support from undesirably rotating when the labelling machine is powered down.

During use of the labelling machine, if it is desired to reduce the amount of braking force applied by the brake belt 76 to the brake disc 74 (and hence to the spool support) the position controlled motor is energised such that the biasing force produced by the resilient biasing member is overcome in order to enable rotation of the cam in a clockwise direction as shown in FIG. 19.

As previously discussed, by controlling the position controlled motor such that the rotary position of the shaft 82*d* and attached cam piece 82*c* is controlled, the amount of braking force applied to the spool support via the brake disc 74 can be varied. A position controlled motor controller may be used to control the position of the position controlled motor and hence the position of the cam piece 82*c* to thereby control the braking force. The position controlled motor controller may be configured such that it is programmed with a position which corresponds to a maximum braking force to be applied and a position which corresponds to a minimum braking force to be applied. In such embodiments, in order to control the braking force applied by the braking assembly, the position controlled motor is controlled such that, as required, its position is the position which corresponds to the maximum braking force; its position is the position which corresponds to the minimum braking force; or its position is between these two positions.

In some embodiments, the cam piece 82*c* may be urged in a direction by a resilient biasing member which urges the brake assembly to apply a braking force to one of the spool supports as previously discussed. The resilient biasing member acting on the cam may define a bias force defined maximum braking position of the cam and attached motor. The bias force defined maximum braking position corresponds to the position of the cam piece and attached motor when the resilient biasing member applies a given biasing force to the cam piece when the motor of the braking assembly is de-energised.

The position controlled motor controller may be programmed with the angular distance between a maximum braking position (for example the bias force defined maximum braking position, although any appropriately defined maximum braking position may be used) and a minimum braking position of the position controlled motor. The angular distance may, for example, be a number of encoder pulses produced by a servo motor or a number of steps of a stepper motor. However, any appropriate parameter may be programmed into the controller which corresponds to the angular distance between the maximum braking position and the minimum braking position of the position controlled motor. In such an embodiment, when the machine is started up, the position controlled motor controller will know that the current position of the position controlled motor is a maximum braking position which is equivalent to the bias force defined maximum braking position (because in the powered-down state of the labelling machine the resilient biasing member has biased the cam piece into the bias force defined maximum braking position) and that the minimum braking position of the position controlled motor is substantially a clockwise rotation of the cam piece by said known angular distance between the maximum braking position and the minimum braking position.

For example, if the position controlled motor is a stepper motor, then the position controlled motor controller may be programmed with information about the angular distance between the maximum braking position of the stepper motor and the minimum braking position of the stepper motor in the manner of a known number of motor steps. Of course, the exact number of steps will depend on many variables such as the particular type of stepper motor used, the type of mechanical linkage between the stepper motor and the cam piece, and the geometry of the braking arrangement.

In one embodiment of the present invention, the position controlled motor is a stepper motor. In this embodiment the stepper motor has 200 full steps per complete rotation. The stepper motor is driven by a stepper motor driver such that it is microstepped, as is well known in the art. In this embodiment each full step is split into 8 microsteps. Therefore, in this embodiment, there are 1600 microsteps per complete rotation. Other embodiments may utilise a stepper motor which has any appropriate number of steps/microsteps per full rotation.

The cam piece 82*c* may be urged towards a bias force defined maximum braking position by a resilient biasing member as previously discussed. When the labelling machine (and hence stepper motor) is in a powered off state the cam piece and attached stepper motor will be biased into the bias force defined maximum braking position by the resilient biasing member. When the labelling machine (and hence stepper motor) is energised from the powered off state the cam piece and stepper motor will enter the initialisation position as shown in FIG. 19. The initialisation position may be slightly different to the bias force defined maximum braking position. The reason for this is that, when energised, the stepper motor rotor will move from the bias force defined maximum braking position to the closest stable position of the stepper motor rotor relative to the stepper motor stator. This may result in a movement between the bias force defined maximum braking position and initialisation position of up to 2 steps (equivalent to 16 microsteps in this case) either clockwise or anticlockwise. In order to compensate for the fact that in the initialisation position the cam may cause the brake belt to apply a braking force which is less than the bias force defined maximum braking force, upon initialisation the controller commands the stepper motor to rotate 2 steps (16 microsteps) anticlockwise (as shown in FIG. 19) from the initialisation position. This position may be referred to as the compensated maximum braking position. The controller stores this position as the position of the stepper motor which corresponds to maximum applied braking force. The controller also sets the position of the stepper motor which corresponds to minimum applied braking force to be 355 microsteps clockwise rotation from the position of the stepper motor which corresponds to maximum applied braking force.

It will be appreciated that the compensated maximum braking position (and hence compensated maximum braking force) will be the same as the bias force defined maximum braking position in the case where the initialisation position is 2 steps clockwise of the bias force defined maximum braking position. Otherwise, if the initialisation position is 1 step clockwise of the bias force defined maximum braking position, the same as the bias force defined maximum braking position, or 1 or 2 steps anti-clockwise of the bias force defined maximum braking position, then the compensated maximum braking position will be anti-clockwise of the bias force defined maximum braking position, and hence the braking force at the compensated maximum braking position may be greater than the braking force at the bias force defined maximum braking position. In the case that the position controlled motor is a stepper motor, the position controlled motor controller may include a stepper motor driver. Where the position controlled motor is another type of motor, the person skilled in the art will appreciate that the position controlled motor controller will include appropriate drive apparatus for the relevant type of motor.

The position controlled motor controller may replace the solenoid armature position control scheme 204 within the dancing arm position control algorithm shown schematically in FIG. 17 (or supply speed control algorithm in FIG. 17*a*). The constants $K_{P2}$, $K_{I2}$, and $K_{D2}$ within the dancing arm position control algorithm (or constants $K_{P3}$, $K_{I3}$, and $K_{D3}$ within the supply speed control algorithm in FIG. 17*a*) may be suitably adjusted to ensure that the set point value SP(t) provided to the position controlled motor controller fall within a suitable range for the position controlled motor controller. The position controlled motor controller may then be configured to convert the set point signal SP(t) into a desired position of the position controlled motor which is between the maximum braking position and minimum braking position. For example, in one embodiment $K_{P2}$=0.6, $K_{I2}$=0.005, and $K_{D2}$=0.6.

In general terms, in a known dancing arm position control algorithm, the dancing arm position control algorithm will co-operate with the position controlled motor controller such that if the dancing arm position is different to the desired dancing arm position, the position controlled motor controller will actuate the braking assembly in order to try to move the dancing arm towards to desired dancing arm position. In general, the greater the difference between the dancing arm position and the desired dancing arm position, the greater the magnitude of the change in dancing arm position that the position controlled motor controller will effect in order to attempt to correct the dancing arm position. For example, if the position controlled motor is a stepper motor, the greater the difference between the dancing arm position and the desired dancing arm position, the greater the number of steps the position controlled motor controller will effect in a given time in order to attempt to correct the dancing arm position.

It will be appreciated that the exact behaviour of the position controlled motor controller will be determined by the dancing arm position control algorithm.

In general terms, in the supply speed control algorithm, the supply speed control algorithm will co-operate with the position controlled motor controller such that if the supply speed is different to the desired supply spool speed, the position controlled motor controller will actuate the braking assembly in order to try to maintain the supply spool speed at the target supply spool speed, or, if the supply spool speed differs from the target supply spool speed, allow the supply spool to accelerate or decelerate towards the target supply spool speed. In some embodiments, the greater the difference between the supply spool speed and the target supply spool speed, the greater the magnitude of the change in supply spool speed that the position controlled motor controller will effect in order to attempt to correct the supply spool speed. For example, if the position controlled motor is a stepper motor, the greater the difference between the supply speed and the target supply speed, the greater the number of steps the position controlled motor controller will effect in a given time in order to attempt to correct the supply spool speed. It will be appreciated that the exact behaviour of the position controlled motor controller will be determined by the supply speed control algorithm.

In embodiments of the invention in which the braking assembly includes a position controlled motor in the form of a stepper motor, the controller may be configured such that it implements a control scheme for controlling the stepper motor which reduces the likelihood of the stepper motor stalling and thereby preventing operation of the braking assembly. Such a control scheme may include any number of the following aspects. First, a 'start delay' may be used which prevents the stepper motor from executing a step until a predetermined amount of time has passed from the motor coils of the stepper motor being energised. This helps to ensure that the motor is in a steady state before it starts operating. In some embodiments the predetermined amount of time is 2 ms, but any appropriate time may be used in other embodiments. Secondly, a turn-around delay may be implemented. This prevents the stepper motor from executing a step in the opposite direction to that in which the motor is currently travelling within a predetermined amount of time of the previous step. In some embodiments the predetermined amount of time is 5 ms, but any appropriate time may be used in other embodiments.

FIG. 26 shows a view of a modification to the braking assembly shown in FIGS. 18 to 20. The similarities and differences between this modification and the braking assembly shown in FIGS. 18 to 20 will be most readily discerned by comparing FIG. 26 with FIG. 19. Within the braking assembly shown in FIGS. 18 to 20, the purpose of the spiral spring is to apply tension to the brake belt 76, thus causing the brake belt 76 to apply a braking force to the brake disc 74. In the modification shown in FIG. 26, the spiral spring of the braking assembly shown in FIGS. 18 to 20 is replaced with two tension springs 82*g*. Each tension spring 82*g* is anchored at one end to the mounting block 80*a* and is fixed at its other end to a moveable plate 82*h*. The movable plate 82*h* is mounted to the second end 76*b* of the brake belt 76 via an end piece 82*j*. In an equivalent way to the coil spring of the brake assembly shown in FIGS. 18 to 20 applying tension to the belt via the cam piece and end piece, the tension springs 82*g* apply tension to the brake belt 76 via the plate 82*h* and end piece 82*j*. One advantage of the modification shown in FIG. 26 is that the coils of the tension springs do not contact each other (as compared with the spiral spring embodiment in which the spring coils tend to rub against each other due to the torque produced in the spring). Any appropriate tension spring may be used. In one embodiment both springs are having part number 2010 supplied by Entex Stock Springs, Nottingham, UK.

As previously discussed, the brake assembly 70*a* is configured such that in a powered down state of the labelling machine the brake assembly applies a braking force to the spool support such that the spool support and supported spool is substantially prevented from rotating. In some situations it may be desirable to provide a manual override for the brake assembly which enables a user to manually reduce the braking force applied by the brake assembly whilst the machine is in a powered-down state. For example, if the spool support which is braked by the braking assembly is the supply spool support, and if it is desired to mount a new roll of label stock to the supply spool support whist the machine is powered off, it may be beneficial for the supply spool support and attached supply spool to be able to rotate so that the label stock can be mounted on the supply spool, pulled from the supply spool, fed along the label path and then attached to the take up spool support.

FIG. 20 shows an arrangement which enables the braking force applied by the braking assembly to be manually reduced whilst the labelling machine is in a powered down state. In this embodiment the dancing arm 28*a* includes a brake release arm 28*b* which is attached to the dancing arm 28*a* such that the brake release arm 28*b* co-rotates with the dancing arm 28*a*.

A brake release catch 28*c* is mounted on the shaft 82*d* which supports the cam piece 82*c* (the cam piece is not shown in FIG. 20, but located on the other side of the mounting block 80*a* to the brake release catch 28*c*). In the present embodiment the shaft 82*d* is the shaft of the position controlled motor. The shaft 82*d* extends out of both ends of the position controlled motor such that the cam piece 82*c* is mounted to the portion of the shaft 82*d* which extends out of a first end of the position controlled motor (and which in this case is on a first side of the mounting block 80*a*), and such that the brake release catch 28*c* is mounted to a portion of the shaft 82*d* which extends out of a second end (opposite to the first end) of the position controlled motor (and which in this case is on a second side (opposite the first side) of the mounting block 80*a*).

It will be appreciated that, whilst in this embodiment the brake release catch is mechanically linked to the second braking surface via the shaft 82*d*, cam piece 82*c* and end piece 82*a*, in other embodiments the brake release catch may be mechanically linked to the second braking surface in any appropriate manner. For example, in some embodiments the second braking surface may not be mechanically linked to a position controlled motor and the brake release catch may be mechanically linked to the second braking surface by another method. The brake release arm 28*b* and brake release catch 28*c* are configured such that when the dancing arm 28*a* is rotated clockwise as shown in FIG. 20 beyond a certain position, the brake release arm 28*b* engages the brake release catch 28*c*. Once the brake release arm 28*b* and brake release catch 28*c* are engaged, further clockwise rotation of the dancing arm 28*a* causes the brake release catch 28*c* to rotate the shaft 82*d* in anti-clockwise direction as shown in FIG. 20. This causes the brake release catch 28*c* to rotate the shaft 82*d* in an anti-clockwise direction as shown in FIG. 20. Referring now to FIG. 19, rotation of the shaft 82*d* within FIG. 20 in an anti-clockwise direction as shown in FIG. 20 will result in the cam piece 82*c* within FIG. 19 rotating in a clockwise direction as shown in FIG. 19, thereby reducing tension in the brake belt 76 and hence releasing the brake, reducing the braking force applied by the brake assembly to the spool support. It follows that, using the brake release arrangement shown in FIG. 20, if an operator wants to release the braking force applied by the braking assembly, this can be achieved by the operator rotating and holding the dancing arm in a clockwise direction as shown in FIG. 20 such that the brake release arm 28*b* and brake release catch 28*c* engage so as to cause the braking force applied by the brake assembly to be released as previously discussed. In some embodiments the dancing arm may be rotated and held in a clockwise direction as shown in FIG. 20 by the action of a user passing label web from a new supply spool mounted to the supply spool support around the dancing arm and the user pulling the label web along the web path to the take up spool support. In this way, when a user is feeding label web along the web path to the take up spool support from a newly mounted supply spool, the brake assembly is automatically released thereby enabling the supply spool support to pay out label web from the supply spool.

Although the above described braking assembly utilises a position controlled motor, in other embodiments any appropriate type of motor may be used, providing the control scheme for its operation is suitably modified. For example, in some embodiments a torque controlled motor such as a DC motor may be used. In such an embodiment, as is well known in the art, the amount of braking force applied by the motor is proportional to the current supplied to the motor. Consequently, the control scheme for such an embodiment may be configured such that the current supplied to the motor is a function of the braking force required. For example, the output of the dancing arm position control algorithm (or supply spool speed control algorithm) may be a current determined by the dancing arm position control algorithm (or supply spool speed control algorithm) which is provided to the motor.

Furthermore, in the above described braking assembly movement of the motor is transmitted to the brake belt via a cam. In other embodiments any appropriate apparatus may be used for transmitting movement of the motor to the brake belt (or any suitable second braking surface). For example, the motor may be linked to a crank which is moved by the motor so a portion of the brake belt is wound on to the crank or unwound from the crank by the motor in order to urge the second braking surface towards the first braking surface (or otherwise) and thereby control the braking force applied to the spool support.

It will be apparent from the foregoing description that the various features described can be used alongside one another in a single labelling machine. That is, unless the context otherwise requires, or unless explicitly stated to the contrary herein, it is envisaged that the features described can advantageously be used in a single labelling machine to realise the various benefits described herein. That said, it will also be appreciated that many of the features described herein can be used separately of one another and as such a labelling machine including one or more (but not necessarily all) of the features described herein is envisaged.

Where a labelling machine including various features described above is implemented, the following processing, as illustrated in FIG. 21, may be carried out at start-up of the labelling machine.

At S1 the controller determines the position of the dancing arm 28. In order to do this the controller sends a control signal to the position controlled motor so as to energise the position controlled motor to rotate the shaft 82*d* and attached cam piece 82*c* in a clockwise direction (as shown in FIG. 19), to the extent that substantially no braking force is applied by the brake belt 76 to the brake disc 74. Alternatively, the controller sends a control signal to the solenoid so as to energise the solenoid such that sufficient current is provided to the coil of the solenoid 94 to move the armature 92 of the solenoid 94 in the direction F to the extent that substantially no braking force is applied by the brake belt 76 to the brake disc 74.

Consequently, the supply spool support 10 (and the supported supply spool) is free to rotate.

Whilst the supply spool support 10 is free to rotate, the force provided by spring 130 on the dancing arm 28 is sufficient to rotate the dancing arm 28 about axis A in the direction G. In order to enable the dancing arm 28 to rotate about axis A in the direction G the supply spool support 10 may also rotate about axis A in the direction G (as previously discussed, the supply spool support 10 is free to move because the brake assembly is not applying a braking force to the supply spool support). The dancing arm 28 rotates about axis A in the direction G until it reaches the home position which is detected by the home position sensor. Processing passes from step S1 to step S2.

At steps S2 to S4 the controller determines the diameter of the take up spool supported by the take up spool support 12.

At S2 the controller places the supply spool support brake assembly under the control of the dancing arm position control algorithm, as described in relation to FIG. 17 (or under the control of the supply spool speed control algorithm, as described in relation to FIG. 17*a*). For example, applying the dancing arm control algorithm (or applying the supply spool control algorithm), the controller may supply a control signal to the position controlled motor and attached cam piece 82*c* which will act to apply the brake fully, until such a time as the dancing arm moves from the home position beyond the set point. This allows tension to be introduced into the label web. Alternatively, in embodiments including a solenoid, the controller sends a control signal to the solenoid 94 (and more particularly to the coil driver 114) such an amount of current (which may be no current) is provided to the coil of the solenoid 94 in order for the armature 92 of the solenoid 94 to move sufficiently in the direction F' such that the brake is applied fully, until such a time as the dancing arm moves from the home position beyond the set point. Again, this allows tension to be introduced into the label web.

The label stock is then tensioned as follows. At step S3 the controller energises the motor 14 so that it rotates the take up spool support 12 to wind web of the label stock on to the take up spool support 12. As this happens, the tension in the web of the label stock increases. Increasing tension in the web of the label stock causes the web of the label stock to apply greater force to the roller 32 of the dancing arm 28. The force applied by the label stock to the dancing arm opposes the spring biasing of the dancing arm 28 in the direction G by the spring 130. Consequently, increasing tension in the label stock due to rotation of the take up spool support causes the dancing arm 28 to move in the opposite direction to G. As previously discussed, the position of the dancing arm 28 is indicative of the tension in the label stock. When the controller is provided with a signal from the sensor which senses the position of the dancing arm which indicates that the dancing arm is at a desired position which is equivalent to a desired tension, processing then advances to step S4. In some embodiments the desired tension is a predetermined or calculated tension. In other embodiments the desired tension may be any appropriate tension other than no tension—that is to say, the desired tension may be any appropriate tension which removes slack from the label stock.

At step S4 the controller commands the motor 14 to rotate a given number of steps (for example 50-150 steps) so as to wind more label stock on to the take up spool support 12. This causes the dancing arm 28 to move from its position at the beginning of S4. Based upon the number of commanded steps the motor 14 advances in step S4 and on the movement of the dancing arm 28 detected by the dancing arm movement sensor (also referred to as the sensor configured to produce a sensor signal indicative of the position of the moveable element) during the rotation of the motor 14 the controller calculates the diameter of the spool supported by the take up spool support 12. This process has been discussed in detail above.

At S5 the controller determines the pitch length $L_P$ of the label stock 18. This is achieved as follows. In this embodiment, this is done with the supply spool support brake assembly under control of the dancing arm position control algorithm (or supply spool speed control algorithm), although in other embodiments this need not be the case. For example, in other embodiments the pitch length of the label stock may be determined with the brake assembly released (i.e. not applying a braking force). Again, in order to release the brake assembly, the controller sends a control signal to the solenoid 94 (and more particularly to the coil driver 114) such that sufficient current is provided to the coil of the solenoid 94 to move the armature 92 of the solenoid 94 in the direction F to the extent that substantially no braking force is applied by the brake belt 76 to the brake disc 74. Consequently, the supply spool support 10 (and the supported supply spool) is free to rotate.

The controller advances the motor which drives the take up spool support. The controller also monitors the signal 56 provided by the detector 52 of the gap sensor. The controller counts the number of steps the motor 14 is commanded to advance whilst a label is sensed and, as previously described, uses this information and the diameter of the spool supported by the take up spool support (determined in step S4) to determine the length of a label $L_L$. Likewise, the controller counts the number of steps the motor 14 is commanded to advance whilst a gap is sensed and, as previously described, uses this information and the diameter of the spool supported by the take up spool support (as determined in step S4) to determine the length of a gap $L_G$. The controller then sums $L_P$ and $L_G$ in order to calculate $L_P$.

In some embodiments, the controller may count the number of steps the motor 14 is commanded to advance whilst a plurality of labels and gaps are sensed by the detector of the gap sensor. The controller may then work out the label length, gap length and/or pitch length by averaging the measured label length, gap length and/or pitch length. For example, the controller may count the number of steps the motor 14 is advanced whilst the controller monitors the signal 56 and senses that a total of three labels and three gaps have passed the gap sensor. The controller may then divide the number of steps counted by the controller by three to give the average pitch length $L_P$ of the labels as a number of steps. This average pitch length of the labels given in steps can then be used in combination with the measured diameter of the take up spool in order to determine the label pitch in a desired unit.

In some embodiments in which the controller counts the number of steps the motor is commanded to advance whilst a plurality of labels and gaps are sensed by the detector of the gap sensor, the controller may count the number of steps whilst the motor is commanded to advance a number of steps which is at least a determined number of steps which is equivalent to a predetermined length of label stock. The controller may determine the determined number of steps $N_S$ using the diameter of the take up spool (which may be obtained in any manner discussed within) and the predetermined length of label stock $L_{LP}$ according to the equation:

$$N_S = \frac{2L_{LP}}{A_S D_S} \tag{19}$$

where $A_S$ is the angle by which the spool support rotates per step of the motor and $D_S$ is the spool diameter.

The predetermined length of the label stock is preferably in excess of twice the greatest pitch length of label stock that will be utilised by the labelling machine. The predetermined length of label stock may be 300 mm.

In other embodiments the take up spool diameter may be determined at step S4 and the label pitch length may be determined at step S5 using the print roller encoder.

For example, the take up spool diameter may be determined at step S4 as follows. The controller may energise the motor 14 to rotate so as to wind more label stock on to the take up spool support 12. The controller may be energised so as to wind a predetermined length of label stock on to the take up spool support 12 as measured by the print roller encoder. The controller monitors the number of steps of the motor 14 which are required to wind the predetermined length of label stock on to the take up spool support 12. The controller then calculates the take up spool diameter based upon a knowledge of the number of steps of the motor 14 required for the motor to complete a single revolution, the length of the predetermined distance, and the number of steps the motor 14 executes in winding the predetermined length of label stock on to the take up spool support 12.

In other embodiments the controller may be energised so as to rotate the motor 14 by a predetermined number of steps so as to wind label stock on to the take up spool support 12. The controller monitors the length of label stock wound on to the take up spool support 12 measured by the print roller encoder whilst the motor 14 executes the predetermined number of steps. The controller then calculates the take up spool diameter based upon a knowledge of the number of steps of the motor 14 required for the motor to complete a single revolution, the predetermined number of steps the motor 14 executes, and the length of label stock wound on to the take up spool support 12 measured by the print roller encoder whilst the motor 14 executes the predetermined number of steps.

The label pitch length may be determined at step S5 using the print roller encoder as follows.

The controller advances the motor which drives the take up spool support. The controller also monitors the signal output by the print roller encoder and the signal 56 provided by the detector 52 of the gap sensor. The controller uses the signal output by the print roller encoder to measure the distance along the web path the label stock moves whilst a label is sensed and hence determines the length of a label $L_L$. Likewise, the controller uses the signal output by the print roller encoder to measure the distance along the web path the label stock moves whilst a gap is sensed and hence determines the length of a gap $L_G$. The controller then sums $L_L$ and $L_G$ in order to calculate $L_P$. In some embodiments the controller may use the signal output by the print roller encoder to measure the distance along the web path the label stock moves between the gap sensor sensing a leading edge of a first label and a leading edge of the subsequent label—this distance is then set by the controller as the pitch length $L_P$ of the label stock 18.

In some embodiments, the controller may use the signal output by the print roller encoder to measure the distance along the web path the label stock moves whilst a plurality of labels and gaps are sensed by the detector of the gap sensor. The controller may then work out the label length, gap length and/or pitch length by averaging the measured label length, gap length and/or pitch length. For example, the controller may measure the distance along the web path the label stock moves whilst the controller monitors the signal 56 and senses that a total of three labels and three gaps have passed the gap sensor. The controller may then divide the measured distance by three to give the average pitch length $L_P$ of the labels.

In some embodiments the take up spool diameter may be determined at step S4 and the label pitch length may be determined at step S5 at the same time—i.e. steps S4 and S5 may be carried out at the same time. For example, the controller may determine the pitch length of the label stock as described above by advancing the motor which drives the take up spool support and monitoring the signal output by the print roller encoder and the signal 56 provided by the detector 52 of the gap sensor. The controller may advance the label stock along the label web path such that the signal 56 indicates that one label and gap have passed the gap sensor. The controller may then use signal output by the print roller encoder to determine how far the label stock has advanced along the web path during said advancement and hence determine the pitch length of the label stock. At the same time, whilst the label stock has been advanced along the web path, the controller counts the number of steps the motor has executed to produce the advancement of the label stock. The controller then calculates the diameter of the take up spool based upon the number of steps of the motor 14 required for the motor to complete a single revolution, the distance the label stock has advanced along the web path during said advancement as measured by the print roller encoder, and the number of steps the motor 14 has executed in producing said advancement of the label stock along the label web path used to determine the pitch length of the label stock. In some embodiments, the controller may advance the label stock along the label web path by a distance such that a plurality of labels and gaps have passed the gap sensor—the pitch length is then determined as an average as determined above. The diameter of the take up spool may then be determined using the advancement distance which is equivalent to a plurality of labels and gaps.

In some labelling machines the main source of inaccuracy in measuring the pitch length of the label stock may be the edge detection performance of the gap sensor. For instance the gap sensor may detect edges to within an error of +/−0.25 mm. Therefore the distance between two edges may be measured within an error of +/−0.5 mm. Shorter labels (hence label stock with a shorter label pitch) will have an error which is proportionally larger compared to that of longer labels (hence label stock with a longer label pitch). For this reason, it may be advantageous in certain embodiments to measure the length of a plurality of labels and gaps (as discussed above) and determine an average label length, average gap length and/or average pitch length.

In some embodiments erroneous data regarding measured label length or measured gap length may be rejected whilst determining an average label length, an average gap length and/or an average pitch length.

One potential cause of erroneous data may be missing labels. For example, if a label is missing then it will cause the controller to measure a large gap between the labels either side of where the missing label would have been located, the gap being larger than the standard gap between adjacent labels. It will be appreciated that if the length of such a large gap resulting from a missing label were measured and then averaged in addition to the length of other, standard, measured gaps, then this would result in an incorrect average of greater length than the average length of standard gaps which would otherwise be determined.

In some embodiments erroneous data regarding measured gap length is rejected as follows. The controller monitors the measured gap length for each measured gap. The controller may check that the measured gap length is above a minimum predetermined gap length and/or below a maximum predetermined gap length. In one embodiment the minimum predetermined gap length is 1 mm and the maximum predetermined gap length is 10 mm, however, it will be appreciated that other embodiments may use any appropriate minimum and/or maximum predetermined gap length. If a measured gap length is not greater than the minimum predetermined gap length and/or not less than the maximum predetermined gap length, then such a measured gap length is not included by the controller when determining an average gap length of the label stock and/or an average pitch length of the label stock.

In some embodiments erroneous data regarding measured label length is rejected as follows. The controller monitors the measured label length for each measured label. The controller may check the measured label length and compare it to the measured label length for the preceding measured label. If the difference in length between the measured label length and the measured label length of the preceding measured label is greater than a predetermined amount then the measured label length is not included by the controller when determining an average label length of the label stock and/or an average pitch length of the label stock. In one example the predetermined amount is 50% of measured label length for the preceding measured label. It will be appreciated that in other embodiments the predetermined amount may be any appropriate amount.

In some embodiments erroneous data regarding measured label length is rejected as follows. The controller monitors the measured label length for first measured label after the labelling machine has been switched on. The controller may then check the measured label length and compare it to the measured label length for the subsequent measured label. If the difference in length between the measured label length of the first measured label and the measured label length of the subsequent measured label is greater than a predetermined amount then the measured label length of the first label is not included by the controller when determining an average label length of the label stock and/or an average pitch length of the label stock. In one example the predetermined amount is 50% of measured label length of the subsequent label. It will be appreciated that in other embodiments the predetermined amount may be any appropriate amount.

At step S6 the controller positions the leading edge of a label at the edge of the labelling peel beak 30. This is achieved as follows. The controller monitors the signal 56 provided by the detector 52 of the gap sensor so as to detect the leading edge of a label. The controller then commands the motor 14 to advance a calculated number of steps such that the label stock advances by a linear displacement equal to the distance $D_B$ (as shown in FIG. 3) between the detector 52 and the edge 66 of the labelling peel beak 30. The number of steps is calculated by dividing the distance $D_B$ by the radius of the take up spool and by the rotation angle per step in radians. In other embodiments, once the controller determines from the signal 56 provided by the detector 52 of the gap sensor that the leading edge of a label has been detected, the controller then commands the motor 14 to advance until the distance of advancement of the label stock along the label web path measured by the print roller encoder is equal to the distance $D_B$ between the detector 52 and the edge 66 of the labelling peel beak 30.

At S7 the labelling machine is ready to operate.

During operation, periodically steps S8 and S9 are carried out.

At step S8 the controller calculates and updates the diameter of the spool mounted to the supply spool support 10.

The process of calculating and updating the supply spool diameter is first discussed below in the case where the movable element (dancing arm) does not move during the process. Subsequently, the case where the movable element moves during the process is discussed.

In one embodiment, in order to achieve this, for a given amount of time the controller monitors the signal 56 provided by the detector 52 of the gap sensor. The controller counts the number of periods of the signal 56 during said given time and multiplies this by $L_P$ in order to determine the linear displacement of the label stock during said given time. During said given time the controller also monitors a signal provided to it by a rotation monitoring sensor which monitors the rotation of the supply spool support 10 (and supported supply spool). Hence the controller determines the amount of rotation of the supply spool support 10 (and supported supply spool). As discussed above, the controller can then determine the diameter of the supply spool based upon the linear displacement of the label stock and the amount of rotation of the supply spool support 10 during said given time. The given amount of time may be defined as the time it takes for a predetermined number of periods of the signal 56 to be received by the controller, or may be defined as the time it takes for the supply spool to rotate by a predetermined number of rotations (as measured by the rotation monitoring sensor).

In an alternative embodiment at step S8 the controller calculates and updates the diameter of the spool mounted to the supply spool support 10 as follows. For a given amount of time the controller monitors the amount of rotation of the supply spool support by monitoring the signal produced by the supply spool rotation monitor. For example, the given amount of time may be the time it takes for the supply spool support to undergo an integer number of complete rotations (as measured by the supply spool rotation monitor). During the given amount of time the controller counts the number of steps that the take up motor is commanded to advance. Based upon this information and on the diameter of the take up spool which has been determined by the controller in either step S4 or step S9, the controller can calculate the length of label stock which has been wound on to the take up spool in the given amount of time. In alternative embodiments, the given amount of time may be defined as the time it takes to advance the take up motor a predetermined number of steps, and rotation of the supply spool measured by supply spool rotation monitor during this time may be used to determine the diameter of the supply spool.

In a further embodiment, at step S8 the controller calculates and updates the diameter of the spool mounted to the supply spool support 10 as follows. The supply spool diameter may be determined using the signal output by the print roller encoder and the signal produced by the supply spool rotation monitor. The controller may energise the motor 14 to rotate so as to wind more label stock on to the take up spool support 12. The controller may be energised so as to wind a predetermined length of label stock on to the take up spool support 12 as measured by the print roller encoder. The controller monitors the signal produced by the supply spool rotation monitor to determine the amount of rotation of the supply spool whilst the predetermined length of label stock is wound on to the take up spool support 12. The controller then calculates the supply spool diameter based upon knowledge of the amount of rotation of the supply spool and the predetermined length.

In other embodiments the controller may be energised so as to rotate the motor 14 by a predetermined number of steps so as to wind label stock on to the take up spool support 12. The controller monitors the length of label stock wound on to the take up spool support 12 measured by the print roller encoder whilst the motor 14 executes the predetermined number of steps. The controller also monitors the signal produced by the supply spool rotation monitor to determine the amount of rotation of the supply spool whilst the predetermined number of steps is executed by the motor 14. The controller then calculates the supply spool diameter based upon a knowledge of the length of label stock wound on to the take up spool support 12 measured by the print roller encoder whilst the motor 14 executes the predetermined number of steps, and amount of rotation of the supply spool whilst the predetermined number of steps is executed by the motor 14.

In an alternative embodiment at step S8 the controller calculates and updates the diameter of the spool mounted to the supply spool support 10 as follows. For a given amount of rotation of the supply spool support determined by monitoring the signal produced by the supply spool rotation monitor, the controller monitors the amount of label stock wound on to the take up spool by monitoring the signal output by the print roller encoder. The controller then calculates the supply spool diameter based upon knowledge of the length of label stock wound on to the take up spool measured by the print roller encoder and the given amount of rotation of the supply spool measured by the supply spool rotation monitor. For example, in an embodiment in which the supply spool rotation monitor includes a pair of magnets attached to the spool support and a Hall Effect sensor such that the Hall Effect sensor outputs two pulses for every full rotation of the spool support, as previously discussed, the given amount of rotation of the supply spool discussed above may be a given number of pulses output by the Hall Effect sensor.

During the given amount of time, given amount of rotation of the supply spool, predetermined distance or predetermined number of steps the controller also monitors the position of the dancing arm by monitoring the signal provided to the controller by the sensor configured to produce a sensor signal indicative of the position of the moveable element (dancing arm). By comparing the position of the dancing arm at the beginning of the given amount of time, given amount of rotation of the supply spool, predetermined distance or predetermined number of steps, and at the end of the given amount of time, given amount of rotation of the supply spool, predetermined distance or predetermined number of steps, as discussed above, the controller can determine the change in path length between the supply spool support and take up spool support which has occurred between the beginning of the given amount of time, given amount of rotation of the supply spool, predetermined distance or predetermined number of steps, and the end of the given amount of time, given amount of rotation of the supply spool, predetermined distance or predetermined number of steps. The controller then adds the change in path length (which is positive if the path length has increased and negative if the path length has decreased) between the supply spool support and take up spool support during the given amount of time to the amount of label stock wound onto the take up spool support during the given amount of time. This gives the amount of label stock which has been unwound from the from the supply spool support during the given amount of time given amount of rotation of the supply spool, predetermined distance or predetermined number of steps. Based upon the amount of rotation of the supply spool support during the given amount of time, given amount of rotation of the supply spool, predetermined distance or predetermined number of steps and on the amount of label stock which has been unwound from the supply spool support during the given amount of time the controller can determine the diameter of the supply spool.

At step S9 the controller calculates and updates the diameter of the spool mounted to the take up spool support 12. In one embodiment, in order to achieve this, for a given amount of time the controller monitors the signal 56 provided by the detector 52 of the gap sensor. The controller counts the number of periods of the signal 56 during said given time and multiplies this by $L_P$ in order to determine the linear displacement of the label stock during said given time. For example, the given time may be such that the number of periods of the signal 56 during said given time is an integer number between 1 and 10. However, any appropriate given time may be used. During said given time the controller also counts the number of steps that the motor 14 is commanded to take. Hence the controller determines the amount of rotation of the take up spool support 12 (and supported supply spool). As discussed above, the controller can then determine the diameter of the take up spool based upon the linear displacement of the label stock and the amount of rotation of the take up spool support 10 during said given time.

In some embodiments the given amount of time the controller monitors the signal 56 provided by the detector 52 of the gap sensor may be the time it takes the label web to advance a predetermined linear distance. The predetermined linear distance is preferably in excess of twice the greatest pitch length of label stock that will be utilised by the labelling machine. The predetermined length of label stock may be 300 mm.

In other embodiments, at step S9, the controller calculates and updates the diameter of the spool mounted to the take up spool support 12 using the print roller encoder in the same manner as discussed in relation to step S4.

In some embodiments, such as those which do not include an encoder measuring movement of the label stock using an encoder which measures rotation of a print roller, the controller may determine the take up spool diameter and then wait until the take up spool has subsequently completed one rotation before re-determining the take up spool diameter. Likewise, in some embodiments the controller may determine the supply spool diameter and then wait until the supply spool has subsequently completed one rotation before re-determining the supply spool diameter.

In order to determine whether the take up spool has completed one rotation, the controller may wait for the take up motor to execute the number of steps equal to that for a complete rotation. Alternatively, the controller may use the determined diameter of the take up spool to determine the circumference of the take up spool. The controller can then monitor the signal output by the printer roller encoder to determine when the distance moved by the label stock along the label web path is equal to the determined circumference.

In order to determine whether the supply spool has completed one rotation, the controller may monitor the supply spool rotation monitor to determine when the supply spool has completed a rotation. Alternatively, the controller may use the determined diameter of the supply spool to determine the circumference of the supply spool. The controller can then monitor the signal output by the printer roller encoder and the movable element (e.g. dancing arm) position sensor to determine when the distance of label stock unwound from the supply spool is equal to the determined circumference.

In some embodiments determination of the supply spool diameter at step S8 may occur concurrently with at least one of steps S3, S4, S5 and S6.

Whilst the controller calculates and updates the diameter of the spool mounted to the take up spool support 12 the controller may carry out checks to detect erroneous data regarding measured label length or measured gap length. If any erroneous data is detected then the process of calculating and updating the diameter of the spool mounted to the take up spool support 12 may be aborted (such that no update of the diameter is carried out based upon the erroneous data). Subsequently, process of calculating and updating the diameter of the spool mounted to the take up spool support 12 is restarted (such that an update can be carried out without being affected by erroneous data). The controller may detect the presence of erroneous data in any appropriate manner. For example, the controller may detect the presence of erroneous data in any of the manners discussed above in relation to step S5.

In some embodiments, the start-up procedure may include a check to see whether the dancing arm position changed while the machine was powered off. In order to do this the controller uses the sensor configured to produce a sensor signal indicative of the position of the moveable element to measure and record the position of the movable element before the machine is switched off. Subsequently, when the machine is switched on, the controller uses the sensor configured to produce a sensor signal indicative of the position of the moveable element to measure the position of the movable element and compare it to the position of the movable element recorded before the machine was switched off. If the position of the movable element is substantially the same when the machine is switched on compared to when it was switched off then certain steps within the above start-up routine may be omitted. For example, steps S2 to S4, S3 to S5, S3 to S6 or S3 to S4 may be omitted. In this case the labelling machine may resume operation using the last known value (i.e. before the machine was switched off) of the take-up spool diameter. This is based upon the assumption that the label stock cannot move (thereby changing the diameter of the spools) without changing the position of the movable element (e.g. dancing arm). The purpose of omitting unnecessary steps is to reduce start-up time which may be beneficial in some applications. In some embodiments data indicative of the position of the movable element, the diameter of the take up spool and/or any other appropriate parameter may be stored in a battery-powered memory or any other suitable non-volatile memory. In some embodiments, data indicative of position of the movable element may be updated to the memory every time movement of the arm is detected by the controller. In other embodiments data indicative of the position of the movable element, the diameter of the take up spool and/or any other appropriate parameter may be updated to the memory at a suitable regular time interval.

In one particular embodiment, the position of the movable element before the machine is switched off is recorded by recording the sensor signal indicative of the position of the movable element. This enables the controller to determine the position of the movable element relative to the home position. Subsequently, when the machine is switched on, the dancing arm is allowed to return to the home position where it is detected by the home position sensor as previously discussed. The controller is configured to monitor the sensor signal indicative of the position of the movable element so as to determine the amount of movement of the dancing arm between its position when the labelling machine is switched on and when dancing arm reaches the home position. A comparison between the position of the dancing arm relative to the home position when the labelling machine is switched off is made with the amount of movement of the dancing arm from its position when the labelling machine is switched on in order to reach the home position. If these quantities are substantially the same, then the position of the movable element when the machine was switched off is substantially the same as the position of the movable element when the labelling machine was switched on. In this situation, as set out above, certain steps within the start-up routine may be omitted.

In some embodiments the controller may determine the position of the dancing arm as set out in step S1 above (see FIG. 21) in a slightly different manner. In this method, the controller sends a control signal to the position controlled motor so as to energise the position controlled motor to rotate the shaft 82*d* and the attached cam piece 82*c* in an anticlockwise direction (as shown in FIG. 19), to the extent that the maximum braking force is applied by the brake belt 76 to the brake disc 74. Alternatively, in embodiments in which the braking assembly includes a solenoid of the type previously discussed, the controller sends a control signal to the solenoid so as to de-energise the solenoid so that the armature 92 of the solenoid is moved in the direction F' to the extent that the maximum braking force is applied by the brake belt 76 to the brake disc 74.

Consequently, the supply spool support 10 (and the supported supply spool (is substantially prevented from rotating.

Whilst the supply spool support 10 is substantially prevented from rotating, the take up motor is commanded to advance in a reverse direction (i.e. such that it allows label stock to be removed from the take up spool). The force provided by the spring 130 on the dancing arm 28 is sufficient to enable the dancing arm 28 to rotate about axis A in the direction G (also T') towards the home position as the take up motor is energised in the reverse direction so as to place label stock from the take up spool into the web path. As the take up motor is energised in the reverse direction, the dancing arm 28 rotates in direction G until it reaches the home position which is detected by the home position sensor. As discussed above, the start-up procedure may include a check to see whether the dancing arm position changed whilst the machine was powered-off. In order to do this, the controller uses the sensor configured to produce a sensor signal indicative of the position of the movable element to measure and record the position of the movable element before the machine is switched off. Subsequently, when the machine is switched on, the controller uses the sensor configured to produce the sensor signal indicative of the position of the movable element to measure the position of the movable element and compare it to the position of the movable element recorded before the machine was switched off. This is achieved by measuring the change in position of the dancing arm which occurs between the position of the dancing arm when labelling machine is switched on and the position of the dancing arm when it is at the home position as sensed by the home position sensor. In order to measure this distance, the controller monitors the sensor signal indicative of the position of the movable element as the dancing arm moves from its position when the machine is switched on to the home position (due to reverse rotation of take up spool). As previously discussed, if the position of the movable element is substantially the same when the machine is switched on as compared to its position when the machine is switched off, then certain steps within the above start-up routine may be omitted.

If the position of the movable element is substantially the same when the machine is switched on as compared to when it was switched off, then the labelling machine resumes normal operation as follows. The controller controls the take up motor to advance the label stock in the forward direction by the same amount as that rotated by the take up spool in the reverse direction when the dancing arm was moved to the home position. In this way, providing the labelling machine was switched off when the dancing arm is at the set point position and with an edge of a label of the label stock at the peel beak, once the controller has commanded the take up spool to rotate in a forward direction the same amount as it was commanded to rotate in the reverse direction during earlier calibration (i.e. as the dancing arm moved from its position when the machine was powered on to the home position), the dancing arm will once again be at the set point position and the label edge will once again be at the peel beak. Because the label web is advanced to its original position when the labelling machine was switched off/on, as previously discussed, the label web will pull the dancing arm back to the set point position. The labelling machine is therefore ready to operate in a condition in which the label stock has an acceptable tension in it for operating the labelling machine (e.g. for the peel beak to work correctly and, in the case of a print and apply labelling machine, for the print quality on the labels of the label stock to be acceptable).

One benefit of calibrating the machine using this alternative method of determining the dancing arm position (step S1) is that because label stock is reverse fed to determine the dancing arm position at switch on (as opposed to forward fed in the first method of determining dancing arm position discussed above), no label stock is wasted in determining dancing arm position. This is because, the label stock will be at the same position along the label web path when the dancing arm has been moved back to a position at which there is sufficient tension in the label stock. In contrast, if the first method of determining the position of the movable element discussed above is used, the label stock will have to subsequently be advanced along the label web path in order to sufficiently tension the label stock for operation of the labelling machine (e.g. such that the tension in the label stock is greater than the minimum tension value). The labels on the portion of the label stock which is advanced along the web path in order to sufficiently tension the label stock may therefore be wasted (because it will not be possible for them to be applied and/or printed).

If the position of the movable element when the machine is switched on is different to that when the machine is switched off, then before the other calibration steps are carried out (i.e. before proceeding to step S2) the controller still controls the take up motor to rotate it forward by approximately the same amount as the take up motor was rotated when it was being rotated in the reverse direction (as the dancing arm moved from its position at switch on to the home position). However, the controller controls the take up motor such that the label web stops short of its position when the machine was powered-on by a distance equal to the distance between the gap sensor and the edge of the labelling peel beak ($D_B$). This ensures that if there were an edge between the gap sensor and the peel beak edge when the labelling machine was switched on, then this edge can be used as part of the calibration process because it will now be located upstream of the gap sensor (as opposed to downstream if the label web had been returned to its position when the labelling machine was switched on). This may provide a small reduction in the time required to calibrate the labelling machine.

When checking whether the position of the movable element is substantially the same when the machine is switched on as compared to when it was switched off, in some embodiments the labelling machine may include an additional check to determine whether another condition of the labelling machine upon being switched on is the same as that when the labelling machine was switched off. This may be useful in a situation in which the condition of the labelling machine between the labelling machine being switched off and switched on is different (for example, the label stock has been changed), but for some reason the position of the movable element (e.g. dancing arm) is substantially the same. For example, in some embodiments the diameter of the take up spool may be measured using any of the methods set out above during the rotation of the take up spool in the reverse direction. This measured diameter of the take up may then be compared by the controller to the last known diameter of the take up spool before the labelling machine was switched off. If the diameter of the take up spool measured during the driving the take up spool in the reverse direction differs from the last known diameter of the take up spool determined by the controller before the labelling machine was switched off by more than a predetermined threshold (for example, about 2%, about 5%, about 10%, or any appropriate threshold) then, regardless of the position of the dancing arm when the labelling machine is switched on, a complete calibration of the labelling machine is carried out (for example, such that none of the steps S1 to S7 in the calibration routine above are omitted, or, put another way, such that all of the steps S1 to S7 are carried out).

In some embodiments the controller is configured such that whilst the alternative dancing arm position determination method of the calibration process is carried out (i.e. in which the take up spool is rotated in reverse), if the controller determines, based on the signal provided to it by the dancing arm position sensor that the dancing arm is moving away from the home position as opposed to towards it, then this will be indicative of the fact that whilst the labelling machine was switched off the label stock was replaced or re-webbed such that when the labelling machine was switched on there was little or no label web on the take up spool support. In some embodiments, if the controller encounters such a situation, the advancement of the take up spool in the reverse direction is halted, and determination of the dancing arm position is carried out using the first described method for determining dancing arm position (i.e. that in which the braking assembly was placed in the released configuration to enable the supply spool to rotate in order for the dancing arm to move towards the home position). Calibration then proceeds in the normal manner as discussed in relation to steps S1 to S7 above.

In some embodiments in which the take up motor is commanded to advance in a reverse direction in order to determine the dancing arm position (step S1), determination of the take up spool diameter (step S4) may be carried out concurrently. It has been found that, for certain types of label web, the ability to backfeed (i.e. feed the label web in a reverse direction along the label web path by reversing the take up spool) is reduced. Without wishing to be bound by theory it is though that this reduction in ability to backfeed the label web may be caused by the stiffness of the backing material of the label web as it folds around the peel beak, the frictional properties of the backing material of the label web, or some other reason. In such a case, there is a tendency for an amount of slack to form in the portion of the label web between the peel beak and the take-up spool. This slack may interfere with the measurement of the take up spool diameter during the initial calibration process since the amount (length) of label web passing the label web movement encoder does not correctly correspond to the amount (length) of label web which has been fed off the take-up spool. In order to address this, in some embodiments, the portion of the backfeed during which the determination of the take up spool diameter is carried out may be performed at a relatively low speed. In doing so the above discussed effects may be alleviated and a more accurate measurement obtained. Once the determination of the take up spool diameter has been carried out the backfeed may be continued at a relatively high speed (until the dancer arm reaches its home position—thus ending step S1). Put another way, the portion of the backfeed during which the determination of the take up spool diameter is carried out may be performed at a lower speed than the remaining portion of the backfeed.

In some embodiments a potential problem using the alternative method to determine the dancing arm position (i.e. the method in which the take up spool is advanced in the reverse direction) may occur when the machine has been switched off so as to replace (or re-web) the label stock. In this situation because when the labelling machine is switched on none of the label stock in the web path has previously passed over the label peel beak, the entire length of the label stock from the supply spool to the take up spool may have labels on it. In this situation, if the take up spool is advanced in the reverse direction, causing the label web to advance away from the take up spool and towards the dancing arm and/or supply spool, then label stock having labels on it may be drawn over the labelling peel beak in this (reverse) direction. It is possible that this may cause at least one label to be removed from the label web by the labelling peel beak in the reverse direction and, in the case of a print and apply labelling machines, for the removed label to foul a portion of the printer (for example, the print ribbon and/or printhead).

In order to prevent this, in some embodiments, the controller of the labelling machine is configured to initially advance the take up spool in the reverse direction such that the label web moves a distance along the label web path (as measured, for example, by an encoder on the print roller, but which may be measured in any appropriate manner) which is less than the minimum distance between the peel beak and any portion of the printer which may be fouled by a label. During this period of advancement (which may, for example, be about 15 mm) the controller determines an estimate of the take up spool diameter. This may be calculated using any of the diameter determination methods discussed above (for example, by comparing the amount of rotation of the take up motor and the linear distance moved by the label web along the web path). If the controller determines that the diameter of the take up spool which is determined whilst the take up motor is advanced in the reverse direction differs from the last determined diameter of the take up spool before the labelling machine was switched off by an amount greater than a predetermined threshold (for example, about 1%, about 2.5%, about 5% or any appropriate threshold), then the controller may be configured to cease advancing the take up spool in the reverse direction. This is because a difference in the diameters of the take up spool between when the labelling machine was switched on and when the labelling machine was switched off, is indicative of label stock replacement or re-webbing the labelling machine, and thus there is the potential for a label to be removed from the label web during advancement of the take up spool in the reverse direction which may foul the printer.

In this case, the take up spool may be advanced in the forward direction and calibration carried out using the first described method of determining the dancing arm position at step S1 (i.e. by releasing the supply spool brake).

If, however, it is determined that the diameter of the take up spool after the labelling machine was switched back on is within the predetermined threshold amount of the diameter of the take up spool before the labelling machine was switched off, then calibration using alternative method (i.e. by advancing the take up spool in the reverse direction) may continue.

In some embodiments, due to inaccuracies in making an estimate as to the take up spool diameter using only 15 mm of movement of the label stock along the web path, even if a determination is made at this point that the machine may have had its label stock replaced or may have been re-webbed whilst it was switched off (i.e. because the diameter of the take up spool after the labelling is switched on is determined to be outside of the predetermined threshold of the diameter of the take up spool before the labelling machine was switched off) such that the labelling machine is calibrated using the first method of determining the dancing arm position (in which the supply spool brake is released), a decision as to whether the labelling machine needs to undergo a full recalibration process or not is still made based upon whether the controller determines that the position of the dancing arm is substantially the same when the machine was switched on as compared to when it was switched off.

The any of the calibration steps (S1 to S6) may be carried out at any appropriate speed. In some embodiments at least one of steps S1 to S6 may be carried out at a relatively low speed such as 25 mm/s. The low speed of the label stock along the web path during the calibration may normally result in the labelling machine operating in the low speed mode of operation. However, because it is not known during calibration how long the label stock will be fed along the label web path for, the controller may be configured such that during calibration it does not attempt to determine a changeover point at which the supply spool target speed is modified by the controller from zero to a non-zero value in order to attempt to achieve the dancing arm arriving at the setpoint position as the labelling operation finishes. Instead, the controller may be configured to operate a modified low speed mode of operation whist undergoing calibration. In this modified low speed mode of operation the target supply speed is set to zero (such that the brake substantially prevents the supply spool from moving) while the dancing arm moves from the setpoint position to the mechanical override position. At this point the supply spool target speed is set to a non-zero value (e.g. 50 mm/s) so that the brake is released and the supply spool feeds label stock into the label web path. The dancing arm now changes direction of movement and moves back to the setpoint position. When the dancing arm arrives at the setpoint position the controller is configured to set the target supply spool speed to zero and the cycle repeats until the feeding of label stock for the calibration completes. Once the calibration has completed the controller is configured to modify the target supply spool speed to a non-zero value (e.g. 50 mm/s) such that the brake is released and the dancing arm moves back to the setpoint position, ready for labelling to begin.

In some embodiments, the start-up sequence may be modified compared to that discussed above. For example, in some embodiments the start-up sequence may be modified such that it proceeds in the order S1, S2, S3, S4, S6, S7, S5, S8, S9. Subsequently, as before, steps S7, S8 and S9 then repeat during on-going operation of the machine. In some applications this start-up sequence may be advantageous because by not determining the label pitch until the labelling machine is operating so as to dispense labels on to an article to be labelled this can reduce the time the start-up procedure (e.g. up to the ready to operate state S7) takes to complete and also prevent wastage of labels. This is because, in this embodiment, the labels dispensed whilst determining the label pitch are used by the labelling machine (i.e. applied to articles) as opposed to wasted (i.e. not applied to an article and dispensed only in order to determine label pitch).

The previously described start-up sequence may equally be applied in conjunction with a braking assembly including a solenoid as shown in FIGS. 5 to 11 or in conjunction with a braking assembly including a position controlled motor as shown in FIGS. 18 to 20.

The construction and operation of various embodiments of a labelling machine have been described above. As has been mentioned, such labelling machines may be used to apply labels to articles/products passing on a conveyor of a production line. Having carried out a start-up procedure, for example, as described above, operation of the labelling machine to dispense labels can begin.

The controller determines a linear speed $V_t$ at which the web is to be fed. In some applications it is necessary for this linear speed to match the speed at which a product is conveyed past the labelling machine by a conveyor. The speed at which the product is conveyed past the labelling machine can be provided as an input to the controller from a line encoder. Any appropriate encoder may be used to determine the speed of the conveyor (and hence the speed at which the product is conveyed past the labelling machine). In one example, the line encoder may be attached to a wheel of known diameter which runs against the conveyor such that the linear movement of the wheel matches the linear movement of the conveyor. The line encoder can thus provide details of a distance through which the wheel has turned. Given knowledge of the time taken to travel that distance, the speed of the conveyor can easily be determined.

In alternative applications the speed at which the label stock is to be moved may be input to the controller by an operator, as a manual input.

Operation of the labeler is normally initiated by a product sensor being triggered indicating that a product is approaching the labelling machine. It is preferred that the controller is programmed with a so-called "registration delay". Such a registration delay can indicate a time which should elapse (monitored by a simple timer) after detection of the product by the product sensor before the labelling process begins, or alternatively indicate a distance through which the conveyor should move (as monitored by the encoder) before the labelling process begins. The registration delay may be input to the controller by an operator of the labelling machine. It will be appreciated that by adjusting the registration delay, the position at which a label is affixed to a passing product may be adjusted.

Movement of the label stock during a first portion of a labelling operation is illustrated by the speed/distance graph of FIG. 22. It can be seen that the total distance through which the label stock is moved in dispensing a single label is indicated $N_p$, denoting that the stepper motor turns through $N_p$ steps to cause the movement of the label stock. Having detected a label edge, the stepper motor turns through $N_0$ steps before the label stock comes to rest, where $N_0$ is determined as described below to ensure that a label edge is aligned with the edge of the labelling peel beak. In alternative embodiments which include an encoder which outputs a signal which can be used by the controller to determine an amount of movement of the label stock along the label web path (e.g. an encoder which monitors rotation of a print roller), the total distance through which the label stock is moved in dispensing a single label is indicated $N_p$, denoting the distance measured by the encoder through which the label stock is moved in dispensing a single label. Having detected a label edge, the stepper motor advances the label stock by a distance $N_0$ as measured by the encoder before the label stock comes to rest.

The label stock is accelerated from rest to the target speed $V_t$. The label stock then moves at the target speed $V_t$ before being decelerated to rest. $N_d$ indicates the number of steps through which the stepper motor driving the take up spool support turns to decelerate the label stock. It will be appreciated that the numbers of steps $N_p$ $N_0$ and $N_d$ are determined with reference to the diameter of the take-up spool $d_t$ (which may be determined using any appropriate method, including those described above) as is now described. Although the graph of FIG. 22 shows a simple speed/distance profile for the label stock, it will be appreciated that in some circumstances different speed/distance profiles may be appropriate. In particular, it may sometimes be appropriate to vary the target speed $V_t$ as the label stock is moved. It will also be appreciated that to achieve a particular target linear speed (i.e. speed of label stock moving along the web path) the speed of the take up motor may change during the operation of the labelling machine as a function of changing take up/supply spool diameters.

FIG. 23 is a flow chart showing operation of the labelling machine to feed a single label. Processing begins at step S25 where a check is carried out to determine whether the product sensor has been triggered by a passing product. If this is the case, processing passes to step S29 otherwise, processing remains at step S25 until the product sensor is triggered by a passing product.

At step S29 pulses provided by the line encoder discussed above are counted. At step S30 a check is carried out to determine whether the number of pulses received is equal to the distance which corresponds to a predetermined registration delay $R_d$. If this is not the case processing returns from step S30 to step S29 and a loop is thereby established until the conveyor has moved through the distance specified by the registration delay $R_d$. Processing then passes to step S26

At step S26 a check is carried out to determine whether an additional time registration delay is required. If an additional time registration delay is required, processing passes from step S26 to step S27 where a timer is initialised. Processing then passes to step S28 where a check is carried out to determine whether the elapsed time is equal to the required time registration delay $R_{td}$. Processing remains at step S28 until the elapsed time is equal to the required time registration delay $R_{td}$.

When the distance (and, if applicable, additional time) of the registration delay has passed, processing passes from step S28 or step S26 to step S31, where the controller calculates various parameters required to define the way in which the label stock will be moved. More particularly the controller computes the numbers of steps through which the stepper motor is to be turned to cause the desired movement of the label stock, the number of steps through which the stepper motor should be turned after detection of an edge so as to allow a label edge to be properly aligned with the labelling peel beak, and the step rate $M_r$ at which the stepper motor which drives the take up spool support should be turned given the desired linear label stock speed which is determined as described above.

In some embodiments, the total number of steps $N_p$ through which the stepper motor which drives the take up spool is to be turned is given by equation (20)

$$N_p = L_p \frac{N_{revolution}}{\pi d_t} \tag{20}$$

where $L_P$ is the pitch length of the label stock, $N_{revolution}$ is the number of steps through which the stepper motor turns to rotate the take up spool support a single revolution and $d_t$ is the diameter of the take-up spool.

The distance $E_0$ through which the label stock should be fed following detection of an edge by the gap sensor in order to cause the leading edge of a label to be aligned with the edge of the labelling peal beak can, if required, be converted into a number of steps $N_0$ using equation (21):

$$N_o = E_o \frac{N_{revolution}}{\pi d_t} \tag{21}$$

The step rate $M_r$ at which the take up stepper motor should step is determined with reference to the desired linear speed of the label stock $V_t$ which as described above can either by input by an operator, or alternatively determined using an encoder. The step rate $M_r$ is given by equation (22):

$$M_r = V_t \frac{N_{revolution}}{\pi d_t} \tag{22}$$

Referring again to FIG. 23, having determined the necessary parameters at step S31, processing passes to step S33.

At step S33, the number of steps $N_g$ remaining in the current feed is set to be equal to the total number of steps $N_p$ in a single label feed. A parameter $C_r$ indicating the current step rate is initialized to a value of zero.

In alternative embodiments which include an encoder which outputs a signal which can be used by the controller to determine an amount of movement of the label stock along the label web path (e.g. an encoder which monitors rotation of a print roller), at step S33, if the total distance $N_p$ required to feed a single label is already known then the distance $N_g$ to be measured by the encoder remaining in the current feed is set to be the total distance $N_p$ required to feed a single label. The total distance $N_p$ required to feed a single label may already be known when the pitch of the label web $L_P$ is less than the distance between the gap sensor and the label peel beak. In such cases, the trailing edge of next label to be dispensed during the label feed will have already passed the gap sensor.

However, if the total distance $N_p$ required to feed a single label is not already known then $N_g$ is set to an amount larger than the longest possible pitch of label stock which may be utilised in conjunction with the labelling machine. For example, in some embodiments $N_g$ is set to 500 mm. The total distance $N_p$ required to feed a single label is not already known when the pitch of the label web $L_P$ is greater than the distance between the gap sensor and the label peel beak. In such cases, the trailing edge of next label to be dispensed during the label feed will not yet have passed the gap sensor. Only when the trailing edge of next label to be dispensed during the label feed passes the gap sensor will the remaining distance the label stock has to be advanced to dispense the next label be known.

Processing passes from step S33 to step S34 where a number of steps $N_d$ required to decelerate the label stock from its current speed to rest is determined. $D_{max}$ is the maximum deceleration of the label stock which can be achieved using the take up stepper motor. The maximum deceleration may be determined in any appropriate way known in the art. For example, it may be determined as described in PCT application WO2010/018368 which is incorporated herein by reference. The linear distances through which the label stock is moved to decelerate from a current linear speed $V_c$ to a target linear speed $U_t$ is given by the familiar equation:

$$U_t^2 = V_c^2 - 2D_{max}\, s \tag{23}$$

where s represents distance.

Given that the target linear speed $U_t$ is zero, and rearranging equation (23), the following expression for the linear distance s can be derived:

$$s = \frac{V_c^2}{2D_{max}} \tag{24}$$

The linear distance s can be converted into a number of steps $N_d$, such that equation (24) becomes:

$$N_d = \left(\frac{V_c^2}{2D_{max}}\right)\left(\frac{N_{revolution}}{\pi d_t}\right) \tag{25}$$

Processing passes from step S34 to step S35. At step S35 a check is carried out to determine whether the label position sensor (also referred to as the gap sensor) has detected a label edge. If this is the case, processing passes from step S35 to step S36 where the number of steps remaining in the current label feed $N_g$ is set to be equal to the number of steps $N_0$ through which the label stock should be moved to align a label edge with the labelling peel beak.

In alternative embodiments which include an encoder which outputs a signal which can be used by the controller to determine an amount of movement of the label stock along the label web path (e.g. an encoder which monitors rotation of a print roller), at step S35, if label position sensor (also referred to as the gap sensor) has detected a label edge, and if $N_g$ was set to be an amount larger than the longest possible pitch of label stock which may be utilised in conjunction with the labelling machine at step S33, then processing passes from step S35 to step S36 where the distance as measured by the encoder remaining in the current label feed $N_g$ is set to be the distance $E_0$ through which the label stock should be moved to align a label edge with the labelling peel beak.

Processing then passes to step S37. If a label edge has not been detected by the label position sensor 52, processing passes directly from step S35 to step S37.

At step S37 a check is carried out to determine whether the number of steps remaining in the current feed is equal to zero. If this is the case processing passes to step S38 where the feed ends.

If this is not the case, processing passes to step S39 where a check is carried out to determine whether the number of steps remaining in the current label feed $N_g$ is less than or equal to the number of steps $N_d$ required to decelerate the label stock. If this is the case, processing passes to step S40 where a deceleration step rate is determined. In alternative embodiments which include an encoder which outputs a signal which can be used by the controller to determine an amount of movement of the label stock along the label web path (e.g. an encoder which monitors rotation of a print roller), at step S39, a check is carried out to determine whether the distance remaining in the current label feed $N_g$ based upon the output of the encoder is less than or equal to the distance s required to decelerate the label stock. If this is the case, processing passes to step S40 where a deceleration step rate is determined. Once it has been determined by the controller that the distance remaining in the current label feed $N_g$ based upon the output of the encoder is equal to the distance s required to decelerate the label stock, the controller enters a deceleration mode in which the distance remaining in the current label feed $N_g$ is converted by the controller to a number of steps $N_g$ remaining in the current label feed (which is equal to the number of steps $N_d$ required for the deceleration of the label stock). Subsequent control of the movement of the label stock by the controller in deceleration mode is based upon the number of steps $N_g$ remaining in the current label feed and not on the signal output by the encoder.

The deceleration step rate is determined by determining the lowest rate $C_{r+1}$ at which the motor can be caused to step, given the limitation of the maximum possible deceleration $D_{max}$ and the current step rate $C_r$. It is determined using equation (26):

$$C_{r+1} = \sqrt{C_r^2 - \frac{2D_{max}N_{revolution}}{\pi d_t}} \tag{26}$$

Equation (26) is based upon equation (23) which can be expressed as follows:

$$V_{c+1}^2 = V_c^2 - 2D_{max}\, S_w \tag{27}$$

where $V_c$ is the current linear label stock speed;

$V_{c+1}$ is the new linear label stock speed; and $S_w$ is the linear distance through which the label stock is moved in a single step.

Equation (27) can be rearranged to give:

$$V_{c+1} = \sqrt{V_c^2 - 2D_{max}S_w} \tag{28}$$

The linear distance $S_w$ through which the label stock is moved in a single step is given by equation (29):

$$S_w = \frac{\pi d_t}{N_{revolution}} \tag{29}$$

The new linear label stock speed can be related to a step rate using equation (30):

$$V_{c+1} = \frac{C_{r+1}\pi d_t}{N_{revolution}} \tag{30}$$

Equation (30) can be rearranged to give:

$$C_{r+1} = V_{c+1}\frac{N_{revolution}}{\pi d_t} \tag{31}$$

Substituting equation (28) into equation (31) gives:

$$C_{r+1} = \sqrt{V_c^2 - 2D_{max}S_w}\left(\frac{N_{revolution}}{\pi D_t}\right) \tag{32}$$

The current linear label stock speed $V_c$ is related to the current step rate by equation (33):

$$V_c = \frac{C_r\pi d_t}{N_{revolution}} \tag{33}$$

Substituting equations (29) and (33) into equation (32) gives:

$$C_{r+1} = \left(\sqrt{\left(\frac{C_r \cdot \pi d_t}{N_{revolution}}\right)^2 - 2D_{max}\frac{\pi d_t}{N_{revolution}}}\right)\frac{N_{revolution}}{\pi d_t} \tag{34}$$

Equation (34) can be rearranged to give equation (26), viz:

$$\begin{aligned} C_{r+1}^2 &= \left(\left(\frac{C_r \cdot \pi d_t}{N_{revolution}\cdot}\right)^2 - 2D_{max}\frac{\pi d_t}{N_{revolution}\cdot}\right)\cdot\left(\frac{N_{revolution}\cdot}{\pi d_t}\right)^2 = \\ &\left(\frac{(C_r \cdot \pi d_t)^2}{(N_{revolution}\cdot)^2} - 2D_{max}\frac{\pi d_t}{N_{revolution}\cdot}\right)\cdot\frac{(N_{revolution}\cdot)^2}{(\pi d_t)^2} = \\ &\left(\frac{C_r^2 \cdot \pi d_t^2}{(N_{revolution}\cdot)^2} - 2D_{max}\frac{\pi d_t}{N_{revolution}\cdot}\right)\cdot\frac{(N_{revolution}\cdot)^2}{(\pi d_t)^2} = \\ &\left(\frac{C_r^2}{(N_{revolution}\cdot)^2} - 2D_{max}\frac{1}{N_{revolution}\cdot\cdot\pi d_t}\right)\cdot(N_{revolution}\cdot)^2 = \\ &C_r^2 - 2D_{max}\frac{N_{revolution}}{\pi d_t} \\ \therefore C_{r+1} &= \sqrt{C_r^2 - \frac{2D_{max}N_{revolution}}{\pi d_t}} \end{aligned} \tag{26}$$

Referring back to FIG. 23, having determined a step rate to effect deceleration at step S40, processing passes to step S51, which is described in further detail below.

If the check of step S39 determines that the number of steps remaining in the current label feed $N_g$ is not less than or equal to the number of steps $N_d$ required to decelerate the label stock, (or that the distance $N_g$ remaining in the current label feed is not less than or equal to the distance s required to decelerate the label stock) processing passes to step S41.

The check of step S39 is required to ensure proper operation where the target speed $V_t$ and consequently the target step rate $M_r$ varies during movement of the label stock. If it were the case that the target step rate did not vary, the check of step 39 need not be carried out.

At step S41 a check is carried out to determine whether the current step rate is too fast. This check determines whether the inequality of equation (35) is true:

$$C_r > M_r \tag{35}$$

If this is the case, processing passes from step S41 to step S42, where a step rate to effect deceleration is calculated using equation (26) set out above. Processing passes from step S42 to step S43 where a check is carried out to determine whether the step rate determined at step S42 is less than the target step rate $M_r$ if this is the case, the step rate is set to be equal to the target step rate $M_r$ at step S44. Processing passes from step S44 to step S51, otherwise, processing passes directly from step S43 to step S51.

If the check of step S41 indicates that the step rate is not too high, processing passes from step S41 to step S45. At step S45 a check is carried out to determine whether it is possible to accelerate the label stock, and still have a sufficient number of steps to decelerate the label stock to rest, given the number of steps $N_g$ remaining in the current feed. This is determined by determining whether the number of steps $N_g$ remaining in the current feed is greater than or equal to one more than the number of steps required to decelerate the label stock to rest if the label stock is accelerated. If this is not the case, it is determined that the label stock should not be accelerated, and processing passes to step S46 where the step rate is set to remain constant, before processing passes to step S51.

In alternative embodiments which include an encoder which outputs a signal which can be used by the controller to determine an amount of movement of the label stock along the label web path (e.g. an encoder which monitors rotation of a print roller), at step S45 a check is carried out to determine whether it is possible to accelerate the label stock, and still have a sufficient distance to decelerate the label stock to rest, given the distance measured by the encoder $N_g$ remaining in the current feed. In order to achieve this the controller may convert the distance $N_g$ remaining in the current feed into an equivalent number of remaining steps of the motor (based upon the diameter of the take up spool) and determine whether the remaining number of steps is greater than or equal to one more than the number of steps required to decelerate the label stock to rest if the label stock is accelerated. If this is not the case, it is determined that the label stock should not be accelerated, and processing passes to step S46 where the step rate is set to remain constant, before processing passes to step S51.

If the check of step S45 is satisfied (i.e. acceleration can be carried out while still allowing sufficient steps for deceleration of the label stock to rest), processing passes from step S45 to step S47. Here a check is carried out to determine whether the current step rate is less than a target step rate. If this is the case, a step rate to effect acceleration is calculated at step S48, according to equation (36):

$$C_{r+1} = \sqrt{C_r^2 + \frac{2A_{max}N_{revolution}}{\pi d_t}} \tag{36}$$

where $A_{max}$ is the maximum possible acceleration.

It can be seen that equation (36) has a similar form to equation (26) and its derivation therefore has the general form set out above.

Processing passes from step S48 to step S49 where a check is carried out to determine whether the step rate $C_{r+1}$ calculated at step S48 exceeds the target step rate $M_r$. If this is the case, the step rate $C_{r+1}$ is set to be equal to the target step rate at step S50, before processing passes from step S50 to step S51. If the step rate $C_{r+1}$ calculated at step S48 does not exceed the target step rate $M_r$ processing passes directly from step S49 to step S51. At step S51 the motor is caused to turn one step at the determined step rate.

If the check of step S47 determines that the current step rate is not too slow, processing passes from step S47 to step S52. It is known (given operation of steps S41 and S47 that the step rate is equal to the target step rate, and the motor is turned through one step at that step rate at step S52.

Processing passes from each of steps S51 and S52 to step S53 where the number of steps remaining in the current feed $N_g$ is decremented by one, before processing returns to step S34.

In alternative embodiments which include an encoder which outputs a signal which can be used by the controller to determine an amount of movement of the label stock along the label web path (e.g. an encoder which monitors rotation of a print roller), if the label stock is not being decelerated (i.e. if the distance remaining in the current label feed $N_g$ based upon the output of the encoder is greater than the distance s required to decelerate the label stock) then step S53 is omitted such that processing passes back to step S34. In such embodiments an encoder increment/decrement routine shown schematically in a flow chart of FIG. 24 is processed concurrently with the routine shown schematically in the flow chart of FIG. 23.

Referring to FIG. 24, at step E1 the controller monitors the encoder. At step E2 the controller waits until an update from the encoder is available. If an update from the encoder is available (e.g. if the encoder has output a signal which is indicative of movement), processing passes to step E3.

In this particular embodiment the encoder can output a first type of pulse which is indicative of the label stock advancing forward along the label web path (i.e. towards the take up spool) by a distance $E_d$. The encoder can also output a second type of pulse which is indicative of the label stock retreating backward along the label web path (i.e. towards the supply spool) by a distance $E_d$.

At step E3 the controller processes the signal received from the encoder and determines whether the signal is indicative of the label stock advancing forward along the label web path (i.e. towards the take up spool) or whether the signal is indicative of the label stock retreating backward along the label web path (i.e. towards the supply spool). In this embodiment, if the encoder outputs the first type of pulse then the label stock has advanced forward and processing passes to step E4. If the encoder outputs the second type of pulse then the label stock has retreated backward and processing passes to step E5.

At step E4 the controller sets the value of the distance $N_g$ remaining in the current feed to be equal to the current value of the distance $N_g$ remaining in the current feed minus distance $E_d$.

At step E5 the controller sets the value of the distance $N_g$ remaining in the current feed to be equal to the current value of the distance $N_g$ remaining in the current feed plus distance $E_d$.

After either steps E4 and E5 processing returns to step E1.

Various features of the labelling machine have been described above. In some cases, exemplary components, configurations and methods suitable for realising these particular features have been described. However in many cases the skilled person will know of other components, configurations and methods which can similarly be used to realise the particular features which are described. Many of these components, configurations and methods will be known to the skilled person from the common general knowledge. It is envisaged that such alternative components, configurations and methods can be implemented in the described embodiments without difficulty given the disclosure presented herein.

While references have been made herein to a controller or controllers it will be appreciated that control functionality described herein can be provided by one or more controllers. Such controllers can take any suitable form. For example control may be provided by one or more appropriately programmed microprocessors (having associated storage for program code, such storage including volatile and/or non-volatile storage). Alternatively or additionally control may be provided by other control hardware such as, but not limited to, application specific integrated circuits (ASICs) and/or one or more appropriately configured field programmable gate arrays (FPGAs).

Where angles have been specified herein, such angles are measured in radians although modifications to use other angular measurements will be apparent to the skilled person.

While various embodiments of labelling machine(s) have been described herein, it will be appreciated that this description is in all respects illustrative, not restrictive. Various modifications will be apparent to the skilled person without departing from the spirit and scope of the invention.

The invention claimed is:

1. A method of operating a labelling machine, the labelling machine comprising a supply spool support, a take-up spool support, a motive device, a first arrangement, a controller and a brake assembly;

the method comprising:

the supply spool support supporting a supply spool comprising a label stock;

the take-up spool support taking up a portion of the label stock;

the motive device propelling the label stock along a web path from the supply spool support towards the take-up spool support;

the first arrangement producing a first signal indicative of a speed at which the label stock is removed from the supply spool by the motive device;

the controller receiving the first signal and outputting a brake assembly control signal based upon the first signal;

the brake assembly applying a braking force to the supply spool support based upon the brake assembly control signal, the braking force resisting rotation of the supply spool support;

the controller outputting the brake assembly control signal based upon a target supply spool speed.

2. A method of operating a labelling machine, the labelling machine comprising a supply spool support; a take-up spool support; a motive device; a movable element biased by a resilient biasing member in a first direction towards a home position, movement of the moveable element in the first direction increasing a length of a web path; a first arrangement; a second arrangement; a controller; and a brake assembly; the method comprising:

the supply spool support supporting a supply spool comprising a label stock;

the take-up spool support taking up a portion of the label stock;

the movable element defining a portion of the web path between the supply spool and the take-up spool support;

the first arrangement producing a first signal indicative of movement of the movable element and providing said first signal to the controller;

the controller outputting a brake assembly control signal which commands the brake assembly to apply a braking force to the supply spool support to substantially prevent rotation of the supply spool support;

the controller commanding the motive device to move the label stock along the web path in a reverse direction from the take-up spool support towards the supply spool such that a position of the movable element is moved by the resilient biasing member in the first direction from a first position to the home position;

the second arrangement producing a second signal indicative of the movable element being located at the home position;

the controller determining the first position of the movable element relative to the home position based on the first and second signals.

3. A method according to claim 2, wherein the movable element is a dancing arm.

4. A method according to claim 2, wherein the resilient biasing member is a tension spring.

5. A method according to claim 2, wherein a tension in the label stock changes based upon the position of the movable element.

6. A method according to claim 5, wherein the tension decreases as the movable element moves towards the home position.

7. A method according to claim 2, wherein the length of the web path between the supply spool and the take-up spool support changes based on the position of the movable element.

8. A method according to claim 7, wherein the length of the web path between the supply spool and the take-up spool support increases as the movable element moves towards the home position.

9. A method according to claim 2, wherein the motive device drives the take-up spool support for rotation.

10. A method according to claim 3, wherein the motive device is a stepper motor.

11. A method according to claim 2, wherein the first arrangement is a sensor configured such that the first signal is pulsed, a pulse corresponding to each time the movable element moves by a first distance.

12. A method according to claim 2, wherein the first distance is an angular distance.

* * * * *